US007381118B2

(12) United States Patent
Wall et al.

(10) Patent No.: US 7,381,118 B2
(45) Date of Patent: Jun. 3, 2008

(54) BELT SANDER

(75) Inventors: Daniel P. Wall, Humboldt, TN (US); Craig A. Carroll, Milan, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/786,471

(22) Filed: Apr. 12, 2007

(65) Prior Publication Data

US 2007/0197149 A1 Aug. 23, 2007

Related U.S. Application Data

(63) Continuation of application No. 11/334,960, filed on Jan. 19, 2006, and a continuation-in-part of application No. 11/089,447, filed on Mar. 24, 2005, now Pat. No. 7,235,005.

(60) Provisional application No. 60/757,818, filed on Jan. 11, 2006.

(51) Int. Cl.
*B25B 7/12* (2006.01)

(52) U.S. Cl. ..... 451/355; 451/292; 451/344

(58) Field of Classification Search ..... 451/292, 451/344, 355

See application file for complete search history.

(56) References Cited

U.S. PATENT DOCUMENTS

| | | | | |
|---|---|---|---|---|
| 1,587,124 | A * | 6/1926 | Lacy | 451/350 |
| 2,199,069 | A * | 4/1940 | Fowler | 451/303 |
| 2,232,149 | A | 2/1941 | Tautz | |
| 2,260,949 | A | 10/1941 | Mall | |
| 2,289,481 | A | 7/1942 | Burleigh | |
| 2,592,581 | A * | 4/1952 | Lorig | 226/3 |
| 2,742,741 | A | 4/1956 | Lars | |
| 2,783,818 | A | 3/1957 | Kenny | |
| 3,312,116 | A | 4/1967 | Blevins | |
| 3,331,165 | A | 7/1967 | Blevins | |
| 3,334,447 | A * | 8/1967 | Leveque | 451/303 |
| 3,359,689 | A | 12/1967 | McCarty et al. | |
| 3,362,111 | A | 1/1968 | Foell et al. | |
| 3,363,367 | A | 1/1968 | Blevins et al. | |

(Continued)

FOREIGN PATENT DOCUMENTS

DE 831648 2/1952

(Continued)

OTHER PUBLICATIONS

Bosch 2002/2003 Catalog, 80-81.

(Continued)

*Primary Examiner*—Joseph J. Hail, III
*Assistant Examiner*—Shantese L McDonald
(74) *Attorney, Agent, or Firm*—Brake Hughes Bellermann LLP

(57) ABSTRACT

A belt sander is disclosed that may include a sanding assembly having a first roller and a second roller, the sanding assembly being configured to receive a sanding belt around the first roller and the second roller to define a sanding surface therebetweeen. The belt sander may include a motor operationally coupled to the sanding assembly and opposite the sanding surface, the motor being configured to rotate at least the first roller and thereby rotate the sanding belt around the first roller and the second roller, as well as a handgrip formed around at least a portion of the motor and substantially encasing the motor.

15 Claims, 37 Drawing Sheets

U.S. PATENT DOCUMENTS

| | | | | |
|---|---|---|---|---|
| 3,393,573 | A | | 7/1968 | Beckering et al. |
| 3,431,686 | A | | 3/1969 | Bergler |
| 3,566,548 | A | | 3/1971 | Beckering et al. |
| 3,682,010 | A | | 8/1972 | Brooks et al. |
| 3,757,382 | A | | 9/1973 | Brooks et al. |
| 4,075,523 | A | | 2/1978 | Lafferty |
| 4,115,957 | A | | 9/1978 | Porth et al. |
| 4,118,797 | A | | 10/1978 | Tarpley |
| 4,163,167 | A | | 7/1979 | Zelt et al. |
| 4,177,609 | A | | 12/1979 | Rameckers et al. |
| 4,195,449 | A | | 4/1980 | Scarpa |
| D255,319 | S | | 6/1980 | Schultz et al. |
| 4,213,288 | A | | 7/1980 | Takeuchi et al. |
| 4,242,839 | A | | 1/1981 | Armbruster et al. |
| 4,305,180 | A | | 12/1981 | Schwartz |
| 4,316,349 | A | | 2/1982 | Nelson |
| 4,334,390 | A | | 6/1982 | Sumerau |
| 4,403,454 | A | | 9/1983 | Glore et al. |
| 4,411,106 | A | | 10/1983 | Fleckenstein et al. |
| 4,420,703 | A | | 12/1983 | Adam et al. |
| 4,559,465 | A | | 12/1985 | Gagneux |
| D282,078 | S | | 1/1986 | House, II |
| 4,574,531 | A | | 3/1986 | McCurry |
| 4,584,797 | A | * | 4/1986 | Wanninkhof et al. ..... 451/355 |
| 4,593,220 | A | | 6/1986 | Cousins et al. |
| D286,737 | S | | 11/1986 | House, II |
| 4,627,624 | A | | 12/1986 | Usui |
| 4,638,196 | A | | 1/1987 | Kranzler |
| 4,673,837 | A | | 6/1987 | Gingerich et al. |
| 4,677,329 | A | | 6/1987 | Secoura |
| 4,748,353 | A | | 5/1988 | Klingentein et al. |
| 4,896,462 | A | | 1/1990 | Farmerie |
| 4,924,633 | A | | 5/1990 | Hock et al. |
| 5,007,205 | A | | 4/1991 | Farmerie |
| 5,251,406 | A | | 10/1993 | Kirm |
| 5,319,887 | A | | 6/1994 | Walz et al. |
| 5,397,952 | A | | 3/1995 | Decker et al. |
| 5,403,229 | A | | 4/1995 | Seli |
| 5,833,524 | A | | 11/1998 | Satoh et al. |
| 5,860,854 | A | | 1/1999 | Sakoh et al. |
| 6,031,313 | A | | 2/2000 | Sugai |
| 6,048,297 | A | | 4/2000 | Lange et al. |
| 6,163,096 | A | | 12/2000 | Michenfelder et al. |
| 6,174,226 | B1 | | 1/2001 | Frech et al. |
| 6,206,771 | B1 | | 3/2001 | Lehman |
| 6,218,746 | B1 | | 4/2001 | Gouge |
| 6,419,569 | B1 | | 7/2002 | Frech et al. |
| 6,494,636 | B1 | | 12/2002 | Mozena |
| 6,544,112 | B1 | | 4/2003 | Fuchs |
| 6,617,726 | B1 | | 9/2003 | Tsergas |
| 6,632,128 | B2 | | 10/2003 | Berger et al. |
| 6,648,737 | B2 | | 11/2003 | Deware |
| D487,008 | S | | 2/2004 | Andriolo |
| 6,688,349 | B2 | | 2/2004 | Razlan et al. |
| 6,725,892 | B2 | | 4/2004 | McDonald et al. |
| 6,744,170 | B1 | | 6/2004 | Du |
| D492,563 | S | | 7/2004 | Wright |
| 6,758,731 | B2 | | 7/2004 | Dutterer |
| D508,833 | S | | 8/2005 | Brazeel |
| 7,034,431 | B2 | | 4/2006 | Kapitza |
| D520,317 | S | | 5/2006 | Robson |
| 7,101,274 | B1 | | 9/2006 | Etter et al. |
| D529,775 | S | | 10/2006 | Leasure |
| 2002/0009960 | A1 | | 1/2002 | Swaddle |
| 2005/0048883 | A1 | | 3/2005 | Melvin et al. |
| 2005/0079810 | A1 | | 4/2005 | Melvin et al. |
| 2005/0146239 | A1 | | 7/2005 | Kapitza |
| 2005/0264127 | A1 | | 12/2005 | Benkert |
| 2005/0272356 | A1 | | 12/2005 | Walker et al. |
| 2005/0272357 | A1 | | 12/2005 | Walker |
| 2006/0264161 | A1 | | 11/2006 | Schnell et al. |

FOREIGN PATENT DOCUMENTS

| | | | |
|---|---|---|---|
| DE | 1732411 | | 10/1956 |
| DE | 1008066 | | 5/1957 |
| DE | 1958046 | | 3/1967 |
| DE | P1577295.9 | | 1/1970 |
| DE | 2121182 | | 11/1971 |
| DE | 7424571 | | 10/1974 |
| DE | 7436615 | | 5/1976 |
| DE | 2632184 | | 3/1977 |
| DE | P2709538.1 | | 10/1977 |
| DE | 2841357 | | 4/1979 |
| DE | 7907875 | | 7/1979 |
| DE | 3147418 | | 6/1983 |
| DE | 3390138 | | 7/1984 |
| DE | 8520256 | | 10/1985 |
| DE | 8520258 | | 10/1985 |
| DE | P3506034.4 | | 8/1986 |
| DE | P3535636.7 | | 4/1987 |
| DE | 8800465.1 | | 5/1988 |
| DE | 3644389 | | 7/1988 |
| DE | 3644390 | | 7/1988 |
| DE | 3731157.3 | | 3/1989 |
| DE | P3920500.2 | | 12/1989 |
| DE | 3920499.5 | | 1/1990 |
| DE | P3823391.6 | | 1/1990 |
| DE | P3823392.4 | | 1/1990 |
| DE | P3919651 | | 1/1993 |
| DE | 19513279.3 | | 2/1996 |
| DE | P4432974.1 | | 3/1996 |
| DE | 19515803.2 | | 10/1996 |
| DE | 19704086.1 | | 8/1998 |
| DE | 19704110.8 | | 8/1998 |
| DE | 19851064.0 | | 6/1999 |
| DE | 49812037 | | 8/1999 |
| DE | 20001371 | | 7/2001 |
| DE | 40107535 | | 4/2002 |
| DE | 059818 | | 6/2002 |
| DE | 10002035.6 | | 7/2002 |
| DE | 40109686.6 | | 7/2002 |
| DE | 40205807.0 | | 11/2002 |
| DE | 062572 | | 2/2003 |
| DE | 10203489.3 | | 7/2003 |
| DE | 40303994.0 | | 11/2003 |
| DE | 19913020 | | 5/2004 |
| DE | 10314695.4 | | 10/2004 |
| DE | 10319173.9 | | 11/2004 |
| DE | 40401047.4 | | 11/2004 |
| DE | 10347697.3 | | 5/2005 |
| DE | 40500318.8 | | 9/2005 |
| EP | 0007172 | | 1/1980 |
| EP | 0088234 | A1 | 9/1983 |
| EP | 0158065 | | 10/1985 |
| EP | 0168531 | | 1/1986 |
| EP | 0195929 | | 10/1986 |
| EP | 0479783 | | 4/1992 |
| EP | 0472548 | | 8/1994 |
| EP | 0548782 | | 4/1997 |
| EP | 0851541 | | 7/1998 |
| EP | 0920723 | | 6/1999 |
| EP | 0935318 | | 8/1999 |
| EP | 1013383 | | 6/2000 |
| EP | 1129822 | | 9/2001 |
| EP | 1175281 | | 1/2002 |
| EP | 1528656 | | 5/2005 |
| EP | 1604780 | | 12/2005 |
| EP | 1604781 | | 12/2005 |
| GB | 1075904 | | 7/1967 |

| | | | |
|---|---|---|---|
| GB | 1081736 | | 8/1967 |
| GB | 2321865 | | 8/1998 |
| WO | WO88/00110 | | 1/1988 |
| WO | WO-2005/102603 | | 11/2005 |
| WO | WO-2006078966 | A2 | 7/2006 |

OTHER PUBLICATIONS

Porter Cable 2004-2005 Catalog, 42-44.

* cited by examiner

BELT SANDER

CROSS-REFERENCE TO RELATED APPLICATIONS

This application claims priority under 35 U.S.C. 120 to, and is a continuation of, U.S. application Ser. No. 11/334,960, filed Jan. 19, 2006, and titled, "BELT SANDER," which (i) claims priority under 35 U.S.C. 120 to, and is a continuation-in-part of, U.S. application Ser. No. 11/089,447, filed Mar. 24, 2005, now U.S. Pat. No. 7,235,005 and titled, "BELT SANDER," and which (ii) claims priority under 35 U.S.C. 119 to U.S. Provisional Application 60/757,818, filed Jan. 11, 2006, and titled "BELT SANDER." The above-identified applications are incorporated by reference in their entirety.

TECHNICAL FIELD

This description relates to belt sanders.

BACKGROUND

Woodworkers often wish to smooth a surface of a workpiece prior to the completion of a woodworking project. For example, many workpieces require at least a minimal amount of sanding in order to remove any excess glue or rough edges, prior to completion of the project. Different types of sanders may be used for such sanding, e.g., to improve a surface quality and appearance of the workpiece. For example, such sanders may include a piece of sandpaper held in the woodworker's hand, or may include automated sanders, such as orbital sanders or quarter pad finishing sanders.

A belt sander is another example of a type of sander. Belt sanders generally include some mechanism for maintaining a sanding belt around two rollers. During operation, such belt sanders are designed to provide sufficient tension to the sanding belt to avoid skewing thereof, while avoiding excess tension that may lead to a breaking of the sanding belt.

SUMMARY

According to one general aspect, a belt sander includes a sanding assembly having a first roller and a second roller, the sanding assembly being configured to receive a sanding belt around the first roller and the second roller to define a sanding surface therebetweeen. The belt sander also includes a motor operationally coupled to the sanding assembly and opposite the sanding surface, the motor being configured to rotate at least the first roller and thereby rotate the sanding belt around the first roller and the second roller, and a handgrip formed around at least a portion of the motor and substantially encasing the motor.

Implementations may include one or more of the following features. For example, the motor may be oriented in-line with a longitudinal axis along the belt sander and intersecting the first roller and the second roller. A center of gravity of the belt sander may be substantially centered over the sanding assembly. The motor may be included within a three-dimensional area defined by a perimeter of the sanding assembly and extending in a direction of the motor. The motor may include an alternating-current motor.

A gear train coupling the motor to the first roller may be included, the gear train including a cross-axis gearing configured to translate a rotation of a motor shaft of the motor into a rotation of a drive pulley shaft that is perpendicular to the motor shaft and parallel to an axis of the first roller. A platen may be disposed between the first roller and the second roller and between the sanding surface and the motor, and a center of gravity of the belt sander may be substantially centered over the platen. The platen may have a length that is approximately less than 150 mm.

An entry area for a power cord may be included at a rear of the belt sander and contoured for gripping during operation of the belt sander. A detachable auxiliary handle mounted at a front of the belt sander also may be included.

A length of the belt sander may be less than approximately 350 mm. A distance between a first axis of the first roller and a second axis of the second roller may be less than approximately 250 mm. A width of the handgrip may be less than approximately 100 mm. The motor may be configured to provide at least 0.25 hp in driving the sanding belt. The sanding belt may be at least 300 mm in length, and the motor may be configured to drive the sanding belt at a minimum of 600 sfpm.

A tracking mechanism may be included, and the tracking mechanism may include a sidewall of the belt sander, a yoke having a roller mount at a front end that is configured for mounting the front roller of the belt sander, the yoke being supported by the sidewall, a pivot pin mounted between the sidewall and the roller mount, and a tracking shaft extending through the sidewall and positioned to move against the yoke and pivot the yoke about the pivot pin. Additionally, or alternatively, a belt tracking mechanism may be included, the belt tracking mechanism including a frame supporting the second roller as an idle roller, said idle roller having an idle roller axle, said idle roller revolving about said idle roller axle, and a yoke supporting said idle roller axle, said yoke lying substantially orthogonal to said idle roller axis and allowing said idle roller and idle roller axis to freely translate along a longitudinal direction, while constraining said idle roller axis from movement along a vertical direction substantially orthogonal to said longitudinal direction.

A brush mounting system may be included that includes a concave brush card having a first brush box and a second brush box attached proximate a first end and a second end of the brush card, and at least one fastener attaching the brush card around a commutator of the motor of the belt sander with the first brush box and the second brush box positioned to provide contact to corresponding motor brushes and substantially opposing sides of the commutator.

According to another general aspect, a belt sander includes a sanding assembly including a rear roller, a front roller, the sanding assembly being configured to receive and rotate a sanding belt around the rear roller and the front roller during operation of the belt sander. The belt sander includes a motor mounted over the sanding assembly and balanced with respect to the sanding assembly in a direction substantially parallel to an axis of the rear roller, and a handgrip at least partially encasing the motor.

Implementations may include one or more of the following features. For example, the handgrip may substantially encase the motor above the sanding assembly. A lower portion of the handgrip may be at or below a bottom of the motor. A cross-axis gearing may be included that is operably connected to the motor and that may be operable to translate a motion of the motor into a rotation of the rear roller. The motor may include an alternating current motor.

According to another general aspect, a sanding assembly is attached to a gear housing, the sanding assembly being configured to receive a sanding belt and including a rear roller and a front roller. A motor is attached to the gear housing above the sanding assembly, the motor being mounted in-line with an axis that intersects the rear roller and the front roller. A handgrip is attached at least partially encasing the motor.

Implementations may include one or more of the following features. For example, in attaching the handgrip, the handgrip may be attached with a lower portion of the handgrip at or below a bottom of the motor, and/or the handgrip may be attached substantially encasing the motor above the sanding assembly. In attaching the sanding assembly, a tracking box may be attached that may include a tracking mechanism configured to provide a tracking of the sanding belt on the sanding assembly.

According to another general aspect, a belt sander includes a sanding assembly having a first roller and a second roller, the sanding assembly being configured to receive a sanding belt around the first roller and the second roller to define a sanding surface therebetweeen, a motor operationally coupled to the sanding assembly and opposite the sanding surface, the motor being configured to provide at least 0.25 hp to rotate at least the first roller and thereby rotate the sanding belt around the first roller and the second roller, and a handgrip having a width of less than approximately 100 mm.

Implementations may include one or more of the following features. For example, the handgrip may be formed around at least a portion of the motor and substantially encasing the motor.

According to another general aspect, a belt sander includes a sanding assembly having a first roller and a second roller, the sanding assembly being configured to receive a sanding belt around the first roller and the second roller to define a sanding surface therebetweeen, and a motor operationally coupled to the sanding assembly and opposite the sanding surface, the motor being configured to provide at least 0.25 hp to rotate at least the first roller and thereby rotate the sanding belt around the first roller and the second roller, wherein the belt sander has a length of less than approximately 350 mm.

Implementations may include one or more of the following features. For example, the handgrip may be formed around at least a portion of the motor and substantially encasing the motor.

According to another general aspect, a tracking mechanism for a belt sander includes a sidewall of the belt sander, and a yoke having a roller mount at a front end that is configured for mounting a front roller of the belt sander, the yoke being supported by the sidewall. A pivot pin is mounted between the sidewall and the roller mount, and a tracking shaft extends through the sidewall and is positioned to move against the yoke and pivot the yoke about the pivot pin.

Implementations may include one or more of the following features. For example, a side-loaded spring may be loaded against the yoke on a side of the belt sander opposite to the sidewall, the pivot pin, and the tracking shaft. The tracking shaft may be movable against the yoke in response to a user rotation of a tracking knob attached thereto and exterior to the belt sander. Movement of the tracking shaft against the yoke may alter an angle of a front roller of the belt sander relative to a rear roller of the belt sander.

The sidewall may include a groove in which the pivot pin is mounted. The pivot pin may be fixed to the sidewall and slidable against the roller mount to allow longitudinal movement of the yoke relative to the sidewall. The pivot pin may be fixed to the roller mount and slidable against a groove of the sidewall to allow longitudinal movement of the yoke relative to the sidewall. A distance from the tracking shaft to the pivot pin may be within a range of 70-100 mm, e.g., may be within a range of 84-92 mm. A distance from the tracking shaft to the pivot pin may be maximized relative to one or more of a length of the belt sander, a length of the sanding belt, a distance between a front axis of the front roller and a rear axis of a rear roller of the belt sander, and/or a length of a platen disposed in contact with the sanding belt during operation of the belt sander.

A tracking box may be mounted on the sidewall that contains slots in which the yoke is mounted. A degree of movement of the tracking shaft may be selectable to provide a desired tracking of a sanding belt on the front roller and a rear roller of the belt sander.

According to another general aspect, a tracking mechanism for a belt sander includes a roller mount configured to hold a front roller of the belt sander, a pivot pin in contact with the roller mount and a sidewall of the belt sander, and a tracking shaft extending through the sidewall and movable against a yoke attached to the roller mount, for rotation of the roller mount about the pivot pin.

Implementations may include one or more of the following features. For example, A spring may be included on an opposite side of the yoke from the pivot pin and tracking shaft and may load the yoke against the pivot pin and tracking shaft. The yoke may be mounted within slots of a tracking box that is mounted on the sidewall. Rotation of the roller mount about the pivot pin may adjust a degree of parallelism between the front roller and a rear roller of the belt sander. The tracking shaft may extend through the sidewall between a rear roller of the belt sander and the front roller, and the tracking shaft may be located toward the rear roller.

According to another general aspect, a tracking mechanism of a belt sander is constructed. A sidewall of the belt sander is formed, the sidewall including a bore and a groove. A tracking shaft is inserted through the bore, a pivot pin is positioned in the groove, and a roller mount configured to hold the front roller is mounted against the pivot pin. A yoke attached to the roller mount is positioned against the tracking shaft, and the yoke and the roller mount are loaded against the tracking shaft and pivot pin, respectively.

Implementations may include one or more of the following features. For example, in loading the yoke and the roller mount a spring may be positioned against the yoke on a side of the belt sander opposite the sidewall. A tracking knob may be mounted on an end of the tracking shaft exterior to the belt sander, wherein rotation of the tracking knob may be translated into motion of the tracking shaft against the yoke and corresponding rotation of the roller mount about the pivot pin.

According to another general aspect, a belt tension control mechanism for a belt sander includes a yoke having a roller mount configured to support a front roller, the yoke having a surface extending away from the roller mount and being movable with respect to a rear roller, a flange attached to the surface and at an angle with the surface, a cam shaft having grooves formed therein and extending through the frame, the cam shaft having a cam extending therefrom in a vicinity of the flange, a knob having mated grooves formed therein and configured to allow sliding of the knob onto the cam shaft, and a belt tension knob that is exterior to a frame of the belt sander and configured for rotation thereof to provide contact between the cam and the flange and resulting motion of the yoke and the roller mount in a direction toward the rear roller.

Implementations may include one or more of the following features. For example, the motion of the roller mount toward the rear roller may be sufficient to permit installation of a sanding belt around the rear roller and the front roller for operation of the belt sander therewith. A spring loading the yoke and roller mount in a direction away from the rear roller also may be included.

According to another general aspect, a tracking box for a belt sander includes a frame attached to a sidewall of the belt sander between a front roller and a rear roller of the belt sander, the frame having a front portion and a bottom portion, and having at least one groove along a length of the front portion. A platen is included having a top surface, and having a flange formed above the top surface at one end thereof and inserted into the groove to maintain the top surface of the platen relative to the bottom portion of the frame.

Implementations may include one or more of the following features. For example, an adhesive pressure-sensitive surface may be attached to the platen and positioned between the top surface of the platen and the bottom portion of the frame. A tracking box cover may be attached to the frame and may maintain the platen in position with respect to the frame.

The frame may include a secondary groove on a back portion of the frame, the platen may include a secondary flange formed above the top surface of the platen at a second end thereof, and the secondary flange may be inserted into the secondary groove.

The groove and the flange may be substantially triangular in shape. The platen may extend beyond the frame in a direction toward the rear roller. Slots may be formed in the frame that are substantially parallel to an axis of the rear roller, and a yoke may be positioned within the slots, the yoke being attached to a roller mount configured to receive the front roller.

According to another general aspect, a frame is formed having a groove along a first surface thereof. The frame is mounted in front of a rear roller axle of a belt sander, a platen having a flange above a top surface thereof is formed, and the platen is joined to the frame by inserting the flange into the groove to thereby match the top surface of the flange to a bottom surface of the frame.

Implementations may include one or more of the following features. For example, in forming the frame, the frame may be extruded with the groove formed therein. In forming the platen, metal may be stamped into a desired shape of the platen, and/or the flange may be formed in a substantially concave shape.

According to another general aspect, a belt sander includes a first roller, a second roller, a motor operationally coupled to the first roller to cause rotation thereof, a groove formed in the first roller, and a band within the groove, the band being in contact with a sanding belt of the belt sander during operation thereof and configured to impart motion of the first roller to the sanding belt for rotation of the sanding belt around the first roller and the second roller.

Implementations may include one or more of the following features. For example, the groove may be formed substantially centered around a middle of the first roller. The band may include an elastimer and/or rubber material. The rear roller may include a crowning at a center portion thereof.

According to another general aspect, a rear roller of a belt sander is formed. A groove is formed in the rear roller, and a drive band is attached within the groove.

Implementations may include one or more of the following features. For example, in forming the rear roller the rear roller may be formed using Aluminum. In forming the groove, the groove may be formed substantially centered about a middle of the rear roller.

According to another general aspect, a drive mechanism for a belt sander includes a motor, a drive pulley operationally coupled to the motor and rotated by the motor, a driven pulley operationally coupled to a drive roller of the belt sander to rotate the drive roller, and a pre-tensioned drive belt around the drive pulley and the driven pulley to translate rotation of the drive pulley by the motor into rotation of the drive roller, the pre-tensioned drive belt having sufficient pre-tensioning to allow slippage of the pre-tensioned drive belt in response to a selected torque value of the motor.

Implementations may include one or more of the following features. For example, the selected torque value may be outside of a torque range of the motor. An amount of the slippage provided by the pre-tensioned drive belt may be determined to provide time for stoppage of the belt sander in response to a jamming of the belt sander. The selected torque value may be determined based on a torque value that is potentially damaging to the motor and/or associated gears. The selected torque value may be determined based on one or more of: a length of the pre-tensioned drive belt, a diameter of the drive pulley and/or the driven pulley, and/or a center distance between the drive pulley and the driven pulley.

According to another general aspect, a belt sander protection mechanism includes a housing having a sidewall and a topwall joined to the sidewall, the topwall having a slot formed therein that is proximate to a surface of the sidewall, a wear plate having a first end positioned within the slot and maintained against the sidewall, and a tracking box fastened to the housing and trapping a second end of the wear plate between the tracking box and the surface of the sidewall.

Implementations may include one or more of the following features. For example, the wear plate may extend from the sidewall and may contact a sanding belt of the belt sander when the sanding belt skews in a direction of the sidewall. The topwall may be substantially perpendicular to the sidewall. A secondary slot formed in the topwall adjacent to the sidewall may be included, and a secondary wear plate may be maintained against the sidewall by the secondary slot and by the tracking box.

The wear plate may include a ceramic material. The wear plate may be substantially rectangular in shape. Side-locating ribs may be formed in the sidewall and may restrict a motion of the wear plate in a direction parallel to the sidewall.

According to another general aspect, a gear box of a belt sander includes a seal assembly through which a shaft is inserted, the shaft being attached to a gear portion, wherein the seal assembly and gear portion are slip-fit into a bore of the gear box with the gear portion being interior to the seal assembly within the gear box, and a bearing through which the shaft is inserted, the bearing being slip-fit into the bore and exterior to the seal assembly.

Implementations may include one or more of the following features. For example, the gear portion may be positioned relative to the seal assembly to contact the seal assembly and thereby remove the seal assembly from the bore in response to a retraction of the shaft from the gear box.

The seal assembly may include a seal holder having a bore formed therein and containing a lip seal. The gear portion may be positioned relative to the seal assembly to contact the seal holder and thereby remove the seal assembly from the bore in response to a retraction of the shaft from the gear box, substantially without damaging the lip seal. A smallest diameter on a flange of the gear portion may be larger than a diameter of the lip seal. The seal assembly may include a seal holder having a groove formed around an outer perimeter thereof, and the groove may contain an O-ring or a rubber gasket.

The gear portion may include a gear and the shaft may include a jackshaft of a drive pulley that is configured to rotate a drive belt of the belt sander. The gear portion may include a pinion and the shaft may include a motor shaft. The shaft may include a drive pulley shaft and a motor shaft that may be positioned substantially perpendicularly to one another within the gear box.

According to another general aspect, a seal assembly is assembled, and a shaft is inserted through a bearing, the seal assembly, and a gear portion. The gear portion, seal assembly, and bearing are inserted into a bore of a gearbox of a belt sander.

Implementations may include one or more of the following features. For example, in assembling a seal assembly a lip seal may be positioned into a seal holder, and a ring may be placed within a groove formed around an outer perimeter of the seal holder. In inserting a shaft, a drive pulley shaft may be inserted through the bearing, the seal assembly, and the gear portion. In inserting a shaft, a motor shaft may be inserted through the bearing, the seal assembly, and the gear portion.

According to another general aspect, brush mounting system for a belt sander includes a concave brush card having a first brush box and a second brush box attached proximate a first end and a second end of the brush card, and at least one fastener attaching the brush card around a commutator of a motor of the belt sander with the first brush box and the second brush box positioned to provide contact to corresponding motor brushes and substantially opposing sides of the commutator.

Implementations may include one or more of the following features. For example, the brush card may be accessible by removal of a side portion of a handgrip of the belt sander. The brush card may include a first spring associated with the first brush box and loading associated brushes against the commutator to maintain electrical contact therebetween. The brush card may include a second spring associated with the second brush box and loading associated brushes against the commutator to maintain electrical contact therebetween. The first brush box may be mounted onto the brush card with mounting tabs. Electrical contacts may be associated with the first brush box and the second brush box and may be positioned to transmit electrical energy to the brushes when a power switch of the belt sander is turned on. The fastener may include a screw inserted through a substantially center portion of the brush card. The fastener may include at least one mounting tab at an end of the brush card that snaps into a mated opening proximate to the motor.

According to another general aspect, a dust collection system for a belt sander includes an opening formed in a rear of a casing of the belt sander, and a detachable vacuum attachment nozzle that is configured to snap into the opening using tabs at a first end thereof, and configured to receive a vacuum attachment at a second end thereof.

Implementations may include one or more of the following features. For example, the tabs may include detents, and the opening may include detent ribs against which the detents may be snapped into place by an insertion and rotation of the vacuum attachment nozzle.

According to another general aspect, a belt tracking mechanism for a belt sander includes a frame supporting an idle roller, said idle roller having an idle roller axle, said idle roller revolving about said idle roller axle, and a yoke supporting said idle roller axle, said yoke lying substantially orthogonal to said idle roller axis and allowing said idle roller and idle roller axis to freely translate along a longitudinal direction, while constraining said idle roller axis from movement along a vertical direction substantially orthogonal to said longitudinal direction.

Implementations may include one or more of the following features. For example, a side wall of said frame may contain a hollow groove, said yoke may have a protrusion received by said groove to allow said idle roller axis to freely translate along said longitudinal direction while constraining said idle roller axis from movement along a vertical direction substantially orthogonal to said longitudinal direction.

A longitudinally extending compression spring may be included to bias said idle roller along said longitudinal direction, said longitudinally extending compression spring parallel with said yoke. A laterally extending compression spring substantially perpendicular to said longitudinally extending compression spring may be included, said laterally extending compression spring may be connected to a post fixed to said side wall of said frame, and said laterally extending compression spring may be biasing said yoke towards said side wall.

A drive roller may be included having a drive roller axle and supported by said frame, said drive roller and said idle roller receiving a belt for said belt sander. A side wall of said frame may be included, said side wall longitudinally extending, and a mechanism for adjusting the angle formed between said longitudinally extending yoke which supports said idle roller axis, and said longitudinally extending side wall of said frame.

The mechanism for adjusting the angle may include a threaded post fixedly embedded in said side wall, said threaded post spacing the longitudinally extending yoke from said side wall, and said threaded post, in response to rotation of said threaded post within said side wall, extending a lateral distance between said yoke and said side wall, said lateral distance being substantially orthogonal to said longitudinal and vertical directions. Said threaded post may include a rotatable thumbscrew, and said yoke may contact said side wall at a protrusion contact point received by said side wall, and said post may extend along said lateral distance and may be located at a position longitudinal to said protrusion contact point.

According to another general aspect, a belt tracking mechanism includes a frame supporting an idle roller, revolving about an idle roller axis, a drive roller, revolving about a drive roller axis and a platen disposed between said idle and drive rollers. The belt tracking mechanism includes a longitudinally extending side wall of said frame, a longitudinally-extending yoke slideably supported by said side wall, said yoke supporting said idle roller, said idle roller axis substantially orthogonal to said yoke. Said yoke is freely translatable along said longitudinal direction while being substantially constrained from movement along a vertical direction orthogonal to said longitudinal direction.

Implementations may include one or more of the following features. For example, a mechanism for adjusting a degree of parallelism between said idle roller axis and said drive roller axis may be included, where said mechanism may be connected to said frame and configured to adjust a degree of angular separation between the side wall of said frame and said longitudinally extending yoke. Said degree of angular separation may be formed by said mechanism moving said yoke in a lateral direction relative to said side wall, said lateral direction substantially orthogonal to said longitudinal and vertical directions.

Said mechanism for adjusting the degree of parallelism between said idle roller axis and said drive roller axis may include a threaded thumbscrew extending along said lateral direction, with a fork slideably supporting said yoke and attached to said thumbscrew. Said yoke may contact said side wall at a protrusion contact point received by said side wall, and said threaded thumbscrew may be located at position longitudinal to said protrusion contact point. Said side wall of said frame may contain a hollow groove, and said yoke may have a protrusion received by said groove to allow said idle roller axis to freely translate along a longitudinal direction while constraining said idle roller axis from movement along a vertical direction substantially orthogonal to said longitudinal direction.

A longitudinally extending compression spring biasing said idle roller along said longitudinal direction may be included. A laterally extending compression spring substantially perpendicular to said longitudinally extending compression spring may be included, and said laterally extending compression spring may be connected to a post connected to said side wall of said frame, said laterally extending compression spring biasing said yoke towards said side wall.

The details of one or more implementations are set forth in the accompanying drawings and the description below. Other features will be apparent from the description and drawings, and from the claims.

DETAILED DESCRIPTION

Figure 1A:
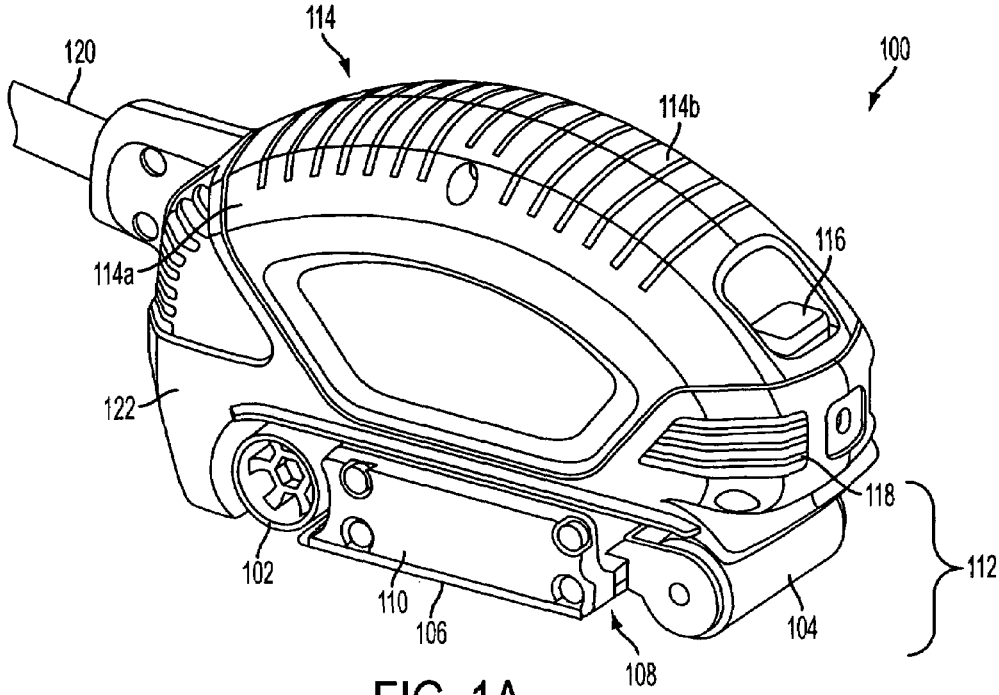
FIGS. 1A and 1B are perspective topside views of an example belt sander.

FIG. 1A is a perspective topside view of an example belt sander 100. The belt sander 100 provides a small, lightweight belt sander that provides sufficient power to perform sanding jobs previously associated with larger, heavier belt sanders. The belt sander 100 may thus be used, for example, by cabinet, trim, or stair installers, or in other applications in which sanding is required to be performed in a fast and thorough manner. For example, in extensive or time-consuming sanding projects, the belt sander 100 may reduce a fatigue of a user, due to the lightweight and maneuverable nature of the belt sander 100. Further, the belt sander 100 provides for sanding in small or relatively inaccessible locations, and, in some implementations, allows for a flexible, multi-positional, one-handed grip. Other features and advantages are described in more detail, below.

In the example of FIG. 1A, the belt sander 100 includes a rear roller 102 and a front roller 104. A continuous sanding belt (not shown in FIG. 1A) may be provided between the rear roller 102 and the front roller 104. In example implementations, rotation of the rear roller 102 (i.e., use of the rear roller 102 as a drive roller) may cause rotation of the sanding belt around the rear roller 102 and the front roller 104. Then, application of the rotating sanding belt to an underlying surface (also not shown in FIG. 1A) may provide fast, thorough smoothing of the surface. In some example implementations, the sanding belt may include a 2.5"×14" sanding belt, although other size sanding belts also may be used.

During rotation, the sanding belt may be pressured against the surface being sanded by a force applied by the user of the belt sander 100, and by a platen 106 disposed between the rear roller 102 and the front roller 104. That is, during rotation, at least a part of the sanding belt is continuously disposed between the platen 106 and the surface being sanded. In some implementations, the platen 106 may be formed from stamped metal, such as, for example, Aluminum or stainless steel.

The platen 106 may be attached to a tracking box 108. As described in more detail below, the tracking box 108 may include one or more tracking mechanisms for ensuring that the sanding belt is maintained between the rear roller 102 and the front roller 104 with proper tension and in a proper position. For example, in a case where the user notices that the sanding belt skews to a particular side during operation of the belt sander 100, such tracking mechanisms may allow the user to adjust a position of the front roller 104 relative to the rear roller 102, in order to counter such skewing.

The tracking box 108 includes, or is associated with, a tracking box cover 110. The tracking box cover 110 may be removable, for access to, and/or repair of, the tracking mechanism(s) or other internal components of the tracking box 108.

Thus, some or all of the components 102-110, and associated components, may be considered to form a sanding assembly 112 for performing the various sanding operations referenced herein, or other sanding operations. As described in more detail below, the sanding assembly 112 may be operated by, and in conjunction with, a motor that is partially or wholly contained within a handgrip 114. The handgrip 114 may thus be grasped during operation of the belt sander 100 by the user, using a single hand if desired/preferred, for use and control of the belt sander 100.

In the implementation of FIG. 1A, the handgrip 114 includes a right clamshell 114*a* and a left clamshell 114*b* (where left/right are defined as shown, and as viewed from a rear of the belt sander 100). Accordingly, the right clamshell 114*a* and the left clamshell 114*b* may be formed, installed, and/or removed independently of one another, so as to provide easy, convenient, and flexible access to an interior of the belt sander 100 (i.e., to an interior of the handgrip 114).

In some implementations, the handgrip 114 may be formed of contoured, overmolded plastic, and/or using glass-filled nylon. Accordingly, the handgrip 114 provides a convenient, reliable, and comfortable gripping surface for the user during operation of the belt sander 100.

Further in FIG. 1A, an on/off switch 116 is provided at a front of the belt sander 100, as shown. Accordingly, the user may quickly and easily access and operate the on/off switch 116 during operation of the belt sander 100. Such accessibility may be important, for example, when the user wishes to stop an operation of the belt sander 100 on short notice. Of course, other switches may be used in conjunction with the on/off switch 116, including, for example, a switch or dial that allows a user-selectable speed of the belt sander 100.

Further in FIG. 1A, a ventilation grill 118 allows for ventilation and cooling of the belt sander 100 (e.g., of an encased motor within the handgrip 114) during operation of the belt sander 100. Meanwhile, a cord 120 provides power to the belt sander 100 from an electrical outlet. Of course, in other implementations, additional or alternate power sources may be used, including, for example, batteries located within a battery compartment (not shown) associated with the belt sander 100.

A casing 122 is illustrated that may be formed of, for example, cast Aluminum. In some implementations, the casing 122 may be formed integrally with the handgrip 114*a*/114*b*.

Figure 1B:
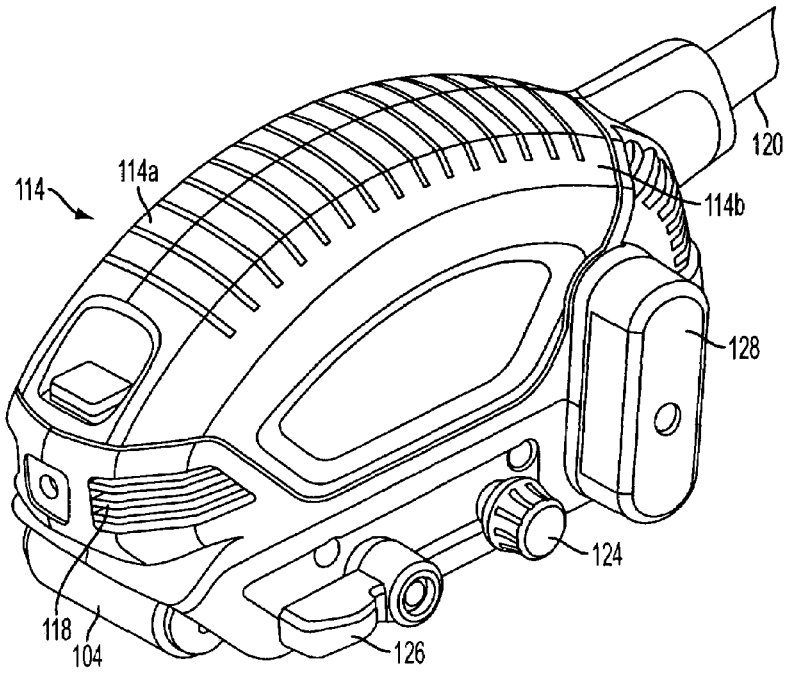

FIG. 1B is a topside perspective view of the belt sander 100 from the opposite side of that shown in FIG. 1A. That is, FIG. 1B illustrates a view of the belt sander 100 from a left side, with respect to the orientation referenced above. Accordingly, the left clamshell 114*b* is in substantially full view in the view of FIG. 1B, as shown.

In FIG. 1B, a tracking knob 124 is illustrated. As described in more detail below, e.g., with reference to FIG. 3, the tracking knob 124 may be used to operate the tracking mechanism(s) contained within the tracking box 108, so as to maintain a proper position and tension of the sanding belt of the belt sander 100.

A belt tension knob 126 may be used to load or unload the sanding belt. For example, as described in more detail below with respect to FIGS. 4A and 4B, the belt tension knob 126 may be rotated upwards to release a tension on the sanding belt (e.g., by moving the front roller 104 in a direction toward the rear roller 102), and may be rotated downward (e.g., into the position shown in FIG. 1B) to increase the tension on the sanding belt 100 for operation thereof.

Also in FIG. 1B, a drive belt cover 128 is illustrated. The drive belt cover 128 is a cover for a drive belt, not shown in FIG. 1B, that is used to translate motion from gears associated with, and rotated by, a motor within the handgrip 114 to the rear roller 102. In this way, the rear roller 102 is used as a drive roller for the belt sander 100, so that the rear roller 102 causes rotation of the sanding paper around the rear roller 102, the platen 106, and the front roller 104. In such implementations, the front roller 104 may be an idle roller that allows rotation of the sanding paper without requiring any source of rotational power other than the driven rotation of the rear roller 102 (along with force applied by the user).

Figure 2A:
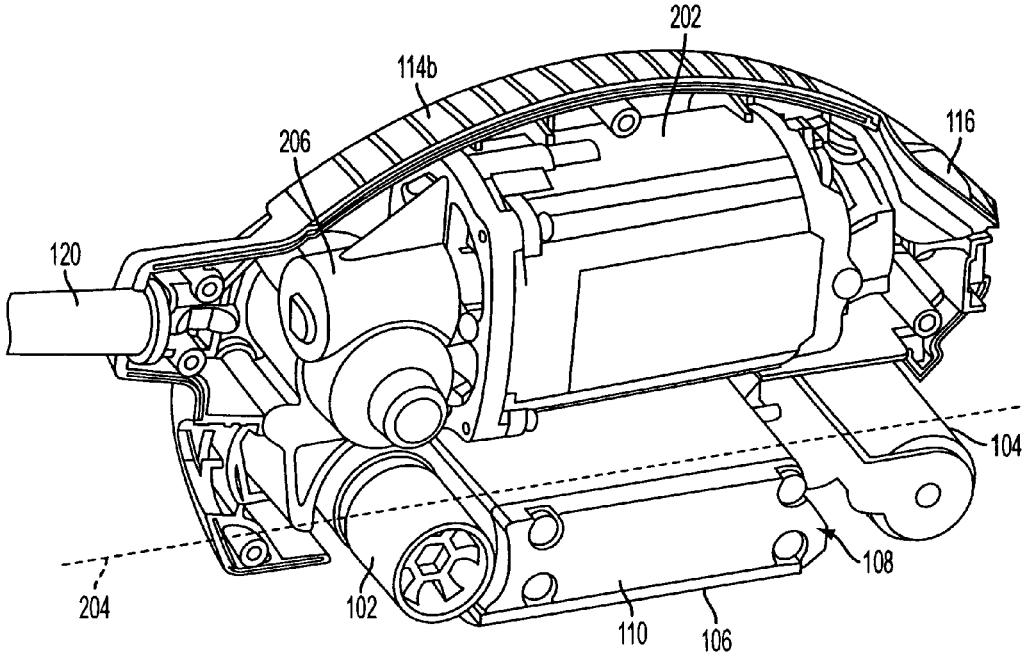
FIGS. 2A and 2B are perspective topside cut-away views of the belt sander of FIGS. 1A and 1B.

FIG. 2A is a topside perspective cut-away view of the belt sander 100. In FIG. 2A, the belt sander 100 is viewed from the right side, and the right clamshell 114*a* is removed.

Thus, in FIG. 2A, a motor 202 is illustrated as an example of the motor included within (i.e., partially and/or substantially encased by) the handgrip 114 and powering the rear roller 102, as described above with respect to FIGS. 1A and 1B. That is, for example, the handgrip 114 may generally surround any portion of the motor 202 that is not otherwise attached to the sanding assembly 112 or other portion of the belt sander 100, and/or may include at least a lower portion that is positioned at or below a bottom of the motor 202.

In the example of FIG. 2A, the motor 202 may include an alternating current (AC) motor that is oriented in-line with a direction of travel of the belt sander 100, such as, for example, a 59 mm AC motor. That is, in the example of FIG. 2A, the motor 202 is aligned along a longitudinal axis 204 intersecting the rear roller 102 and the front roller 104, as shown.

Thus, both the sanding assembly 112 and the motor 202 may be substantially centered with respect to one another along the longitudinal axis 204, so that the handgrip 114 also may be centered along the longitudinal axis 204. As a result, for example, a weight of the motor 202 may be evenly-distributed from left to right, and may be substantially centered over the sanding assembly 112. Put another way, a center of gravity of the motor 202 may be located substantially over a center of the sanding assembly 112. Accordingly, the belt sander 100 may be very well-balanced during operation, even when the belt sander 100 is operated upside-down, or sideways (e.g., along a vertical surface).

Further, the motor 202 may be contained, or substantially contained, within an area defined by the sanding assembly 112, and/or within an area defined by the platen 106. That is, for example, the sanding assembly 112 may define a two-dimensional area extending from one side of the rear roller 102 to the other (i.e., perpendicularly to the axis 204 along an axis of the rear roller 102), and extending from a back edge of the rear roller 102 to a front edge of the front roller 104. In the example of FIG. 2A, then, extension of this two dimensional area defined by a perimeter of the sanding assembly 112 in a perpendicular direction toward the motor 202 may be understood to contain the motor 202 within a resulting three-dimensional space. Again, such placement of the motor 202 may result in a compact, well-balanced, yet powerful belt sanding device.

Finally in FIG. 2A, a gearbox 206 is illustrated that includes a gear train (not shown in FIG. 2A, and examples of which are provided in more detail below, e.g., with respect to FIGS. 9A-9D). Generally, though, the gearbox 206 may include a worm gear or cross-axis helical gear, so that (as described below with respect to FIG. 2B) rotation of the in-line motor 202 may be translated into rotation of the rear roller 102. In this way, corresponding rotation of the sanding belt may be obtained in conjunction with the in-line motor design referenced herein and illustrated in corresponding figures.

Figure 2B:
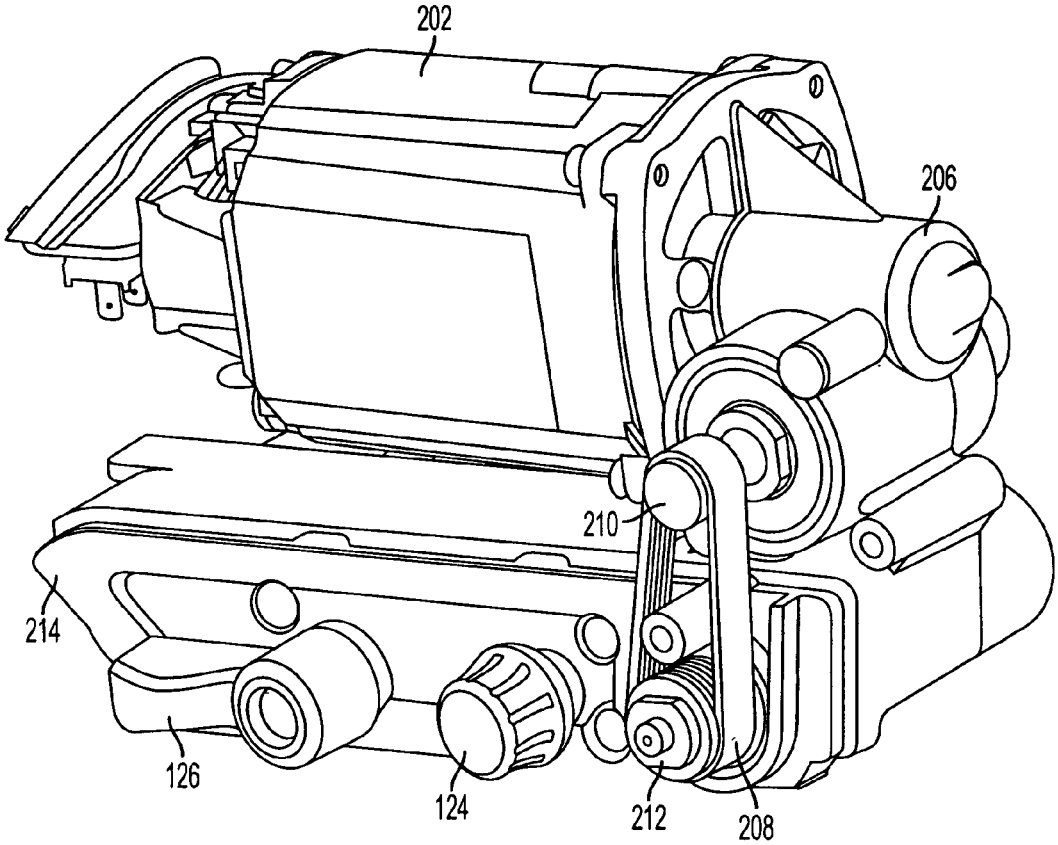

FIG. 2B is another topside perspective cut-away view of the belt sander 100. In FIG. 2B, the belt sander 100 is viewed from the left side, and both the right clamshell 114*a* and the left clamshell 114*b* are removed.

In FIG. 2B, a drive belt 208 is illustrated (which should be understood from FIG. 1B to be contained within the drive belt cover 128) as being connected both to a drive pulley 210 and to a driven pulley 212 (i.e., a member that is rotatably connected to an axle of the rear roller 102, so that rotation of the driven pulley 212 causes rotation of the rear roller 102). As is thus apparent from FIGS. 2A and 2B, rotation of the motor 202 is translated through the gearbox 206 to rotation of the drive pulley 210, which causes the drive belt 208 to rotate and thus causes the rotation of the driven pulley 212. Rotation of the driven pulley 212 leads to rotation of the rear roller 102 itself, thus resulting in rotation of the sanding belt around the sanding assembly 102.

Finally in FIG. 2B, a gear housing 214 refers to a metal portion of the belt sander 100 that is joined with, associated with, and/or integral to, the gearbox 206, and that provides a frame for mounting various elements of the belt sander 100. For example, as described in more detail herein, the gear housing 214 may be joined to, and/or support, the tracking box 108, the rear roller 102, the tracking knob 124, the belt tension knob 126, as well as the motor 202 and the gearbox 206 themselves.

In the examples of FIGS. 1A-2B, and in following examples, the belt sander 100 may be implemented with a variety of size and power characteristics. For example, a width of the handgrip 114 may be less than approximately 100 mm, while an overall front-to-back length of the belt sander 100 may be less than approximately 300 mm. In another example, a length of the platen 106 (e.g., a length of a flat portion of the platen 106 above the sanding belt) may be less than approximately 100 mm. A distance between an axis of the front roller 104 and the rear roller 102 may be, in some example implementations, less than approximately 200 mm. As another example, a length of the sanding belt may be at least 300 mm (e.g., 355.6 mm for a 2.5×14 inch sanding belt). In determining or describing the above distances, or other distances, it should be understood that the distances may be measured with respect to functional aspects needed or used in an operation of the belt sander; so that, for example, inclusion of an auxiliary handle (or any other extension) may or may not be considered in determining the above characteristics, as would be appropriate.

The motor 202 may be configured to provide a t least 0.25 hp, and, for example, may be configured to drive a 2.5×14 in sanding belt at a minimum of 600 sfpm (surface feet per minute), e.g., at 800 sfpm. Of course, all such characteristics, e.g., length, width, or power, are merely intended as examples, and many other values and quantities also may be used, and, moreover, various ratios or relationships between these characteristics, or other characteristics, also may be used.

Figure 3:
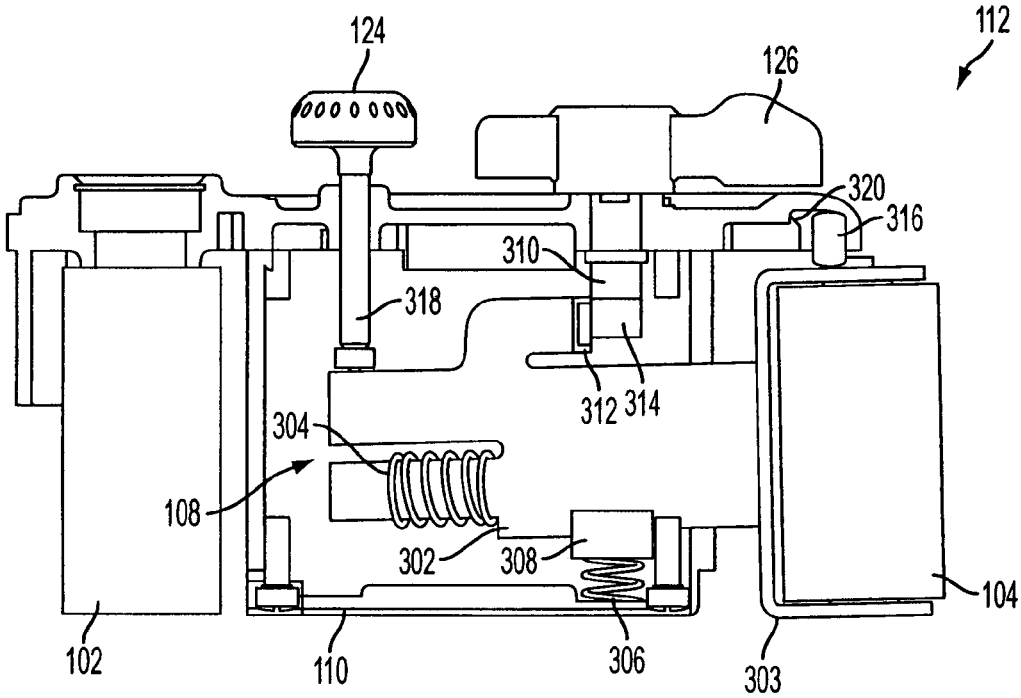
FIG. 3 is a top cut-away view of the belt sander of FIGS. 1A and 1B.

FIG. 3 is a top cut-away view of the belt sander 100 of FIGS. 1A and 1B. That is, FIG. 3 illustrates (portions of) the sanding assembly 112 from above, without showing the handgrip 114, the motor 202, the gearbox 206, or other intervening components, and without necessarily showing all components of the sanding assembly 112 (e.g., the tracking box 108 may not be illustrated in its entirety).

In FIG. 3, the tracking box 108 is illustrated as containing a tracking mechanism that includes a yoke 302. The yoke 302 may comprise, for example, stamped metal, such as Aluminum or stainless steel. As shown, the yoke 302 provides a roller mount 303 for the front roller 104, which allows the front roller 104 to rotate freely. As described and illustrated in more detail below with respect to FIGS. 5A-5C, the yoke 302 may be mounted in slots of the tracking box 108, the slots being parallel to the axes of the rear roller 102 and the front roller 104, so that the yoke 302 and the roller mount 303 may generally be movable in directions both parallel and perpendicular to the axes of the rear roller 102 and the front roller 104.

Such movement of the yoke 302 may be constrained, e.g., by a front load spring 304 and a side load spring 306. That is, the front load spring 304 may be loaded against a portion of the tracking box 108 (the portion not shown in FIG. 3), so as to constrain a motion of the yoke 302 (and thereby of the front roller 104) in a direction toward the rear roller 102. Meanwhile, the side load spring 306 may be used to restrict a motion of the yoke 302 (and the roller mount 303 and the front roller 104) away from the gear housing 114, parallel to an axis of the rear roller 102. A plastic slider 308 is used to maintain contact between the side load spring 306 and the yoke 302.

The front load spring 304 loads the yoke 302 against a cam shaft 310 associated with the belt tension knob 126, which thus restricts motion of the yoke 302 (and the front roller 104) in a direction away from the rear roller 102. More specifically, a flange 312 (which may be formed using a hardened stamping to prevent wear) of the yoke 302 is maintained in pressure against the cam shaft 310. In this way, as referenced above and described/illustrated in more detail below with respect to FIGS. 4A and 4B, rotation of the belt tension knob 126 may cause rotation of a cam 314 at the end of the cam shaft 310, thereby causing the cam 314 to exert pressure against the flange 312.

Consequently, the flange 312 is pushed toward the rear roller 102, causing a motion of the yoke 302 (and the front roller 104) in the same direction (thereby temporarily further loading the front load spring 304). In this way, since the front roller 104 and the rear roller 102 move closer to one another, a belt tension on the sanding belt is reduced, so that the sanding belt may be removed and/or installed or re-installed. Conversely, motion of the belt tension knob 126 in the opposite direction after removal and subsequent (re-) installation of the sanding belt re-establishes tension of the sanding belt, for subsequent operation of the belt sander 100.

Further in FIG. 3, a pin 316 is illustrated that defines a pivot point for the tracking mechanism of the belt sander 100. That is, for example, as may be appreciated from FIG. 3 and from the above description, rotation of the tracking knob 124 in a first direction may cause tracking shaft 318 of the tracking knob 124 to move toward (a rear of) the yoke 302, while rotation of the tracking knob 124 in a second, opposite direction causes the tracking shaft 318 to move away from (a rear of) the yoke 302.

In FIG. 3, the pin 316 is located in a divot or groove 320, and may be fixed in position, therein, while being slidably engaged with the yoke 302. In other implementations, however, the pin 316 may be fixed to the yoke 302, and may slide within the groove 320 and/or along the gear housing 214. Other implementation details may be included that are not necessarily illustrated in FIG. 3. For example, an additional (compression) spring may be associated with the tracking knob 124 and/or the tracking shaft 318, so as to maintain pressure on the tracking knob 124 and prevent undesired motion thereof.

As a result of the structure of FIG. 3, or similar structures, the yoke 302 may pivot about the pivot point established by the pin 316. That is, a degree of parallelism between the rear roller 102 and the front roller 104 may be adjusted. Accordingly, a tracking mechanism is provided by which a tendency of the sanding belt to skew inappropriately (e.g., to veer to one side or the other on the rollers 102, 104) may be reduced, and an appropriate tension and/or position of the sanding belt may be maintained. In this way, for example, undesired exposure of the rear roller 102, the front roller 104, or the platen 106 may be reduced or eliminated during operation of the belt sander 100, and a lifetime and reliability of the belt sander 100 may be improved. Moreover, the examples of the described tracking mechanism allow for rotation of the front roller 104 about the pivot pin 316, while permitting little or no side-to-side motion (i.e. in a direction parallel to an axis of the rear roller 102) of the roller mount.

In some example implementations, a tracking distance from the tracking shaft 318 to the pivot point 316 may be maximized relative to and/or as a function of, other parameters of the belt sander 100. For example, the tracking distance may be maximized with respect to one or more of a length of the belt sander, a length of the sanding belt, a distance between a front axis of the front roller and a rear axis of a rear roller of the belt sander, and/or a length of a platen disposed in contact with the sanding belt during operation of the belt sander. In some implementations, the tracking distance from the tracking shaft 318 to the pivot point 316 may be within a range of 70-100 mm, e.g., may be within a range of 84-92 mm, such as, for example, 88 mm. To give specific but non-limiting examples of resulting ratio(s) of the tracking distance to other parameters of the belt sander 100, an example of a first ratio of the tracking distance to the overall tool length may be at least 0.2 (e.g., a ratio of 0.352 when the respective measurements are 88 mm to 250 mm). An example of a second ratio of the tracking distance to the sanding belt length may be at least 0.14 (e.g., a ratio of 0.247 when the respective measurements are 88 mm to 355.6 mm). An example of a third ratio of the tracking distance to the distance between axes of the rear roller 102 and the front roller 104 may be at least 0.45 (e.g., a ratio of 0.657 when the respective measurements are 88 mm to 134 mm). An example of a fourth ratio of the tracking distance to the platen length may be at least 1.3 (e.g., a ratio of 1.426 when the respective measurements are 88 mm to 61.7 mm).

Figure 4A:
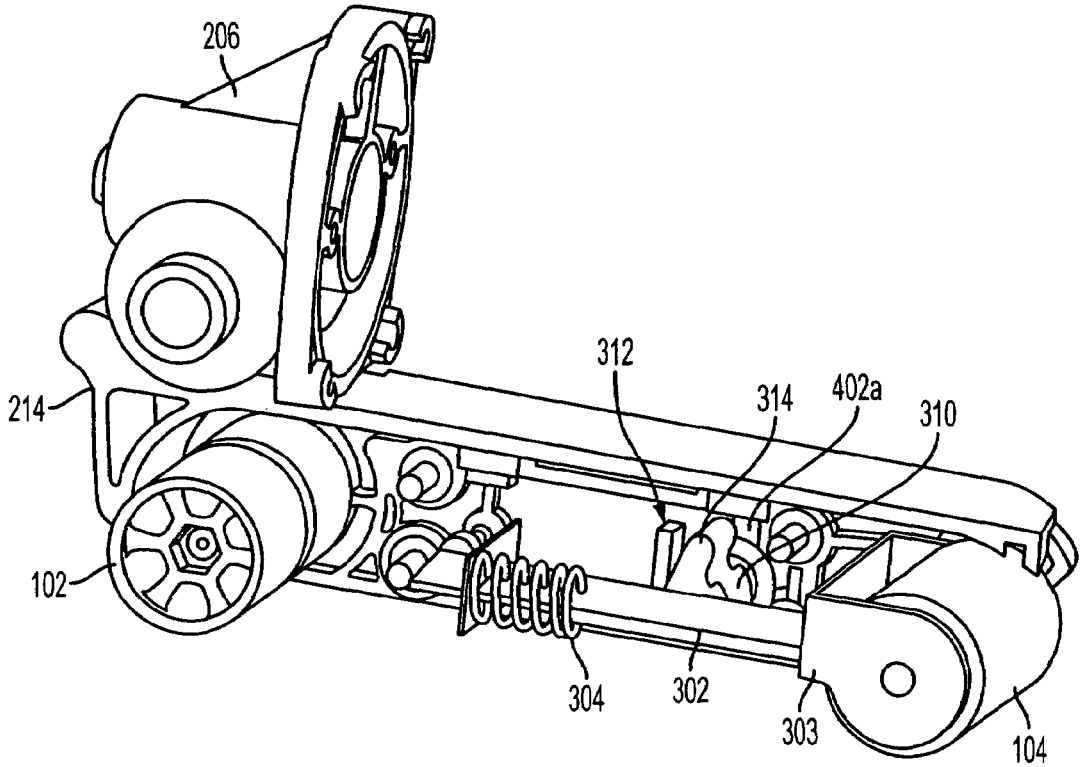
FIGS. 4A and 4B illustrate examples of a structure and operation of an example implementation of a belt tension adjustment mechanism of FIG. 3.
Figure 4B:
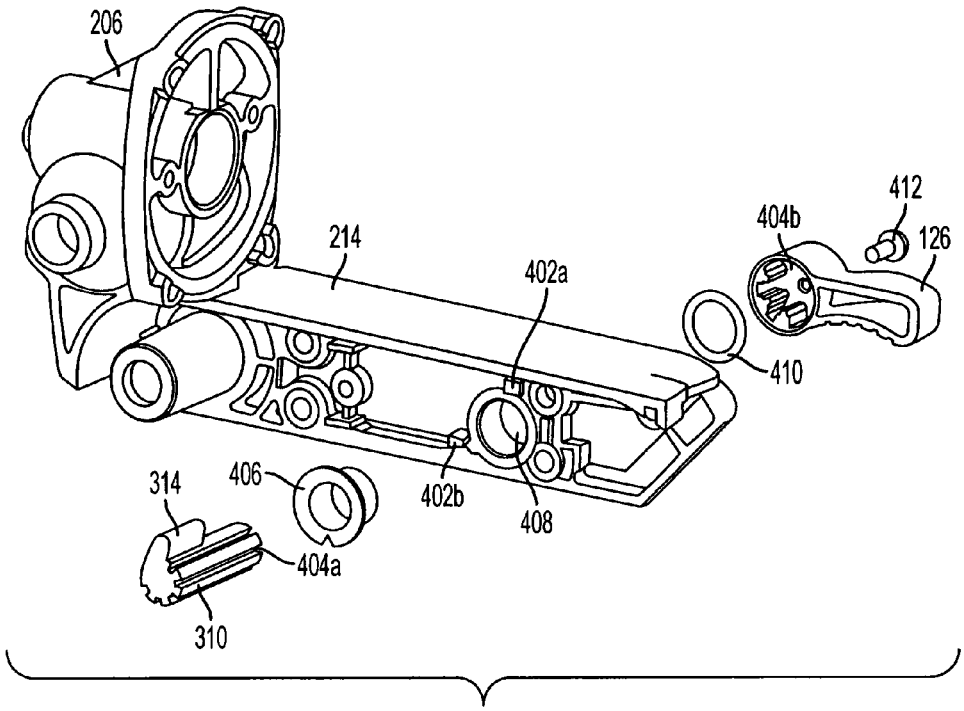

FIGS. 4A and 4B illustrate examples of a structure and operation of an example implementation of the belt tension adjustment mechanism of FIG. 3, i.e., of the belt tension knob 126, the cam shaft 310, the cam 314, and the flange 312 (of the yoke 302). FIG. 4A provides a perspective side view in which the cam 314 is illustrated in a forward position, which would correspond to a full tension on the sanding belt and a ready condition for operation of the belt sander 100.

As should be understood from the above description, however, appropriate rotation of the belt tension knob 126 (e.g., here, in a direction toward the rear roller 102) causes rotation of the cam shaft 310, and thus of the cam 314. Thus, the cam 314 exerts pressure on the flange 312, causing motion of the yoke 302 (and thus the front roller 104) toward the rear roller 102.

By rotating the belt tension knob 126, then, tension of the sanding belt may be decreased or increased, as needed, for a desired removal, adjustment, installation, or re-installation of the sanding belt. In FIG. 4A, a cast stop 402*a* is used that prevents the cam 314 from rotating beyond the illustrated point. A corresponding cast stop 402*b* (not visible in FIG. 4A, but shown in FIG. 4B) behind the flange 312 and yoke 302 serves to stop a motion of the cam 314 in the reverse direction, so that a full range of motion of the cam 314 is restricted to approximately 90 degrees. Of course, the cast stops 402*a*, 402*b* may be placed in slightly different positions, to provide for a greater or lesser degree of motion of the cam 314 (and thereby of the front roller 104). In other implementations, additional or alternative techniques may be used to restrict a range of motion of the belt tension knob 126. For example, rotation stops may be placed on an opposite side of the gear housing 214 than that shown in FIG. 4A, e.g., directly in contact with the belt tension knob 126.

FIG. 4B illustrates a cam shaft assembly for providing the belt tension adjustment mechanism described above. In FIG. 4B, the cam shaft 310 is illustrated as containing grooves 404*a* that are mated to, and correspond with, grooves 404*b* within the belt tension knob 126. In this way, rotation of the belt tension knob 126 may cause rotation of the cam shaft 310, as described above, due to the interaction between the mated grooves 404*a*, 404*b*.

Further in FIG. 4B, a flange bushing 406 is illustrated that may be inserted into a bore or opening 408 formed in the gear housing 214, and through which the cam shaft 310 may be inserted. The flange bushing 406 may comprise, for example, Teflon, or any material suitable for allowing rotation of the belt tension knob 126 and cam shaft 310. A washer 410, such as, for example, a wave spring washer, may be used on an opposite side of the gear housing 214, in conjunction with the belt tension knob 126, in order, for example, to prevent undesired motion of the belt tension knob 126 when tension is off of the cam shaft 310. The entire assembly may be joined using a screw 412, inserted through the belt tension knob 126 and into a tapped hole of the cam shaft 310 (not visible in FIG. 4B).

In this way, reliable and easy rotation of the belt tension knob 126 may be maintained during a lifetime of the belt sander 100. Further, the various components just described may be manufactured and assembled in a quick and cost-effective manner. For example, the cam shaft 310 may be formed using powdered metal, and may be formed near net shape, i.e., may be formed during a manufacturing process that results in the cam shaft 310 having the illustrated form (including the grooves 404*a*), without generally requiring secondary operations on the cam shaft 310 (although secondary operations are not necessarily excluded; for example, as just referenced, a tapped hole at an end of the cam shaft 310, through which the screw 412 is inserted, may be formed as part of a secondary operation on the camshaft 310). For example, injection molding may be used, in which the metal powders are injection molded with a polymer or other binder, which is then removed for fusing of the metal powder into the shape of the cam 314 and cam shaft 310.

Figure 5A:
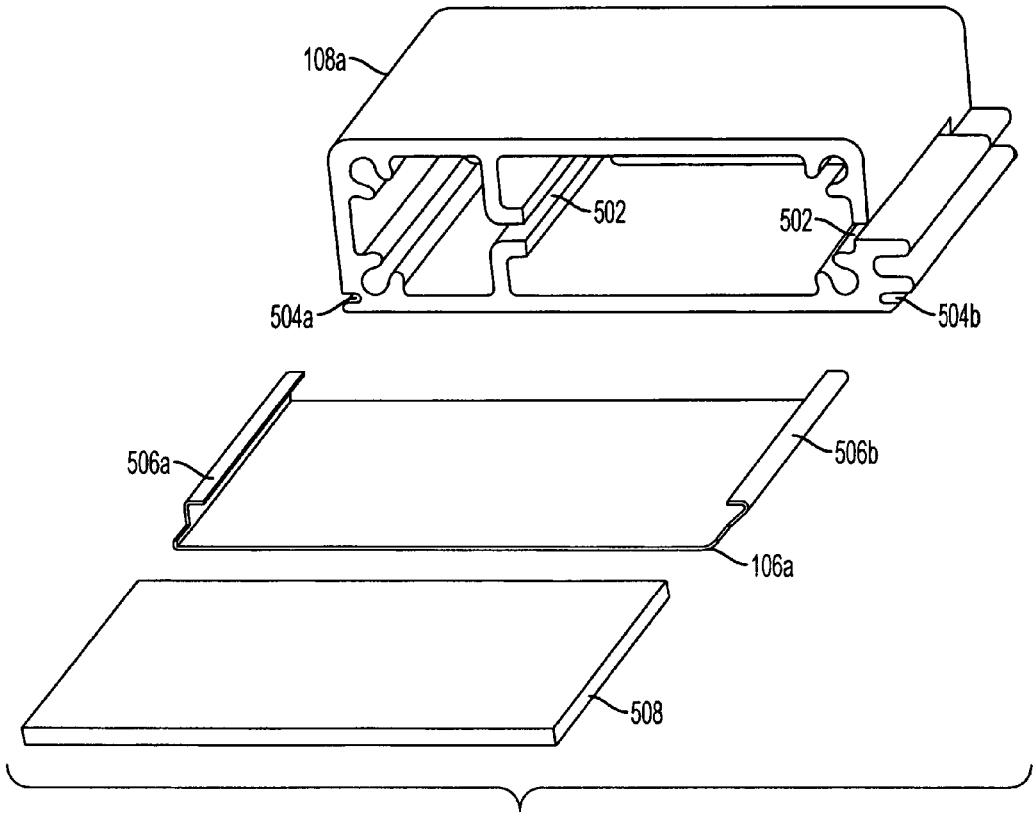
FIGS. 5A-5D illustrate example tracking box designs and implementations for use with the belt sander of FIGS. 1A and 1B.

FIGS. 5A-5D illustrate example tracking box designs and implementations for use with the belt sander 100 of FIGS. 1A and 1B. For example, FIG. 5A illustrates the tracking box 108 with a first design for joining the platen 106 of FIGS. 1A and 1B thereto. In FIG. 5A, the platen 106 and the tracking box 108 are shown as platen 106*a* and tracking box 108*a*, to distinguish the illustrated designs from that of the alternate implementations associated with FIGS. 5B and 5C, below.

In the example of FIG. 5A, then, the tracking box 108*a* includes slots 502, which, as referenced above, may be used for the insertion and mounting of the yoke 302 (not shown in FIG. 5A). The tracking box 108*a* also includes slots 504*a* and 504*b*. As may be appreciated from FIG. 5A, the platen 106*a* includes flanges 506*a* and 506*b* that mate with, e.g., slide into, the respective slots 504*a* and 504*b*.

More specifically, a cork 508 is used that has a pressure-sensitive or pressure-absorbing adhesive surface for attaching to the platen 106*a*. Then, the cork/platen assembly may together be attached to the tracking box 108*a*, simply by sliding the flanges 506*a*/506*b* into respective receiving slots 504*a*/504*b*. With the tracking box 108*a* joined to the gear housing 214 on one side, and with the tracking box cover 110 attached to the other (see FIG. 5B for an example of a similar construction), the cork/platen assembly may be maintained therebetween, without requiring screws or other secondary joining techniques to maintain the assembly as a whole.

In some implementations, the tracking box 108*a* itself may be formed as an Aluminum extrusion (i.e., metal shaped by flowing through a shaped opening in a die), with the slot 502 for the yoke 302 being machined after the extrusion occurs. The platen 106*a* may be, for example, stamped metal, or any other material suitable for applying and withstanding pressure against the sanding belt (and thereby a sanding surface). In this way, the assembly of FIG. 5A may be manufactured in a fast, reliable, and cost-effective manner.

Figure 5B:
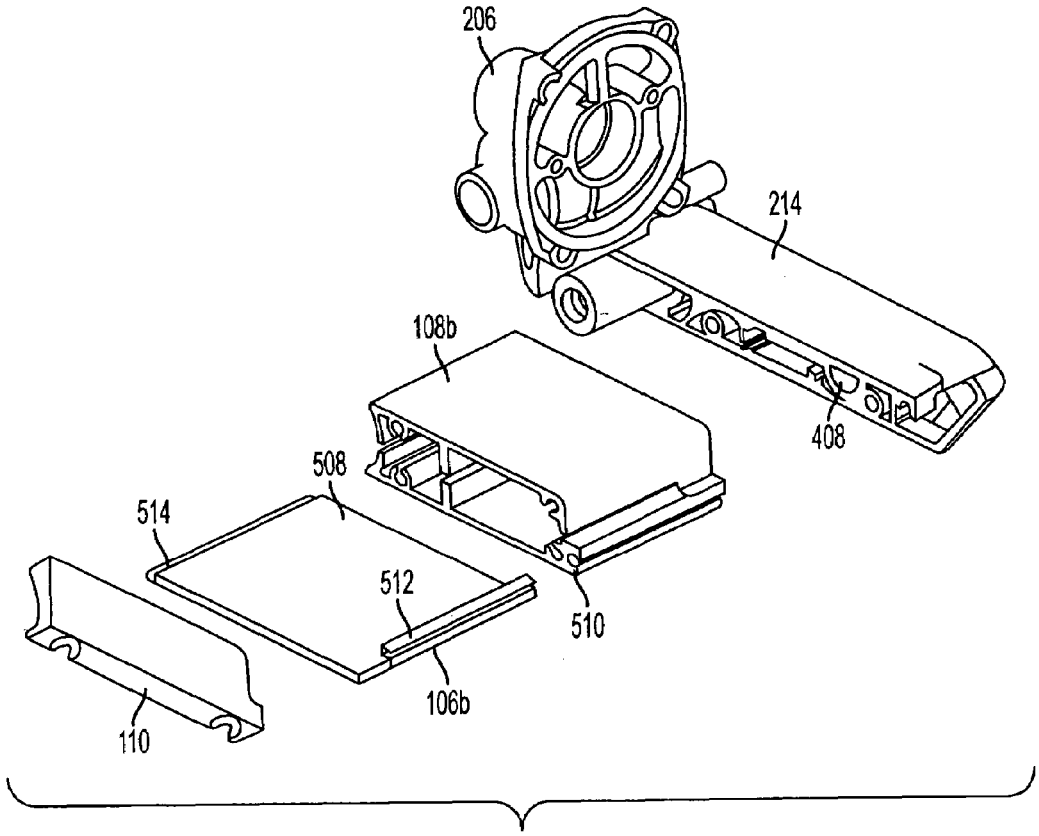
Figure 5C:
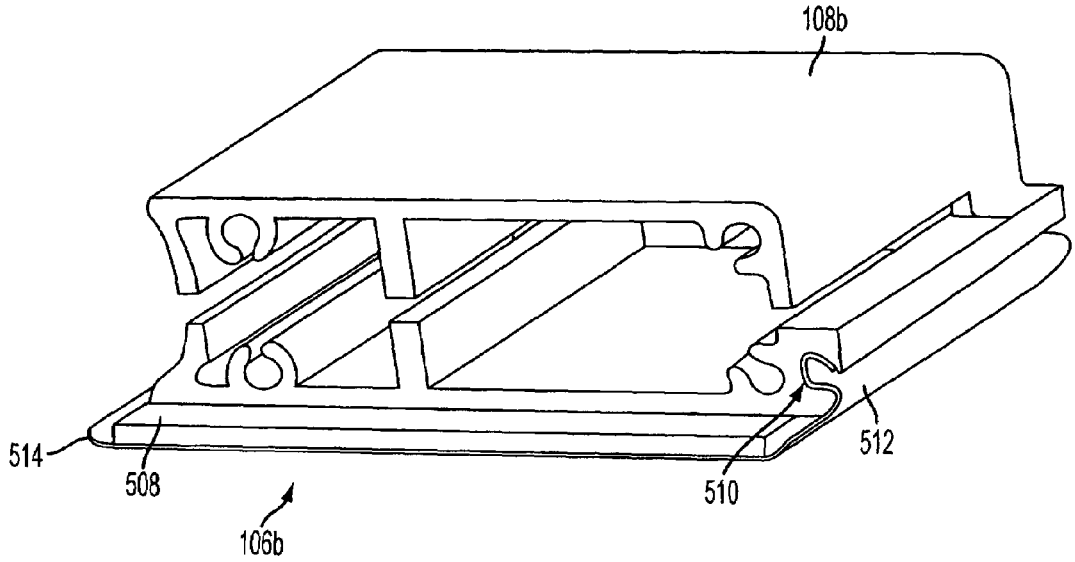

FIGS. 5B and 5C illustrate an alternate implementation of a tracking box for use with the belt sander 100 of FIGS. 1A and 1B. Referring first to FIG. 5B, a substantially similar configuration to FIG. 5A is illustrated, in which the cork board 508 is adhered to the platen 106*b* for attachment to the tracking box 108*b* (where the latter two elements are so labeled for the purposes of distinguishing from the platen 106*a* and the tracking box 108*a*, respectively, of FIG. 5A).

In FIG. 5B, however, a slot 510 in the tracking box 108*b* is illustrated as matching a substantially triangular-shaped flange 512 of the platen 106*b*. FIG. 5C more clearly illustrates a nature of the joining of the triangular flange 512 with the mating slot 510. Meanwhile, a back edge 514 of the platen 106*b* is illustrated as being substantially flat, and extending under and beyond a length of the cork board 508. FIG. 5B also more fully illustrates a nature of the assembly and joining of the tracking box 108*b* and related components with the tracking box cover 110 and the gear housing 214.

In this way, then, a secure attachment of the cork board/platen assembly to the tracking box 108*b* may be obtained, using only the single flange 512 and slot 510. That is, the triangular shape of the flange 512 (and corresponding shape of the slot 510) provide a more secure attachment than would the single, curved flange 506*b* and slot 504*b* of FIG. 5A (if the latter were used without the rear flange 506*a* and slot 504*a*), and, moreover, may provide a more secure attachment in both a front-to-back, as well as side-to-side, direction(s). As a result, for example, the platen 106*b* may be secured to the tracking box 108*b*, even if a rear portion of the platen 106*b* is damaged (e.g., worn through or melted).

Moreover, the design of FIGS. 5B and 5C allows the back edge 514 of the platen 106*b* to be freed, for example, for extension thereof toward the rear roller 102 (when assembled). Such extension may improve a balance of the belt sander 100 during operation.

Figure 5D:
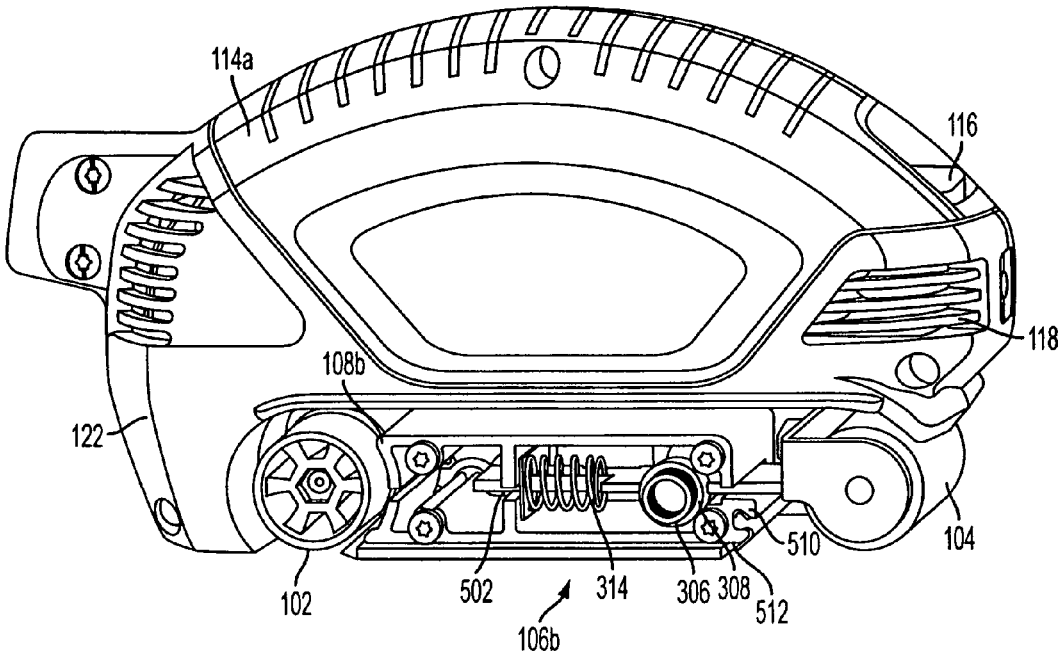

FIG. 5D illustrates a view of the design of FIGS. 5B and 5C in which the tracking box 108*b* and associated tracking elements are fully assembled and mounted within the belt sander 100, but with the tracking cover 110 removed. As shown, and as referenced above with respect to FIGS. 3, 4A, and 4B, the yoke 302 may be mounted in the slots 502 and loaded by the springs 314 and 306. Accordingly, at least the various advantages described herein may be obtained, including, for example, tracking of the sanding belt, easy removal of the sanding belt, and reliable mounting of the platen 106*b*.

Figure 6A:
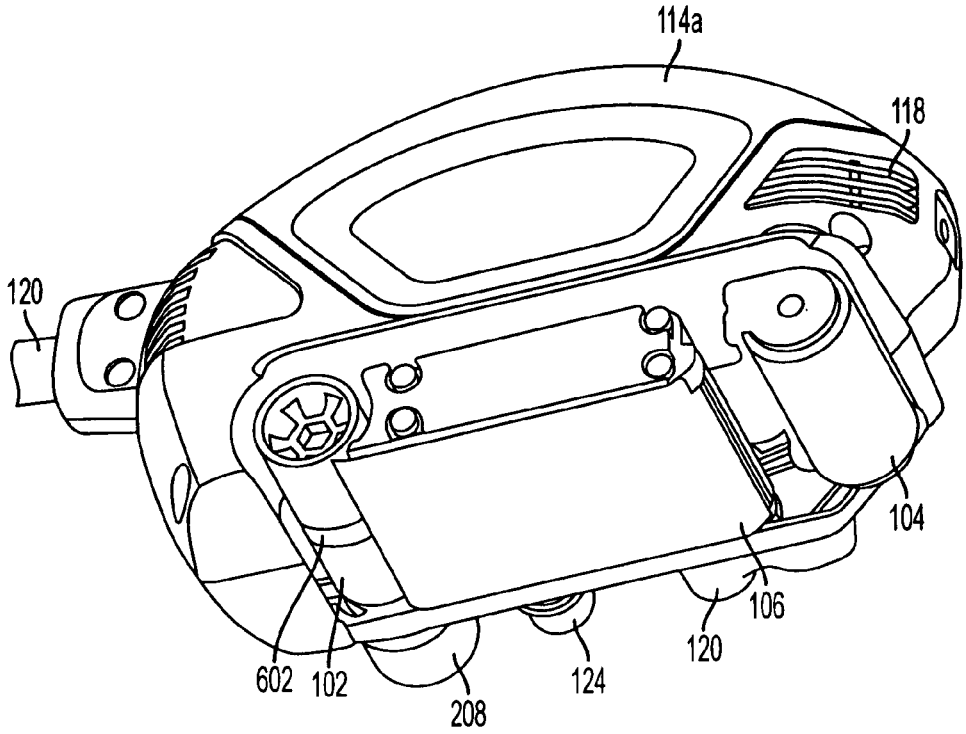
FIGS. 6A and 6B illustrate a drive mechanism for the belt sander 100 of FIGS. 1A and 1B.
Figure 6B:
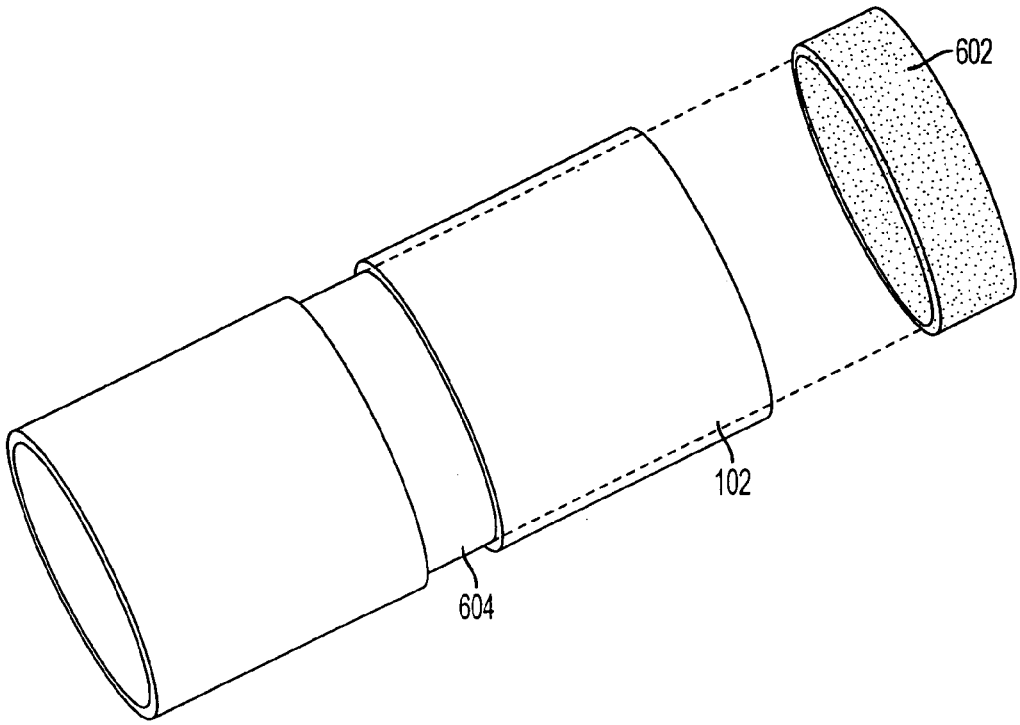

FIGS. 6A and 6B illustrate a drive mechanism for the belt sander 100 of FIGS. 1A and 1B. Specifically, FIG. 6A illustrates the inclusion of a drive band 602 in/on the rear roller 102. FIG. 6B illustrates that the rear roller 102 may include a groove 604 to receive the drive band 602.

In some implementations, the drive band 602 may include rubber (or other elastomer and/or polymer) that provides sufficient friction against the sanding belt that rotation of the rear roller 102 is reliably translated into rotation of the sanding belt around the rear roller 102 and the front roller 104. In other words, the drive band 602 provides sufficient torque-carrying ability to drive the sanding belt during operation of the belt sander 100. As a result, the belt sander 100 is provided with a robust, cost-effective drive mechanism.

The rear roller 102 may include a die cast Aluminum wheel with the groove 604 formed therein. In some implementations, the rear roller 102 may be die cast so as to include a crown at a center of the wheel, e.g., at a center of the groove 604 when the groove 604 is centered on the wheel. In these implementations, the drive band 602 may thus protrude slightly above an outer edge(s) of the rear roller 102, so as to establish improved contact between the drive band 602 and the sanding belt as compared to implementations without the crowning (or other raising of the drive belt 602 relative to the other surface(s) of the rear roller 102).

Figure 7:
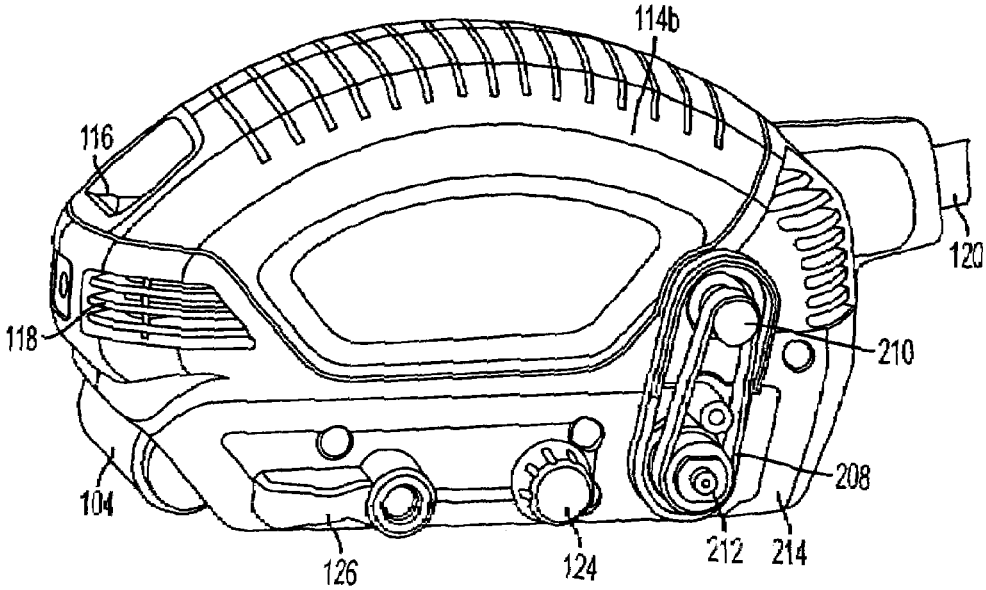
FIG. 7 illustrates an example implementation of the belt sander of FIGS. 1A and 1B that includes a pre-tensioned drive belt.

FIG. 7 illustrates an example implementation of the belt sander 100 of FIGS. 1A and 1B that includes a pre-tensioned drive belt. Specifically, FIG. 7 illustrates the drive belt 208 of FIG. 2B, provided around the drive pulley 210 and the driven pulley 212. As explained above with respect to FIG. 2B, the motor 202, through gears within the gearbox 206, causes rotation of the drive pulley 210. This rotation is translated through the drive belt 208 to the driven pulley 212, and thereby to rotation of the rear roller 102 (not shown in FIG. 7).

In FIG. 7, the drive belt 208 may include a pre-tensioned drive belt that is fitted around the drive pulley 210 and the driven pulley 212 with a tension selected to allow slippage of the drive belt 208 in response to a selected torque value of the motor 202. In other words, for example, the drive belt 208 may be pre-tensioned and stretched to fit onto the drive pulley 210 and the driven pulley 212. Such pre-tensioning may allow the drive belt 208 to settle into an appropriate operating tension quickly and remain at this operating tension.

In addition to consistent driving of the sanding belt, this pre-tensioning allows the slippage referenced above, according to which a certain torque value experienced by the drive belt 208 results in slippage of the belt and corresponding prevention of damage to the motor 202 (e.g., due to lock-up of the motor 202) and/or damage to the gears of the gearbox 206. Thus, the drive belt 208 acts as a clutch during operation of the belt sander 100, so that, for example, if an object is accidentally sucked into the sanding belt, a jamming of the belt sander 100 is avoided due to the described slippage of the drive belt 208. This clutch effect may be designed to be sufficient to allow the user to stop the belt sander 100, e.g., using the on/off switch 116, so that the user may then remove the object and resume use of the belt sander 100.

For example, the belt sander 100 may experience an accidental intake of the power cord 120, such as when the user mistakenly backs over the power cord 120 during operation of the belt sander 100. In the implementation of FIG. 7, the pre-tensioned drive belt 208 would thus begin to slip as the jammed sanding belt becomes unable to rotate, and an undesirably high level of torque begins to be experienced by the drive belt 208. During such slipping, as just referenced, the user may shut off the belt sander 100 and remove the power cord 120 (e.g., by rolling the sanding belt backwards), without having to perform any disassembly of the belt sander 100.

Accordingly, the implementation of FIG. 7 may provide a clutch for the belt sander 100 that slips at a certain load value and prevents motor burn up or other damage (e.g., damage to the gear train), so that a prolonged lifetime of the belt sander 100 is obtained. Further, the described belt design allows for loosened manufacturing tolerances of the fixed center distance dimension of the implementation, while maintaining constant tension on the drive belt 208. That is, the distance between the drive pulley 210 and the driven pulley 212 may be fixed, as opposed to other designs where some degree of flexibility or motion may be provided for one or both of the drive pulley 210 and/or the driven pulley 212.

Figure 8A:
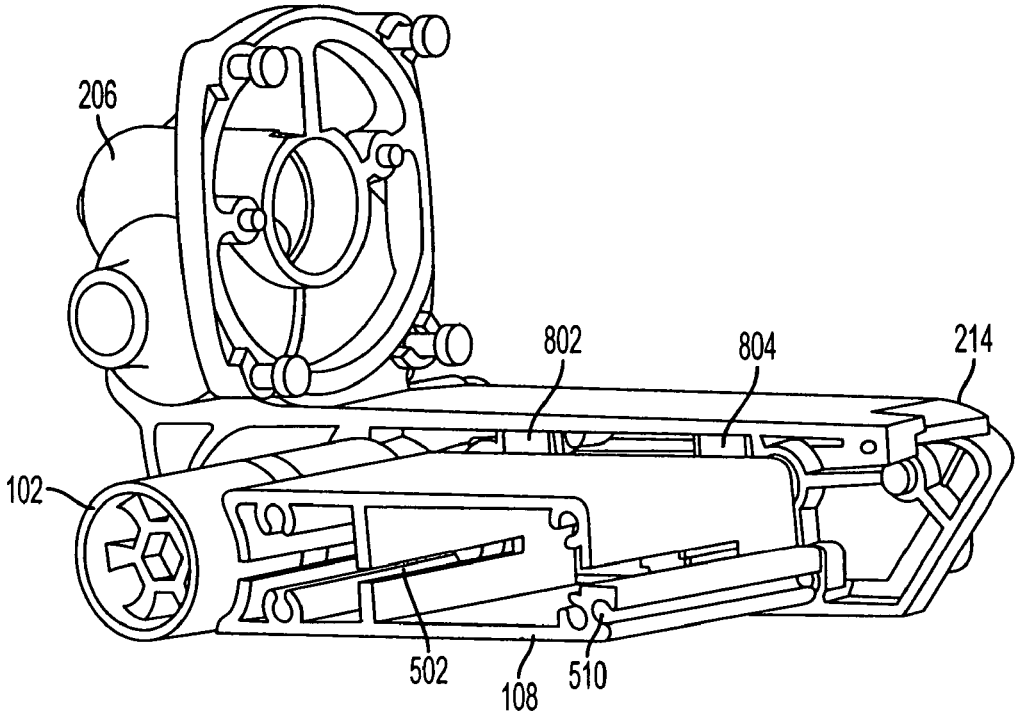
FIGS. 8A-8C illustrate an example implementation of the belt sander of FIGS. 1A and 1B using fitted wear plates.
Figure 8B:
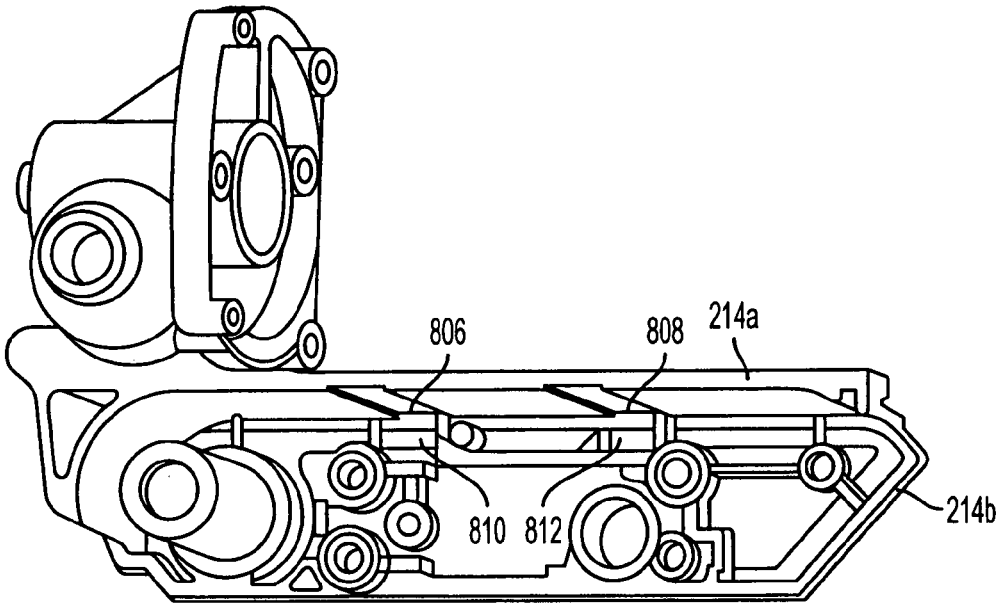
Figure 8C:
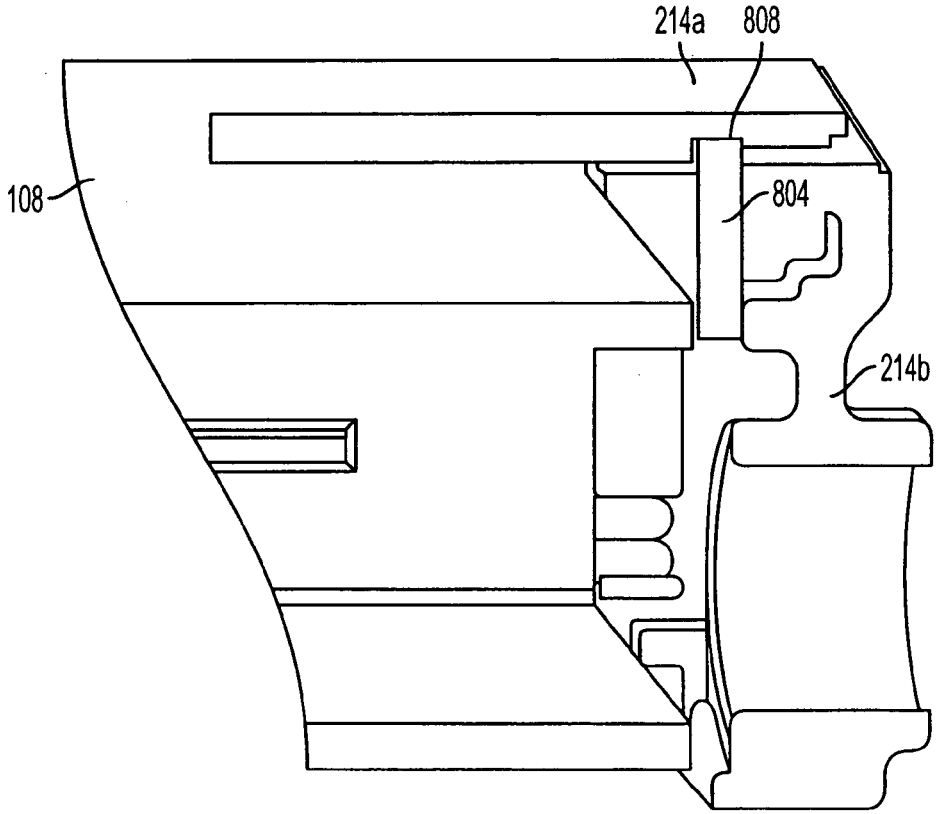

FIGS. 8A-8C illustrate an example implementation of the belt sander 100 of FIGS. 1A and 1B using fitted wear plates 802, 804. The wear plates 802, 804 may be included, for example, to prevent the sanding belt from damaging the gear housing 214 when the sanding belt is tracked too far in a direction of the gear housing 214.

The wear plates 802, 804 may be made of, for example, ceramic, and may have an easily and inexpensively-manufactured shape, such as, for example, rectangular or square. As shown in FIG. 8A and explained in more detail below, the wear plates 802, 804 may be maintained in a desired position by a fastening of the tracking box 108 to the gear housing 214. In this way, no specialized or expensive fastening elements are required in order to position and use the wear plates 802, 804.

In FIG. 8B, a mounting/positioning technique for the wear plates 802, 804 is illustrated, in which corresponding undercuts 806, 808 are formed in the gear housing 214, as shown, so as to provide slots into which the wear plates 802, 804 may be inserted (shown in more detail in FIG. 8C). That is, the gear housing 214 may be considered to include a topwall 214*a* and a sidewall 214*b*, so that the undercuts 806, 808 form slots within the topwall 214*a* proximate to a surface of the sidewall 214*b*, as shown.

Accordingly, first (e.g., top) ends of the wear plates 802, 804 may be inserted into the corresponding undercuts 806, 808, and partially held in position there by side-locating ribs 810 and 812. Then, as referenced above and shown more clearly in FIG. 8C, second (e.g., bottom) ends of the wear plates 802, 804 may be trapped against the sidewall 214*a* by the tracking box 108, e.g., by a screwing of the tracking box 108 to the gear housing 214.

By trapping each of the wear plates 802, 804 in at least two places, as shown, and by restricting a sideways motion of the wear plates 802, 804 with the side-locating ribs 810, 812, the wear plates 802, 804 may reliably be maintained in position and may thus protect the gear housing 214 from damage caused by the sanding belt. Further, the simple assembly provided by the implementations just described may result in a cost reduction associated with avoidance of any additional fasteners and/or assembly methods.

Figure 9A:
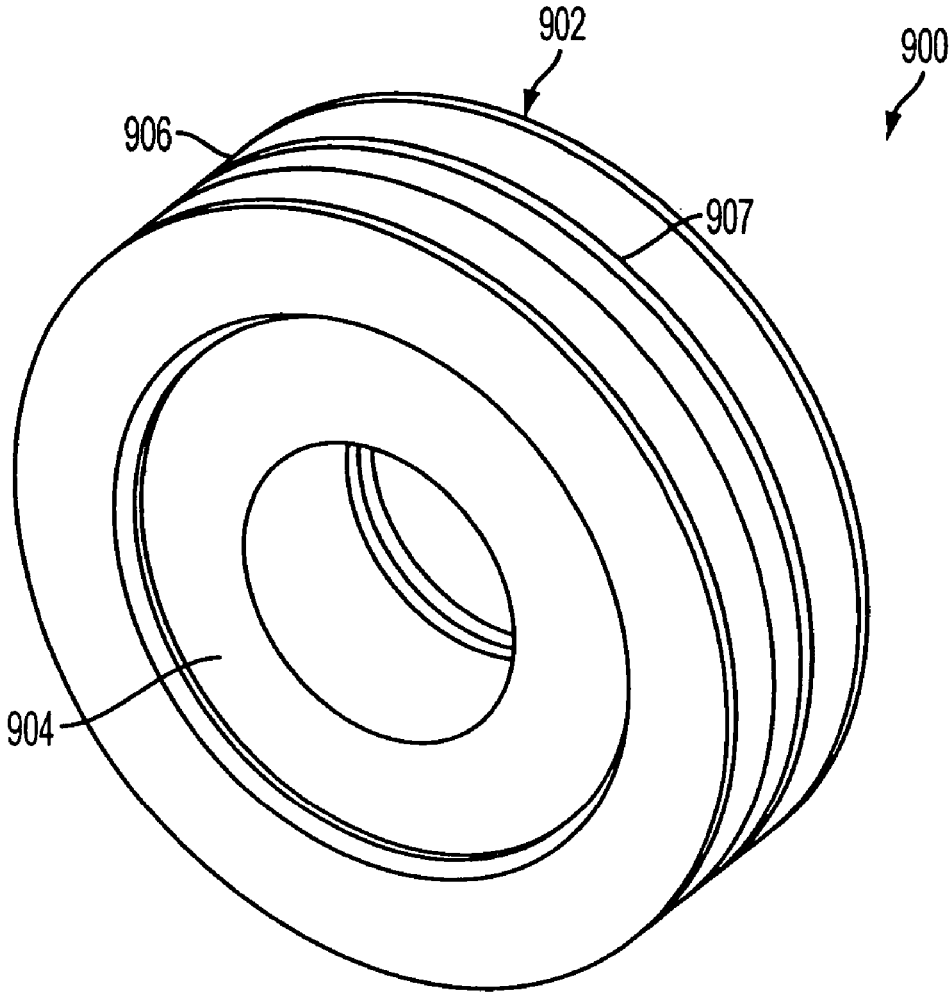
FIGS. 9A-9D illustrate sealing techniques associated with a gear train of the belt sander 100 of FIGS. 1A and 1B.

FIGS. 9A-9D illustrate sealing techniques associated with a gear train of the belt sander 100 of FIGS. 1A and 1B. In FIG. 9A, a seal assembly 900 is shown that includes a seal holder 902, a lip seal 904 contained within (a bore of) the seal holder 902, and an O-ring 906 within a groove 907 of the seal holder 902. The seal holder 902 may be, for example, a machined part or a powdered metal part.

As described in more detail below with reference to FIGS. 9B-9D, and by way of example and not limitation, the seal assembly 900 may serve at least two purposes. First, the seal assembly 900 may provide sealing for a lubricant for gears contained within the gearbox 206, and, second, the seal assembly 900 may provide a point of contact and/or leverage for removing gear elements when servicing the gearbox 206.

Figure 9B:
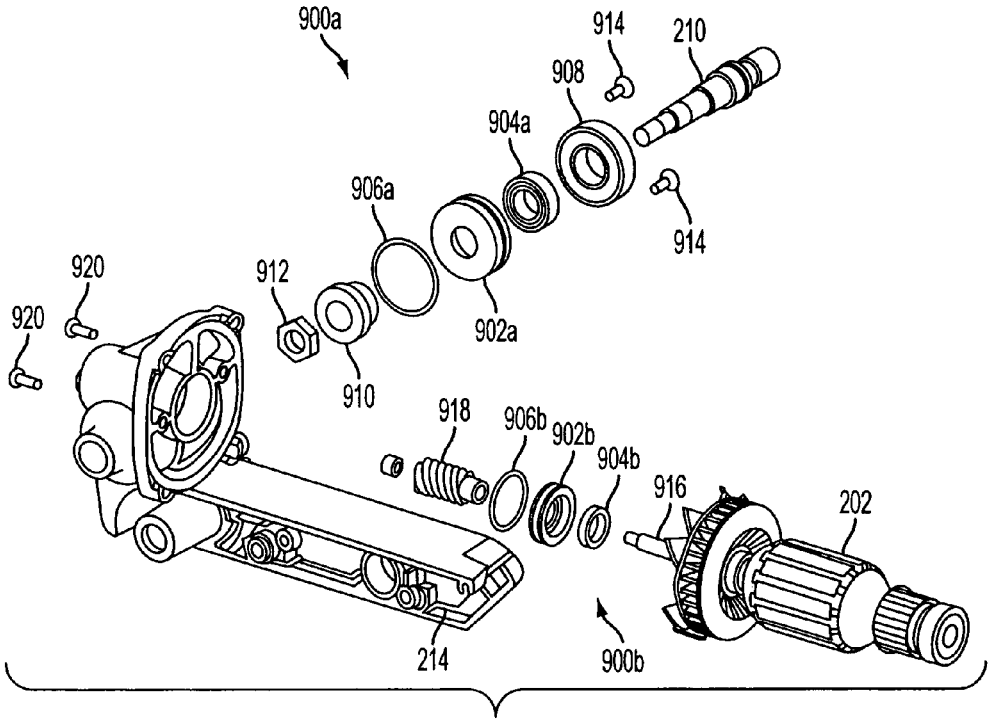

FIG. 9B is an expanded view of an assembly and use of the seal assembly 900 of FIG. 9A. In FIG. 9B two examples of seal assemblies 900*a*, 900*b* are provided. In a first example, the drive pulley 210 (e.g., a jackshaft associated with the drive pulley 210) is inserted through a bearing 908, and the seal assembly 900*a* (lip seal 904*a*, seal holder 902*a*, and O-ring 906*a*) is then pressed against a gear 910 and a nut 912 that holds the gear 912 in place within the gearbox 906 (shown in more detail in FIG. 9C). Then, the seal assembly 900*a* may be maintained in position by screws 914.

Figure 9C:
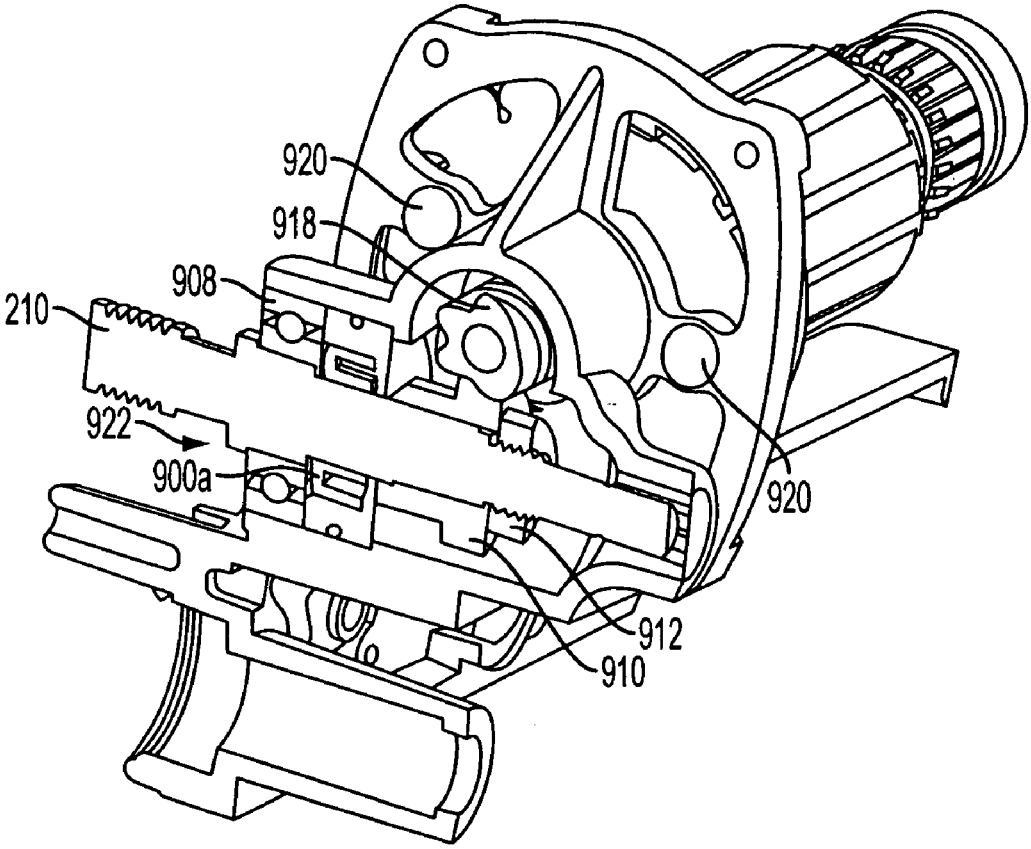
Figure 9D:
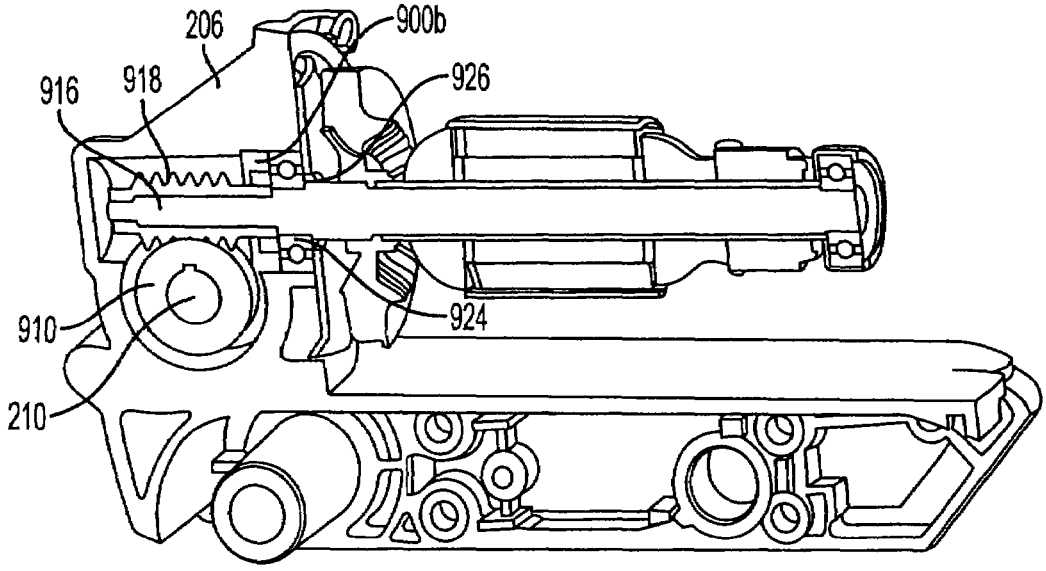

Similarly, on an armature side of the gearbox 206, associated with the motor 202, a shaft 916 of an armature assembly is inserted through the seal assembly 900*b* (lip seal 904*b*, seal holder 902*b*, and O-ring 906*b*), and against a pinion 918 of the gear train (shown in more detail in FIG. 9D). Then, screws 920 may be used to secure the seal assembly 900*b* against the gear housing 214/gearbox 206.

FIG. 9C is a cut-away view of the gearbox 206 illustrating the seal assembly 900*a* in the context of the assembled belt sander 100. In FIG. 9C, the gear 910 may be shown to be in contact with the pinion 918, so that rotation of the motor 202 may result in corresponding rotation of the jackshaft of the drive pulley 210, as referenced herein. As should be appreciated from the above discussion, the gear train of FIGS. 9C and 9D illustrates one example that may be used with the belt sander 100, although, in general, the compact and in-line design of the belt sander 100 may benefit from use of other gear trains, such as, for example, a worm drive or cross-axis helical gear design.

Accordingly, an oil or fluid grease may be used in such gear trains, and the seal assembly 900*a* may prevent such oil or fluid grease from leaking from the gearbox 206. For example, the seal assembly 900*a* (and the bearing 908) may be inserted into respective bore(s) 922, and the O-ring 906*a* may prevent leakage around an outer edge of the seal assembly 900*a*, while the lip seal 904*a* may prevent leakage around the jackshaft of the drive pulley 210.

In the design of FIG. 9C, then, leakage may be minimized or prevented. Meanwhile, to remove the gear 910, the drive pulley 210 may simply be pulled out, in which case, the bearing 908 and the seal assembly 900*a* are simply removed from the bore 922. More specifically, as appreciated from FIG. 9C, pressure from the gear 910 on the seal assembly 900*a* during pulling of the drive pulley 210 may result in easy removal of the bearing 908 and the seal assembly 900*a*. That is, a smallest diameter on a flange of the gear 910 may exert pressure on the seal holder 902*a*, and may not exert pressure on the lip seal 904*a* itself. As a result, damage to the lip seal 904*a* may be avoided, and so a need to replace the lip seal 904*a* when servicing the gearbox 206 may be reduced or eliminated.

FIG. 9D is a cut-away view of the gearbox 206 illustrating the seal assembly 900*b*. In FIG. 9D, many of the same or similar advantages and features just described with respect to FIG. 9C are provided for the armature assembly of the motor 202. Specifically, for example, the shaft 916 may be inserted through a bearing 924 and through the seal assembly 900*b*, and into a bore 926 for joining with the pinion 918.

Thus, as just described, the seal assembly 900*b* prevents leakage of oil or grease from the gearbox 206. Moreover, during removal of the shaft 916, a back shoulder of the pinion 918 may contact, and exert pressure on, the seal assembly 900*b*, and, more specifically, on the seal holder 902*b*. In this way, the shaft 916 may easily be removed, e.g., for servicing, without damaging the lip seal 904*b*.

By using the seal assembly 900 that is, in at least some implementations, a slip fit into the same sized bore(s) 922, 926 of the bearings 908, 924, assembly may be performed easily and reliably, and leakage may be prevented. Moreover, disassembly (and subsequent servicing; e.g., replacing of the gear 910) may be performed quickly and easily, without damaging the lip seal 904, thereby facilitating subsequent re-assembly, as well.

Figure 10A:
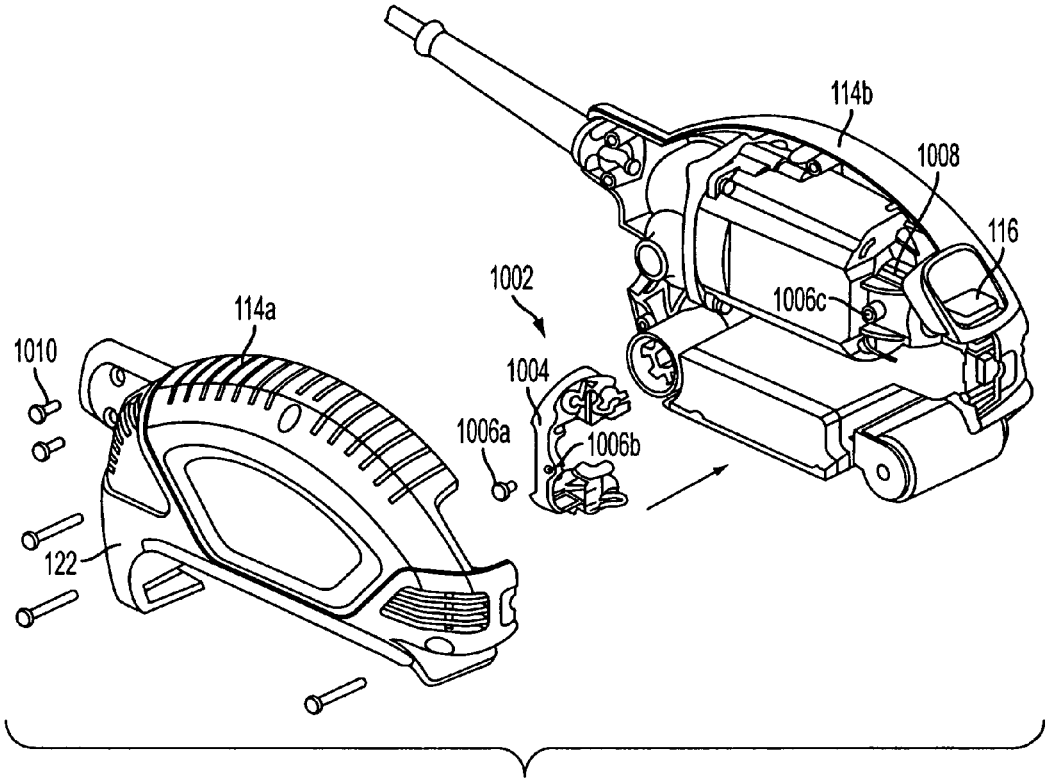
FIGS. 10A-10C illustrate a motor brush system for use in the belt sander of FIGS. 1A and 1B.
Figure 10B:
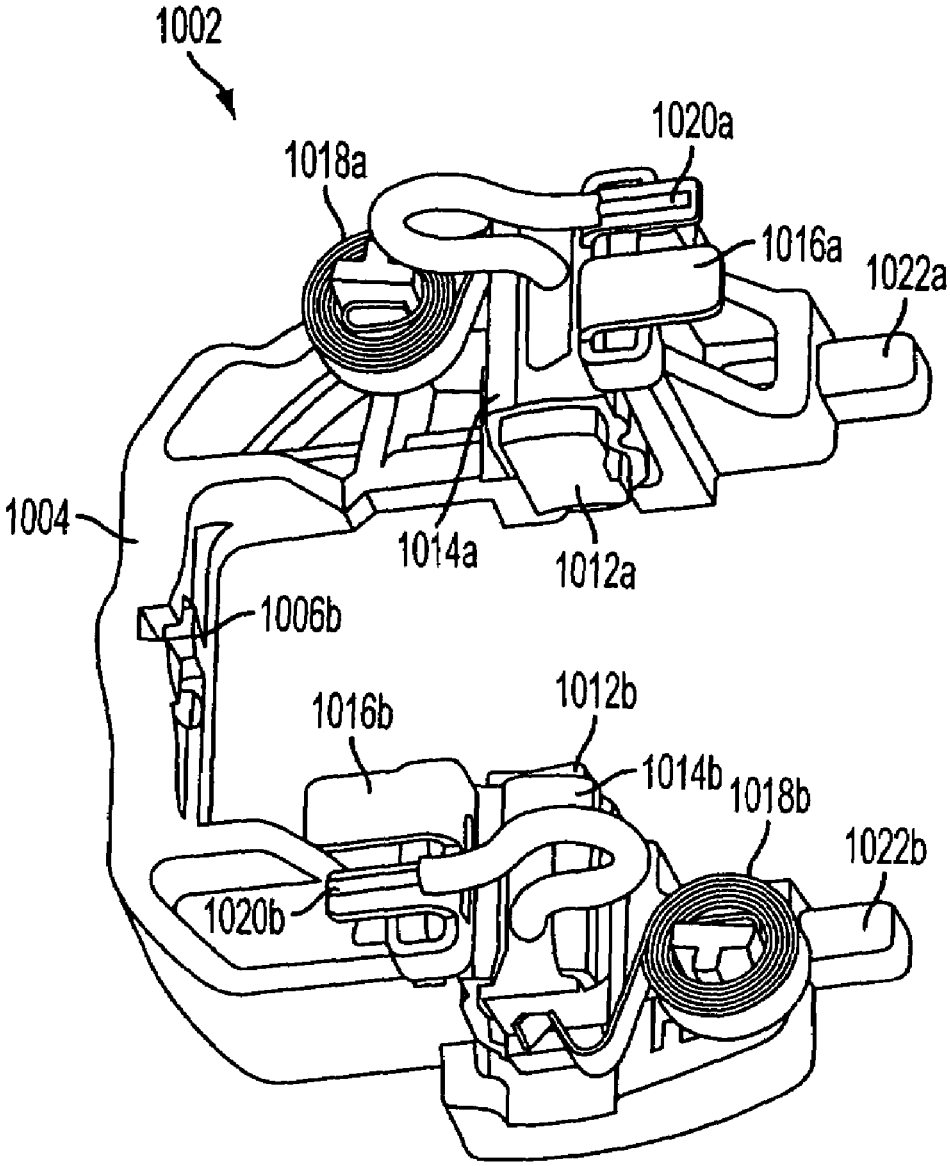
Figure 10C:
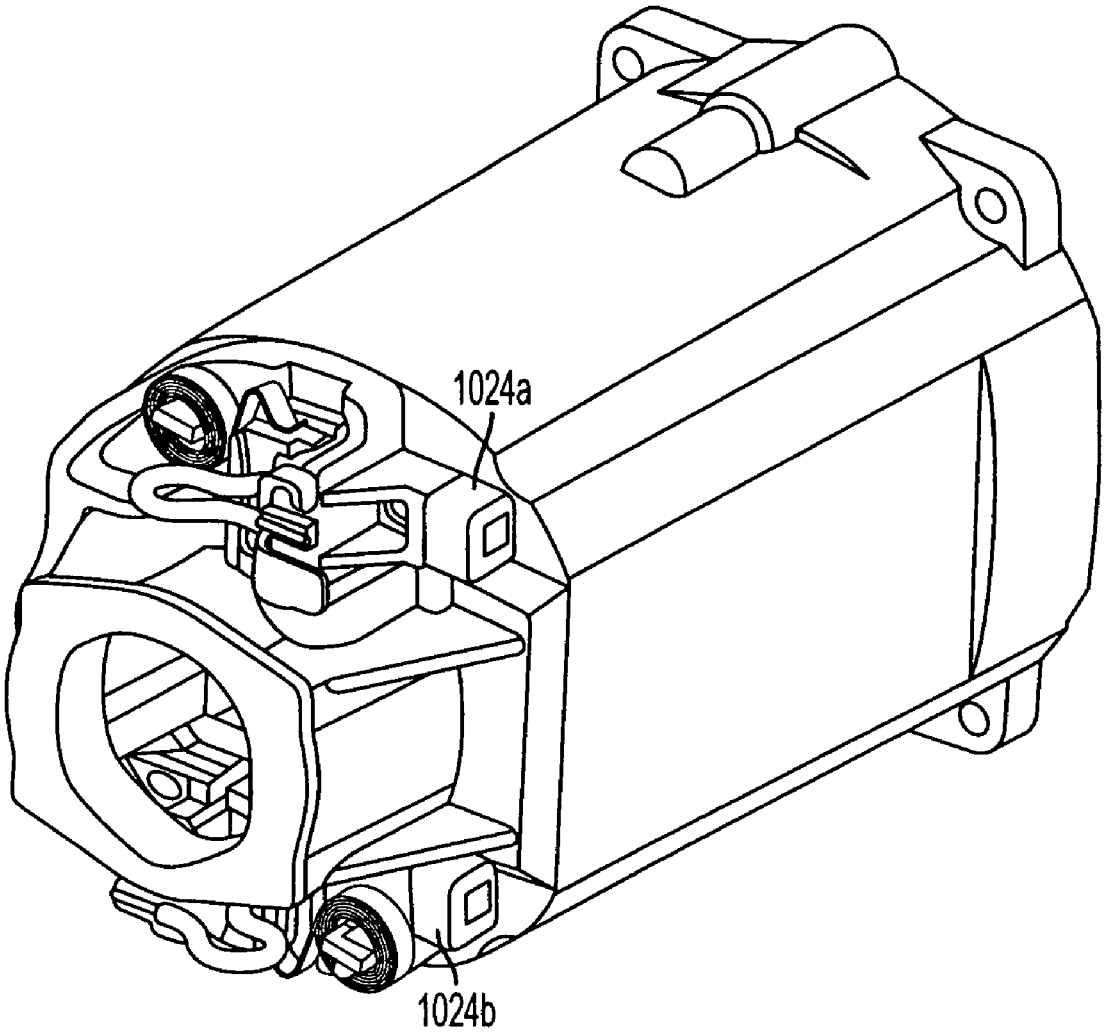

FIGS. 10A-10C illustrate a motor brush system for use in the belt sander 100 of FIGS. 1A and 1B. In FIG. 10A, a curved or concave brush card 1002 is illustrated that includes a frame 1004 having a curved shape, e.g., a C-shape or U-shape. As shown, a screw 1006*a* maybe inserted through hole 1006*b* on the frame 1004, and then into a hole 1006*c* on the motor 202 (or a casing thereof). Thus, the screw 1006*a* illustrates a first type of fastener or mounting element for the brush card 1002, which is easily inserted or removed for mounting or removal of the brush card 1002 itself.

In this way, as should be apparent from FIG. 10A, the brush card 1002 may easily be mounted to, or removed from, the motor 202. Accordingly, brushes (not shown in FIGS. 10A-10C) may provide electrical contact with a commutator of the motor 202 for operation of the motor 202, as is known.

Further, the C-shaped design of the brush card 1002 allows for easy installation and removal to/from the belt sander 100. For example, brushes of the brush card 1002 may wear out over time and may need to be replaced. Accordingly, the right clamshell 114*a* of the handgrip 114 (as well as the casing 122, where the casing 122 may be formed integrally with the right clamshell 114*a*, as referenced above and as shown in FIG. 10A) may be removed simply by attaching/removing screws 1010, so that the brush card 1002 may be accessed. For example, as should be apparent from FIG. 10A, there is no need to remove the left clamshell 114*b*, which may necessitate removal or modification of the various elements mounted on that side of the belt sander 100 (e.g., the tracking knob 124, the belt tension knob 126, and/or the drive belt 208). Thus, upon a wearing out of the brush card 1002, the right clamshell I 114*a* may be removed, the screw 1006*a* may be removed, and the brush card 1002 may be removed and replaced with a new brush card.

FIG. 10B illustrates an expanded view of the brush card 1002 of FIG. 10A. In FIG. 10B, brush boxes 1012*a* and 1012*b* may be seen as being mounted in brush box mountings 1014*a* and 1014*b*, respectively. That is, the brush box mounting 1014*a* snaps onto the frame 1004 with a tab 1016*a*, while the brush box mounting 1014*b* snaps onto the frame 1004 with a tab 1016*b*, as shown.

Springs 1018*a* and 1018*b* may be used to load the brushes (not shown) during operation of the motor. The springs 1018*a* and 1018*b* may be pulled back to allow the brushes to retract into the brush boxes 1012*a* and 1012*b* for installation onto the motor 202 (and/or for removal of the brush card 1002, although if the brushes are sufficiently worn down there may be little or no need to retract the brushes using the springs 1018*a* and 1018*b*, and the brush card 1002 may simply be slid off of the motor 202).

Thus, contacts 1020*a* and 1020*b* may be properly positioned to establish or remove electrical power with/from the motor 202, depending on a selected position (i.e., "on" or "off") of the switch 116. Further, mounting of the brush card 1002 for proper positioning of the brush boxes 1012*a*/1012*b* and the contacts 1020*a*/1020*b* may be obtained using additional or alternative fasteners or mounting elements, as shown in more detail with reference to FIG. 10C, using tabs 1022*a* and 1022*b* that are inserted into mated openings 1024*a* and 1024*b* of a housing of the motor 202.

Figure 11A:
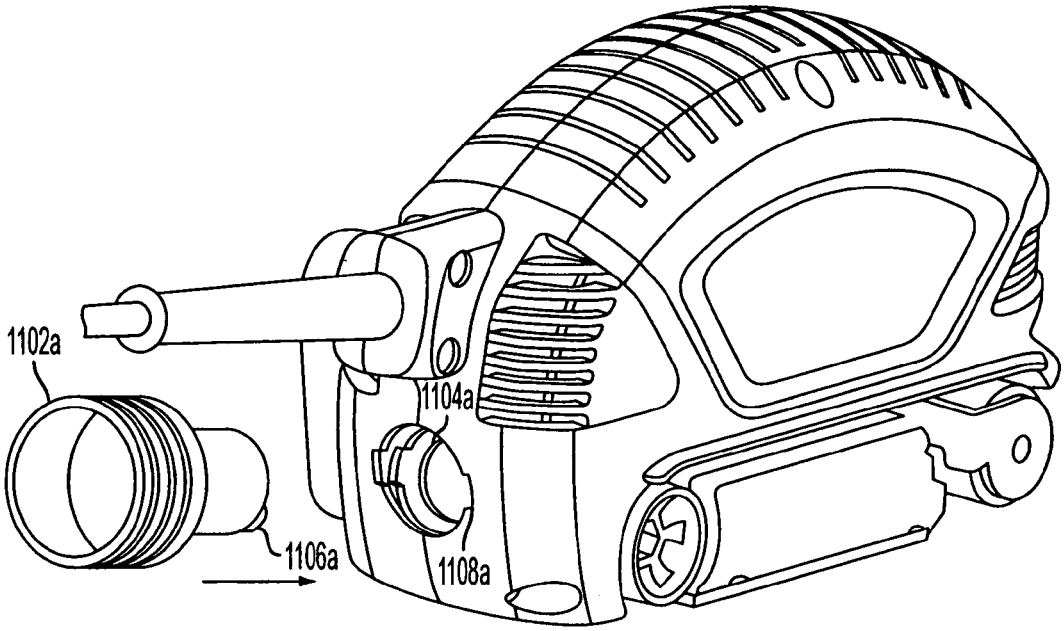
FIGS. 11A-11C illustrate examples of vacuum sub-assemblies for use with the belt sander of FIGS. 1A and 1B.
Figure 11B:
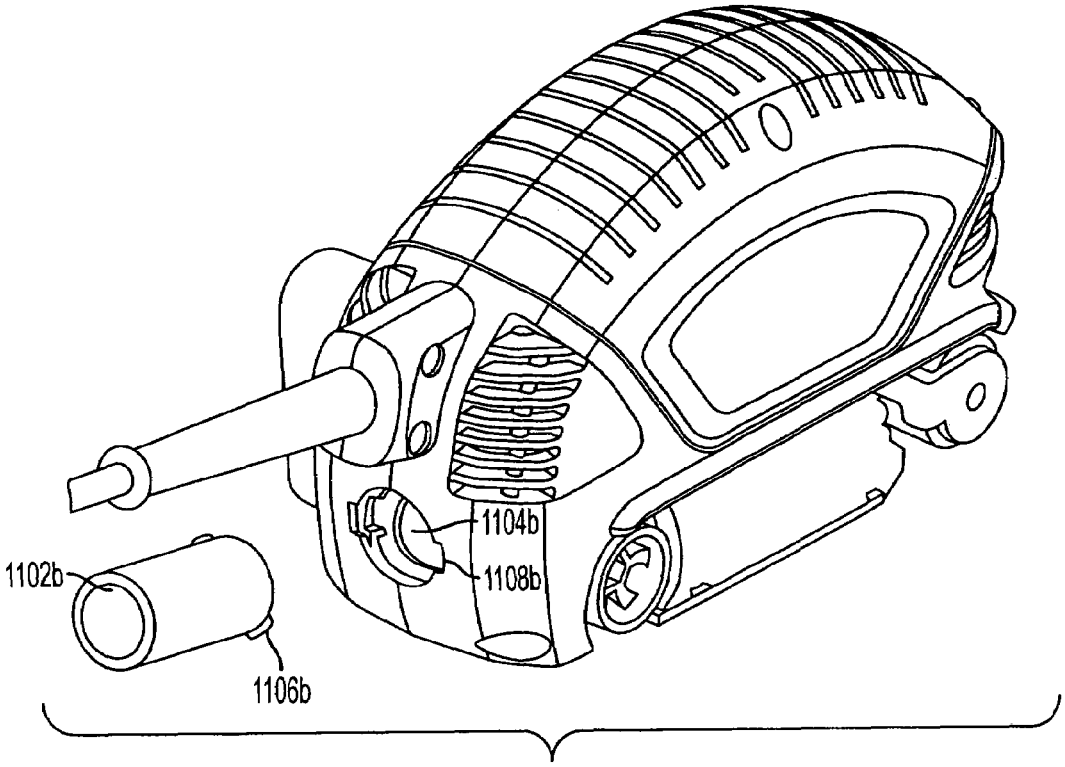
Figure 11C:
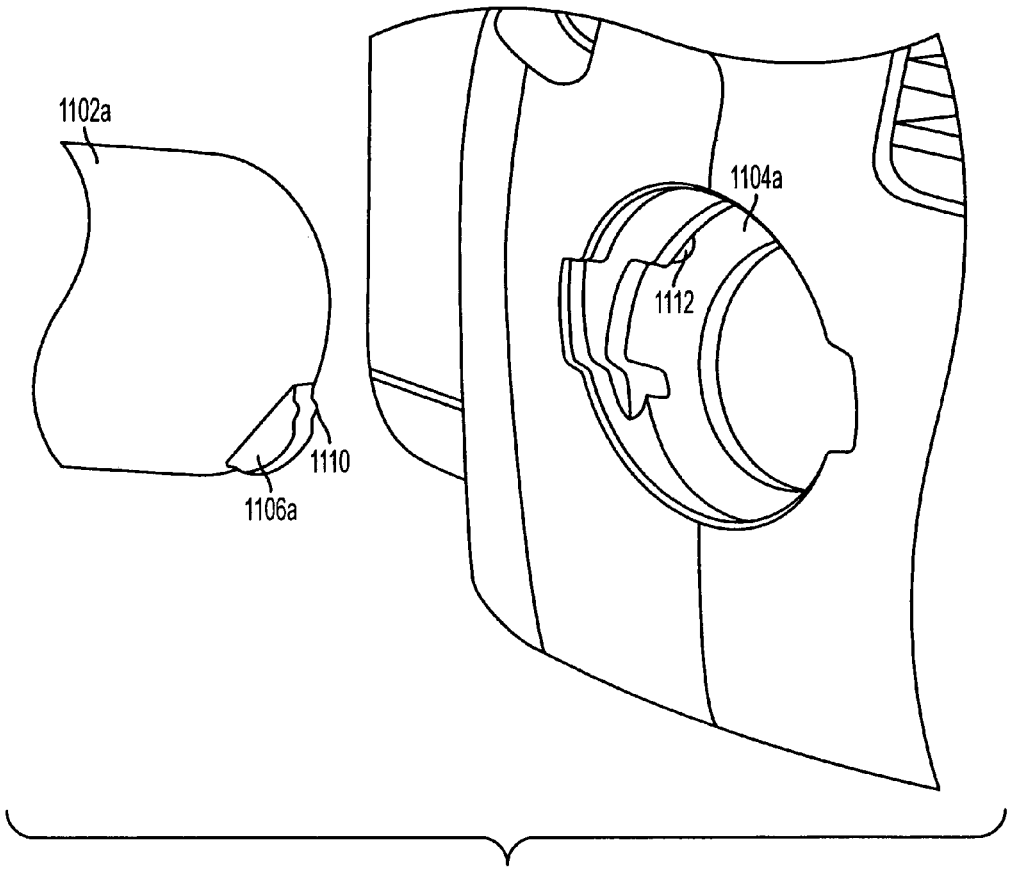

FIGS. 11A-11C illustrate examples of vacuum sub-assemblies for use with the belt sander 100 of FIGS. 1A and 1B. In FIG. 11A, a vacuum attachment nozzle 1102*a* is illustrated that optionally attaches to a port 1104*a*. Specifically, tabs 1106*a* on the vacuum attachment nozzle 1102*a* may be inserted into mating indentations 1108*a*. In the example of FIG. 11A, a vacuum (not shown) may be inserted into an end of the vacuum attachment nozzle 1102*a*, and may be used to collect dust that may result from an operation of the belt sander 100. In this way, the belt sander 100 provides a passive dust collection mechanism by which a powered vacuum is not required as an integral part of the belt sander 100. Rather, power for the (not illustrated) vacuum may be associated with that vacuum, so that vacuum parts requirements for integration with/into the belt sander 100 (e.g., an internal dust fan) are minimized, and power for dust collection is used only when necessary or desired by the user of the belt sander 100 (i.e., by attaching the vacuum attachment nozzle 1102*a* and corresponding vacuum). The example of FIG. 11A illustrates a vacuum attachment mechanism that may be compatible with European devices, mandates, and conventions for dust collection in sanding devices.

A similar implementation is illustrated in FIG. 11B, but with a vacuum attachment nozzle 1102*b*, a port 1104*b*, tabs 1106*b*, and indentations 1108*b*. The example of FIG. 11B illustrates an implementation that may be used in the United States (i.e., may be mounted to conventional vacuums produced in the U.S.).

FIG. 11C illustrates further details of an example attachment technique for mounting the vacuum attachment nozzle 1102 into the port 1104 in an easy, secure, and reliable manner. For example, the tab(s) 1106 may include detents 1110, as shown, while the port 1104*a* may include detent ribs 1112. Thus, the user may insert the vacuum attachment nozzle 1102 into the port 1104, rotate the vacuum attachment nozzle 1102 to the right for, e.g., 45°, and thereby snap the detents 1110 over the detent ribs 1112. The vacuum attachment nozzle 1102*a* may thus be removed by a (reverse) rotation to the left, by virtue of which the detents 1110 may disengage from the detent ribs 1112.

During operation, dust may be swept up, e.g., from a bottom of the belt sander 100 and between a rear of the rear roller 102 and the casing 122, and into the vacuum associated with the vacuum attachment nozzle 1102*a*/1102*b*. Further, the vacuum attachment nozzle 1102*a* (and vacuum) may easily be removed, e.g., for use of the belt sander 100 in a small space that does not permit attachment of the vacuum.

Figure 12:
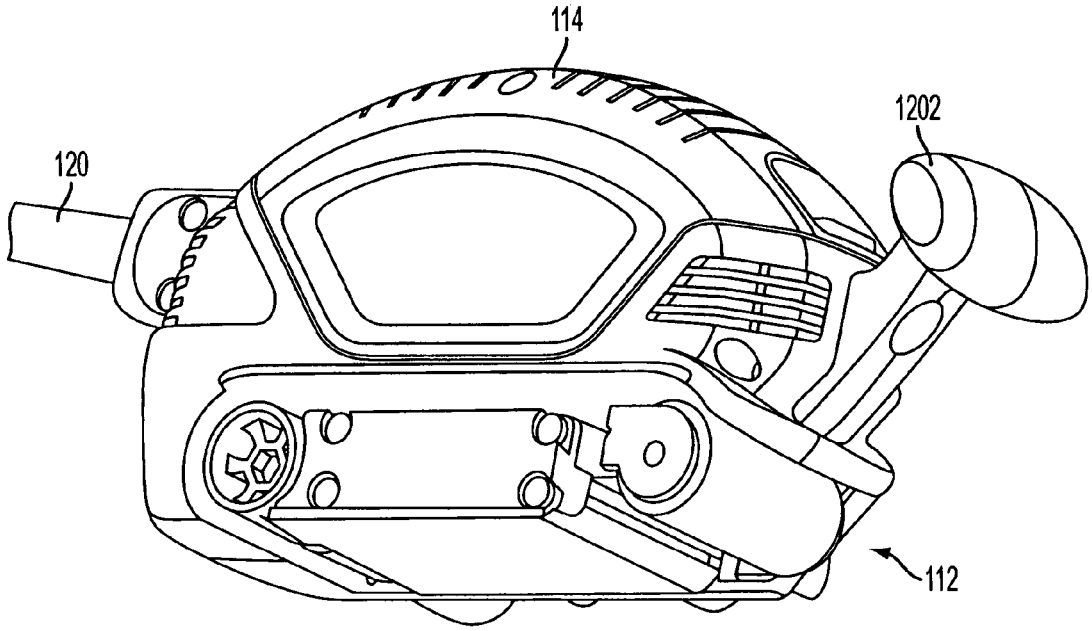
FIG. 12 is a perspective view of an example alternative implementation of the belt sander 100 of FIGS. 1A and 1B.

FIG. 12 is a perspective view of an example alternative implementation of the belt sander 100 of FIGS. 1A and 1B. In FIG. 12, an optional auxiliary handle 1202 is included, and provides an additional gripping surface for the user. In some implementations, the auxiliary handle 1202 may be attachable/detachable by the user, while in other implementations, the auxiliary handle 1202 may be integrally formed with the belt sander 100. Combined with the overmolded handgrip 114, which allows the user to grasp the handgrip 114 in a variety of positions, the auxiliary handle 1202 provides a convenient choice for the user, e.g., to apply additional pressure on a sanding surface during sanding. Further, many other implementations, not necessarily illustrated or described in detail herein, may be used. For example, the power cord 120 (or an associated entry area thereof) may be shaped to form an additional finger grip area, for a convenience and reliability of grip by the user.

Figure 13:
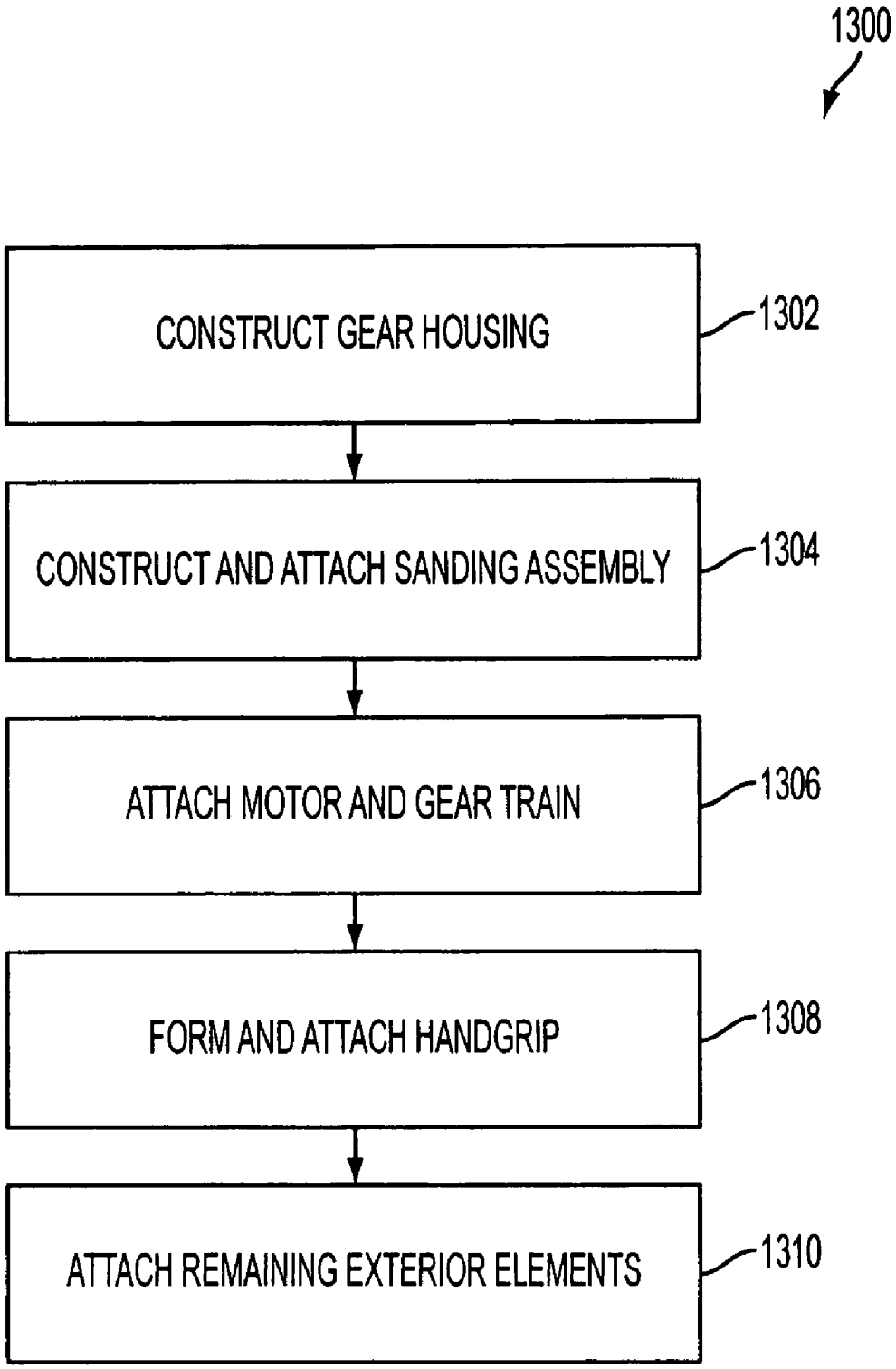
FIG. 13 is a flowchart illustrating methods of manufacturing associated with the construction and/or assembly of the belt sander of FIGS. 1A and 1B.

FIG. 13 is a flowchart 1300 illustrating methods of manufacturing associated with the construction and/or assembly of the belt sander of FIGS. 1A and 1B. In the example of FIG. 13, a gear housing is constructed (1302). For example, the gear housing 214 may be constructed using example techniques discussed below with respect to FIG. 14.

A sanding assembly may be constructed and attached to the gear housing (1304). For example, the sanding assembly 112, including the rear roller 102, the front roller 104, the tracking box 108 (and the tracking mechanism(s) contained therein), and the platen 106 may be formed, assembled, and attached to the gear housing 214.

A motor and gear train may be attached (1306). For example, the motor 202 and a gear train associated with the gear box 206 may be attached. For example, the motor 202 may be attached in-line with the belt sander 100, and substantially over a center and/or center of gravity of the belt sander. In using a worm gear or cross-axis helical gear for translating rotation from the motor 202 to the rear (drive) roller 102, the sealing assembly 900 may be used to reduce or eliminate leakage of oil or grease, while minimizing or preventing damage to the a seal for the oil/grease, particularly during removal of the seal.

A handgrip may be formed and attached (1308). For example, the handgrip 114 may be formed of overmolded plastic that allows easy and comfortable one-handed operation of the belt sander 100. The handgrip 114 may include two or more sub-parts, such as the right and left clamshells 114*a*/114*b*, and may partially or wholly encase or otherwise surround the motor 202. As described herein, placement of the motor 202 in-line with and substantially above the sanding assembly (and within an area above the sanding assembly), along with the encasing of the motor 202 by the handgrip 114, allows for a well-balanced, small, yet powerful belt sanding device.

Finally in FIG. 13, remaining exterior elements, if any, may be attached (1310). For example, the vacuum attachment(s) 1102*a*/1102*b* may be attached, and/or the auxiliary handle 1202 may be attached.

Figure 14:
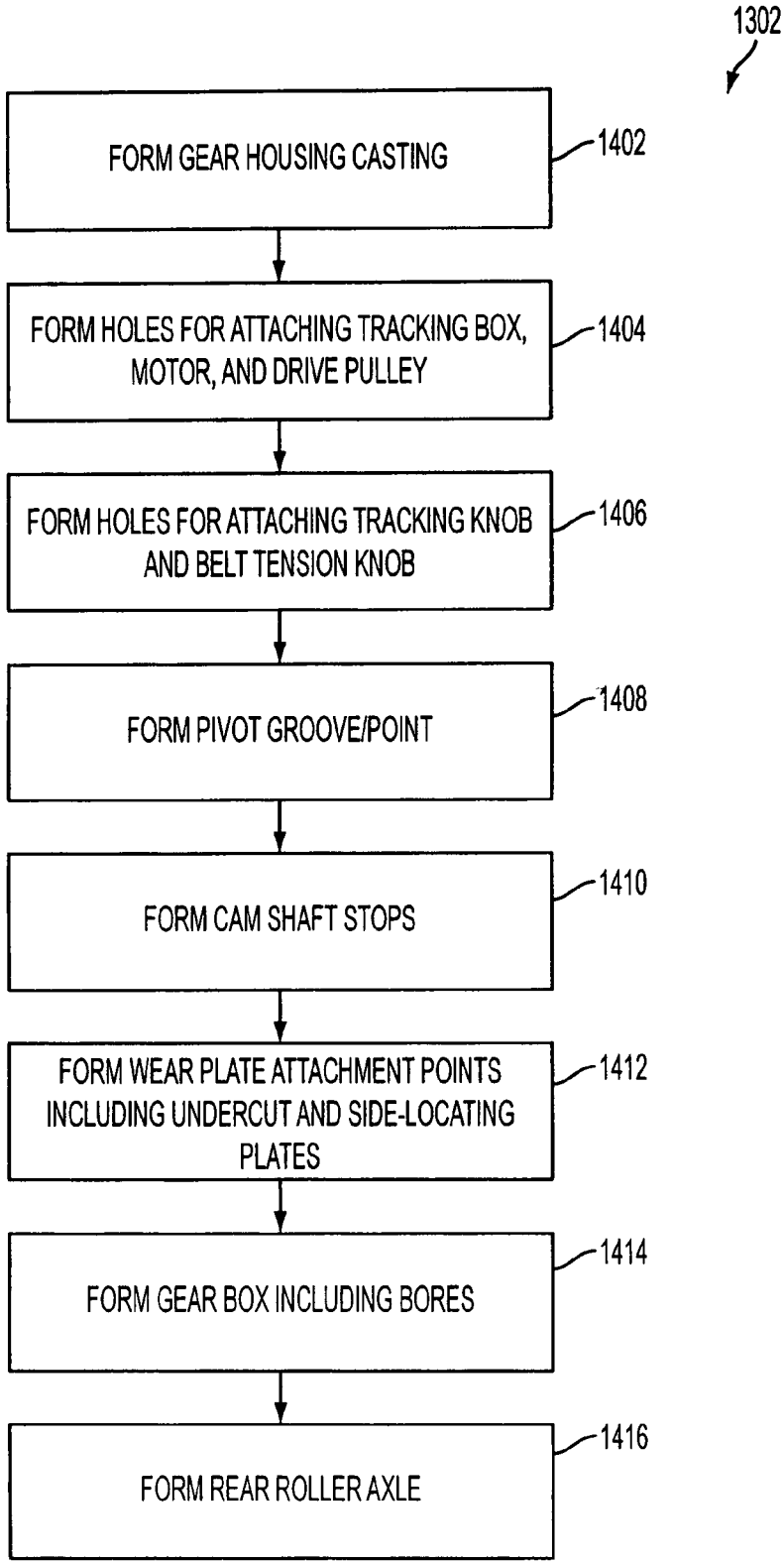
FIG. 14 is a flowchart illustrating alternative implementations of the flowchart of FIG. 13.

FIG. 14 is a flowchart illustrating alternative implementations of the flowchart of FIG. 13. For example, FIG. 14 illustrates additional, alternative and/or more detailed implementations for constructing the gear housing 214 (1302).

In constructing the gear housing 214, an initial casting of the gear housing may be formed (1402). For example, a mold or die in a general shape of the gear housing 214 may be used to shape molten metal into the desired shape of the gear housing.

Holes may be formed in the gear housing 214 for attaching the tracking box 108, motor 202, and drive pulley 210 (1404). For example, screw holes may be formed for attaching the tracking box 108 and the motor 202, using screws. Similarly, holes may be formed for attaching the tracking knob 124 and the belt tension knob 126. For example, the hole 408 may be formed.

A pivot groove/point, e.g., the groove 320, may be formed in the gear housing 214 (1408). In this way, as described above, the pivot pin 316 may be inserted into the grove 320, and used as a rotation point for adjusting a position of the front roller 104 with the tracking knob 124.

Cam shaft stops may be formed (1410). For example, the cam shaft stops 402*a* and 402*b* may be formed that are used to restrict a motion of the cam 314 to, e.g., about ninety degrees when moving the flange 312 (and thus the front roller 104).

Wear plate attachment points (including an undercut for inserting a top end of a wear plate(s)) and side-locating plates) may be formed (1412). For example, the undercuts 806, 808 may be formed in the topwall 214*a* of the gear housing 214, and the side-locating ribs 806, 808 may be formed.

A gear box, e.g., the gear box 206, may be formed, as well as bores, e.g., the bores 922, 926 (1414). Finally, a rear roller axle may be formed (1416), e.g., the axle for the rear roller 102.

As should be understood from the description herein and from general manufacturing principles and techniques, the above description of FIG. 14 is not intended to imply, suggest, or require the particular order illustrated, or any other order. Nor is any requirement implied regarding a number of operations to be performed, since, for example, some operations may be combined into one operation, or one operation of FIG. 14 may be broken into two or more operations. Moreover, similar comments apply to FIGS. 15-17, below, as well.

Figure 15:
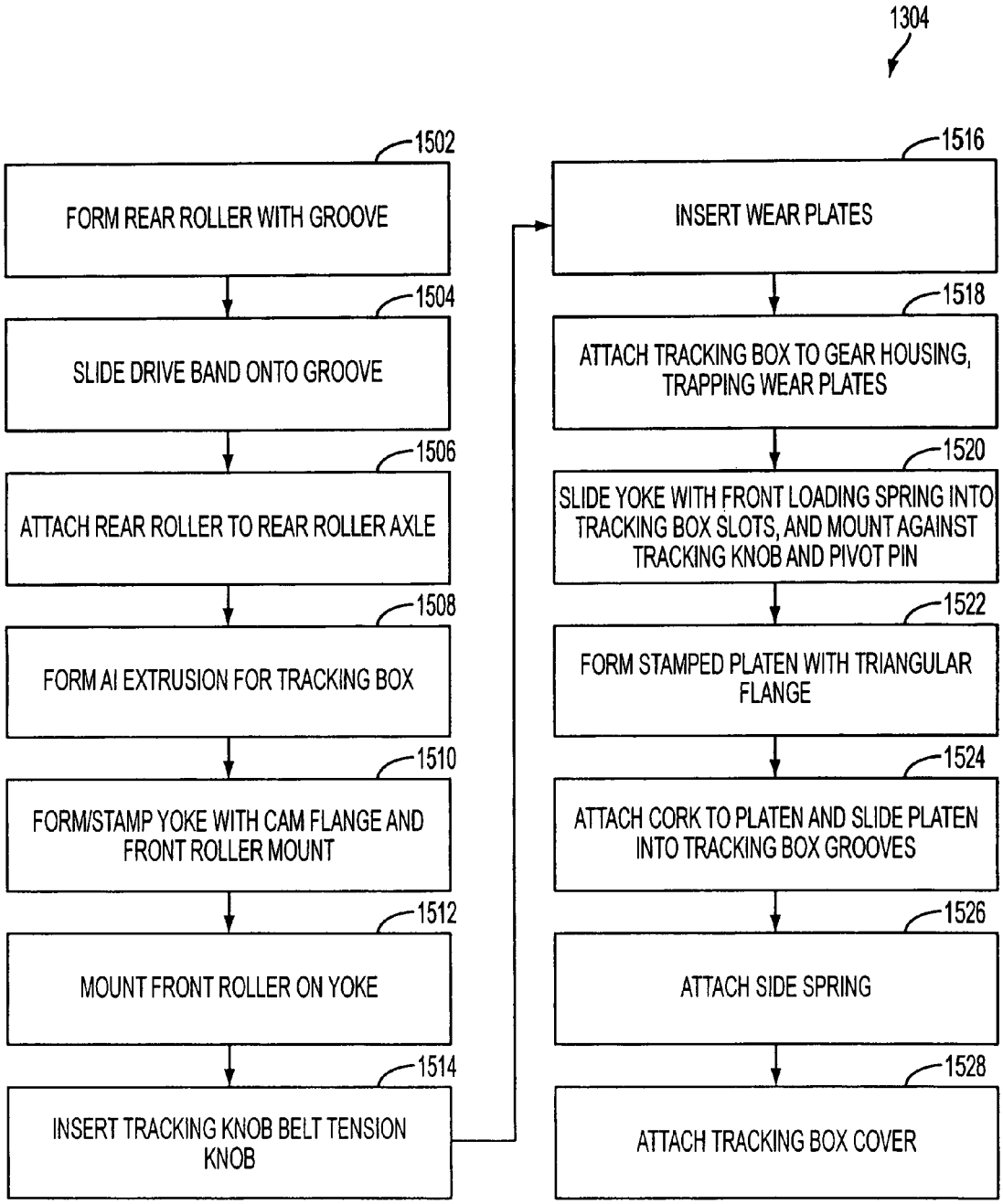
FIG. 15 is a flowchart illustrating alternative implementations of the flowchart of FIG. 13.

FIG. 15 is a flowchart illustrating further alternative implementations of the flowchart of FIG. 13. For example, FIG. 15 illustrates additional, alternative and/or more detailed implementations for constructing/attaching the sanding assembly 112 (1304).

In the example of FIG. 15, a rear roller is formed with a groove (1502), e.g., the rear roller 102 may be formed with the groove 604. Accordingly, a drive band, e.g., the drive band 602, may be slid into the groove 604 (1504), and the rear roller 102 with mounted drive band 602 may be attached to the rear roller axle associated with the gear housing 214 (1506).

Then, an extrusion, e.g., an aluminum extrusion, may be formed for the tracking box 108 (1508). As should be understood from the above description, as well as with reference to FIGS. 5A-5C, the extruding process provides an easy and inexpensive way to obtain the tracking box 108 with the slots 502 and various other useful features (e.g., the flange-mounting groove 510) included therein, so that remaining processing operations may be performed quickly and easily, using such features (as described in more detail below, with further reference to FIG. 15).

A tracking/mounting yoke, e.g., the yoke 302, may be formed (1510), e.g., using stamped metal and including the cam flange 312 and a mount for the front roller 104, so that, accordingly, the front roller 104 may then be mounted thereon (1512). The tracking knob 124 and the belt tension knob 126 may then be slip-inserted into their corresponding holes (1514) formed in the gear housing 214 (as described with respect to FIG. 14 (1404)). Wear plates, e.g., the wear plates 802, 804 also may be inserted or laid into the corresponding undercuts 806, 808 (1516), so that, as a result, top end(s) of the wear plates 802, 804 are held between the topwall 214*a* and the sidewall 214*b*, while motion in a lateral direction is restricted by the side-locating ribs 810, 812.

Then, the tracking box 108 may be attached (e.g., screwed) to the gear housing 214, thereby trapping the wear plates 802, 804 in position (1518). As already described, such techniques for mounting the wear plates 802, 804 thus do not require additional screws or mounts, and yet still allow the wear plates 802, 804 to be formed in a simple (e.g., rectangular or square) shape.

The yoke 302 may be slid into the slots 502 of the tracking box 108, and mounted against the tracking knob 124 (and/or associated compression spring) and the pivot pin 316 (the other end of which is inserted into the groove 320 (1520). As should be apparent from FIGS. 3 and 4A, the yoke 302 may be mounted with the loading spring 304, for appropriate application of tension to the sanding belt and for use in loading of the sanding belt using the belt tension knob 126 and associated components.

The platen 106, which also may be formed from stamped metal, may be formed with, in this example, the triangular flange 512 (1522). Of course, as should be apparent, and as referenced above, forming of the stamped platen 106 need not be performed in the order shown, and may have been performed at a much earlier stage of the process(es). The self-adhesive cork 508 may be attached to the platen 106 as shown in FIGS. 5A-5C, and then the (cork 512 and the) platen 106 may be slid into grooves 510 of the tracking box 108.

A side spring, e.g., the side spring 306, may be attached (1526). As described above, e.g., with respect to FIG. 3, the side spring 306, the tracking shaft 318 of the tracking knob 124, and the pivot 316 at the front roller 104, provide three points with respect to which a position/orientation of the front roller 104 relative to the rear roller 102 may be adjusted, so that a desired tracking of the sanding belt may be obtained. In so doing, the tracking box cover 110 may be attached (1528) to maintain the position of the side spring 306 and otherwise to position and protect internal components of the tracking box 108.

Figure 16:
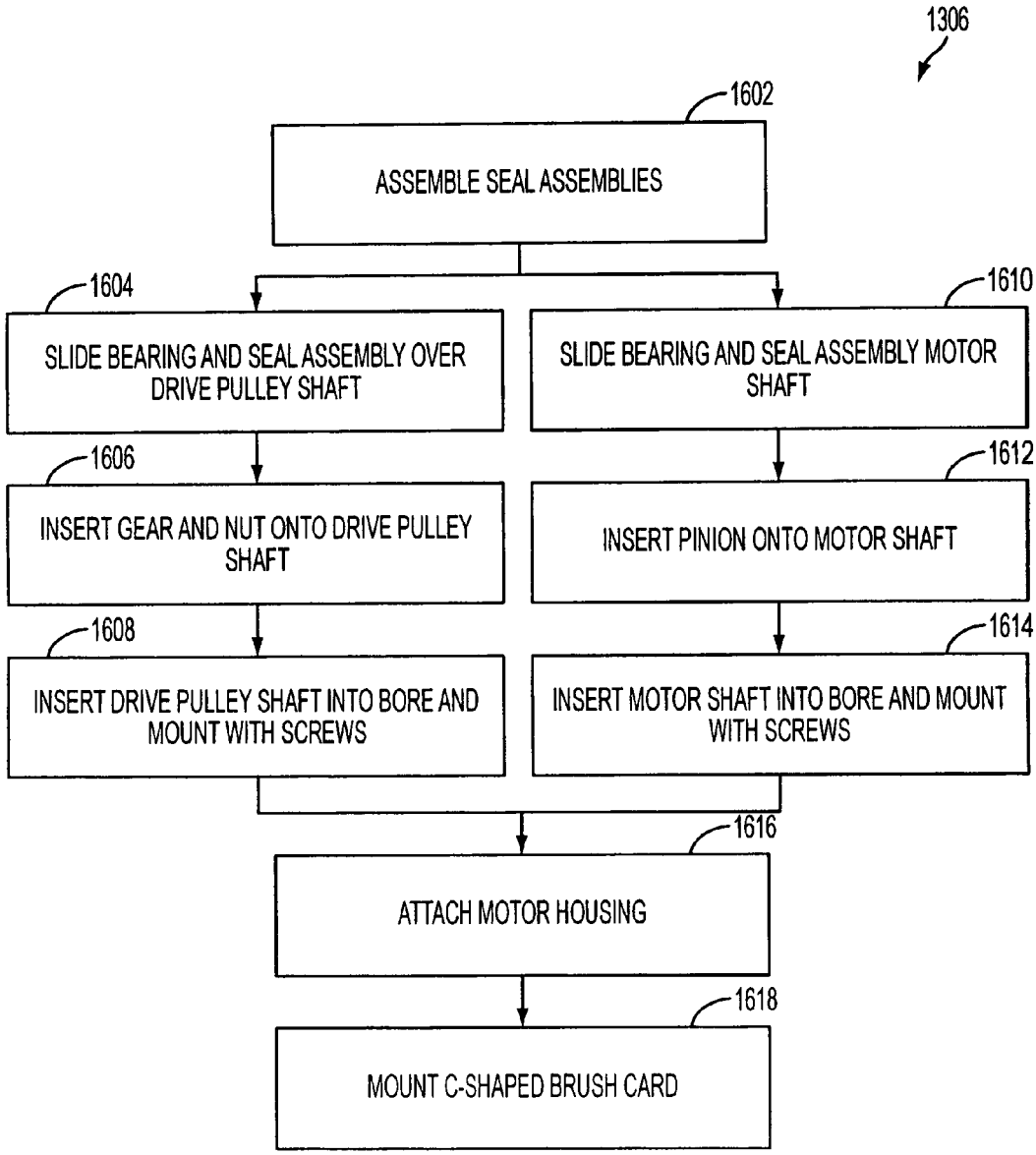
FIG. 16 is a flowchart illustrating alternative implementations of the flowchart of FIG. 13.

FIG. 16 is a flowchart illustrating alternative implementations of the flowchart of FIG. 13. For example, FIG. 16 illustrates additional, alternative and/or more detailed implementations for constructing/attaching the motor 202 (and/or associated components) and/or the gear train (1306).

In FIG. 16, it is assumed that the motor 202, such as the 59 mm AC motor referenced above, is available for assembly/mounting. Thus, FIG. 16 first illustrates an assembling of the seal assemblies 900 (e.g., 900*a*, 900*b*) of FIGS. 9A-9D (1602). For example, the seal assembly 900 may be assembled that includes the seal holder 902, the lip seal 904 contained within (a bore of) the seal holder 902, and the O-ring 906 within the groove 907 of the seal holder 902.

With reference to FIGS. 9B and 9C, the bearing 908 and seal assembly 900*a* may be slipped over the shaft of the drive pulley 210 (1604), which may then be inserted into the gear 910 and the nut 912 (1606). Accordingly, the resulting assembly may be inserted into the bore 922 and mounted with screws 914 (1608).

Similarly, and with reference to FIGS. 9B and 9D, the bearing 924 and the seal assembly 900*b* may be inserted onto the motor shaft 916 (1610), so that the pinion 918 may then be inserted thereon, as well (1612). The motor shaft 916 may then be inserted into the bore 926 and mounted with the screws 920 (1614).

One the gear trains are constructed and mounted as just described, so that the motor 202 also is appropriately mounted, a housing of the motor 202 (visible, for example, in FIGS. 2A and 2B) may be attached (e.g., slid over) the motor 202 (1616). Finally in FIG. 16, the C-shaped brush card 1002 may be mounted (1618) to the motor 202 as shown in FIGS. 10A-10C, by retracting the brushes with the springs 1010*a*, 1010*b* and using the mounting tabs 1014*a*, 1014*b* into mounts 1024*a*, 1024*b*.

Figure 17:
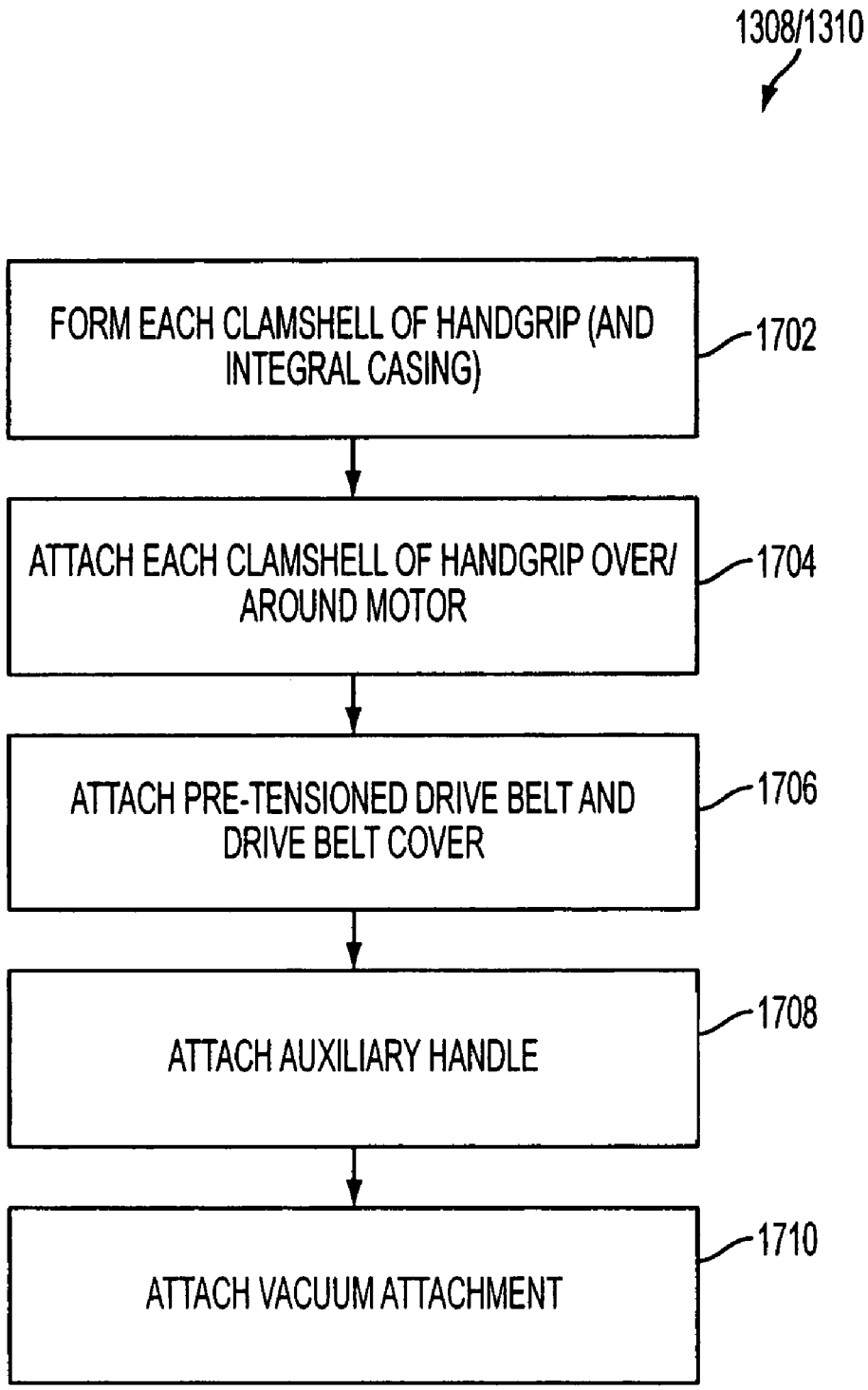
FIG. 17 is a flowchart illustrating alternative implementations of the flowchart of FIG. 13.

FIG. 17 is a flowchart illustrating alternative implementations of the flowchart of FIG. 13. For example, FIG. 17 illustrates additional, alternative and/or more detailed implementations for forming/attaching the handgrip 114 (1308) and attaching any optional/exterior components (1310).

In the example of FIG. 17, each clamshell 114*a*, 114*b* of the handgrip 114 is formed, along with integral casing 122 (1702). The casing 122 may include symmetrical half-openings that, when joined together, form the hole(s) 1104*a*/104*b* of FIGS. 11A-11C that may be used with a vacuum attachment(s), as described above. As already referenced, the clamshells 114*a*, 114*b* may be formed of over-molded plastic that is contoured for easy and comfortable one-handed operation of the belt sander 100.

Each clamshell 114*a*, 114*b* may then be attached over and/or around the motor 202 (1704). Although the examples of FIGS. 1A-12 illustrate a substantially complete encompassing of the motor 202 by the handgrip 114, it should be understood that, in other implementations, the handgrip 114 may only partially encompass or encase the motor 202.

The pre-tensioned drive belt 208 may then be attached around the drive pulley 210 and the driven pulley 212 (1706). For example, specifications for an amount of pre-tensioning to be applied to the drive belt 208 may be provided to a supplier of the drive belt 208, where, as already described, the specifications may be selected based on, for example, a torque of the motor 202 when some or all of the sanding assembly 112 is jammed (e.g., a torque higher than a rated torque range of the motor 202), a length of the drive belt, a diameter of the drive pulley 210/driven pulley 212, and/or a center distance between the drive pulley 210 and the driven pulley 212. In this way, a desired amount of slippage of the drive belt 208 may be obtained during an accidental jamming of the belt sander 100, so that the user of the belt sander 100 is provided with time to turn off power applied thereto and reduce or prevent damage to the motor 202. Finally in FIG. 17, the auxiliary handle 1202 may be attached (1708) and/or the vacuum attachment 1102*a*/1102*b* may be attached (1710).

In some example implementations, which may be additional or alternative to the implementations discussed above with respect to FIGS. 1-17, and which are discussed in more detail below with respect to FIGS. 18-23, the belt sander(s) may include a high voltage direct current motor for providing rotational torque to the belt sander. In some such example implementations, a motor housing may generally encompass the motor for enclosure of the motor and motor control components. The motor housing may generally be contoured to be received by a human hand and sized to a generally sized human hand. Further, a sanding assembly may be operationally coupled to the motor housing for providing an abrasive surface to be used to sand a desired surface. The sanding assembly may include a plurality of rollers, the plurality of rollers including a front roller and a rear roller, and the front roller may be of a smaller diameter than the rear roller. The motor housing generally contoured to be received by the human hand and sized to the generally sized human hand may allow a user to control the belt sander with one hand.

In some example implementations discussed below in association with FIGS. 18-23, the high voltage DC motor may be oriented in line with the direction of travel of the sanding assembly. Further, a power switch may be disposed within the front of the housing to control the transmission of electricity to the motor. In addition, a variable speed switch or dial may be disposed within the front of the housing to allow a user to vary the speed of the motor. In additional implementations, the motor housing may be contoured so that a user's hand and wrist occupy different planes during use of the belt sander. Moreover, the belt sander may include a gearing system for transmitting torque to the sanding assembly. In some example implementations, such a gearing system(s) may be enclosed by a gear housing to prevent dust and debris from entering the gearing system and for dampening noise. In still further implementations, the motor housing contouring may define an indentation for a user's thumb.

Referring in general to FIGS. 18-23, a belt sander 1800 is contoured to allow a woodworker to easily grip the sander and apply the sander to a workpiece. In an example embodiment, the motor housing is substantially contoured to be received by a human hand. For example, the entire motor housing may be configured to conform to a user's hand. In another example embodiment, the front roller of the sanding assembly is of a smaller diameter than the diameter of the rear roller adjacent to a power cord. Thus, the resulting configuration of the belt sander 1800 allows a woodworker to exert better control over the leading edge of the belt sander by providing an ergonomically configured motor housing. The belt sander 1800 therefore permits efficient control, and, in addition, the belt sander 1800 permits material removal in limited work environments. In some example implementations, and as referenced above, a use of a high voltage direct current motor provides rotational torque to the sanding assembly.

Figure 18:
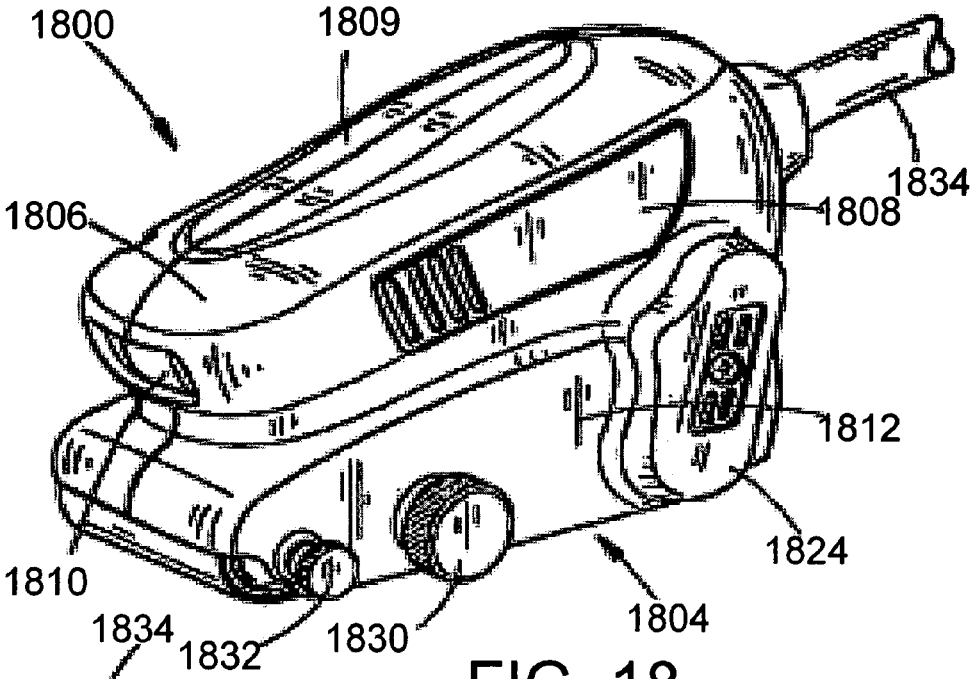
FIG. 18 is an isometric illustration of an alternative example implementation of a belt sander.
Figure 21:
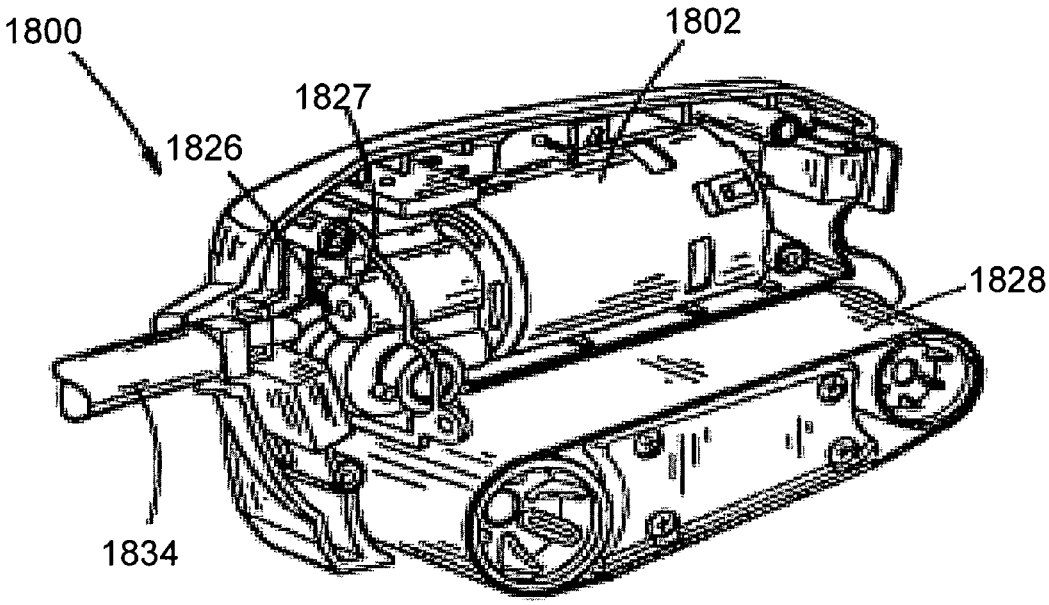
FIG. 21 is an isometric view of the belt sander shown in FIG. 18, wherein the motor housing is removed revealing a gearing system, including a gear housing, for transmitting torque to the drive belt pulley.

Referring specifically to FIG. 18, a belt sander 1800 in accordance with an example embodiment is provided. The belt sander 1800 includes a motor 1802 (as shown in FIG. 21) for providing rotational torque to a sanding assembly 1804 included within the belt sander 1800. In an example embodiment, a high voltage direct current (HVDC) motor is included in lieu of a traditional induction or synchronous motor(s). Use of a HVDC motor may offers high efficiency, multi-speed control and low frequency noise. Additionally, in an example embodiment, the motor 1802 axis may be oriented in-line with a direction of travel of a sanding assembly 1804. The in-line configuration of the motor 1802 allows the weight of the motor 1802 to be uniformly distributed over substantially the entire sanding interface, and to be relatively light, so that user fatigue may be decreased while user comfort is increased.

As illustrated by FIG. 18, in an example embodiment, a motor housing substantially encloses the motor 1802 and motor control components. In the example embodiment, the motor housing 1806 is contoured to provide a gripping surface for a user. For example, the motor housing 1806 may be configured to the shape of a user's palm so that the user's palm is place directly over the motor housing 1806 so that in use the user's hand and wrist are parallel with a direction of travel of the sanding assembly. Such configuration allows the user to maintain sufficient control of the sander.

In example embodiments, the housing is formed of materials which may include the desired rigidity, machinability and impact resistance such as polyvinyl chloride (PVC), acrylonitrate-butadiene-styrene (ABS), ultra high molecular weight polyethylene (UHMW) plastic, and the like. In additional embodiments, soft grip sides 1808 and top 1809 are included to reduce vibration transferred to the user and allow a user to maintain efficient control over the sander 1800 by providing an easy-to-grip surface. In such embodiments, the soft grip sides 1808 may be formed of elastomeric material such as foam, rubber, rubber impregnated with gel, or the like. It is contemplated that gripping pads may be included in addition to or instead of soft grips sides.

Figure 23:
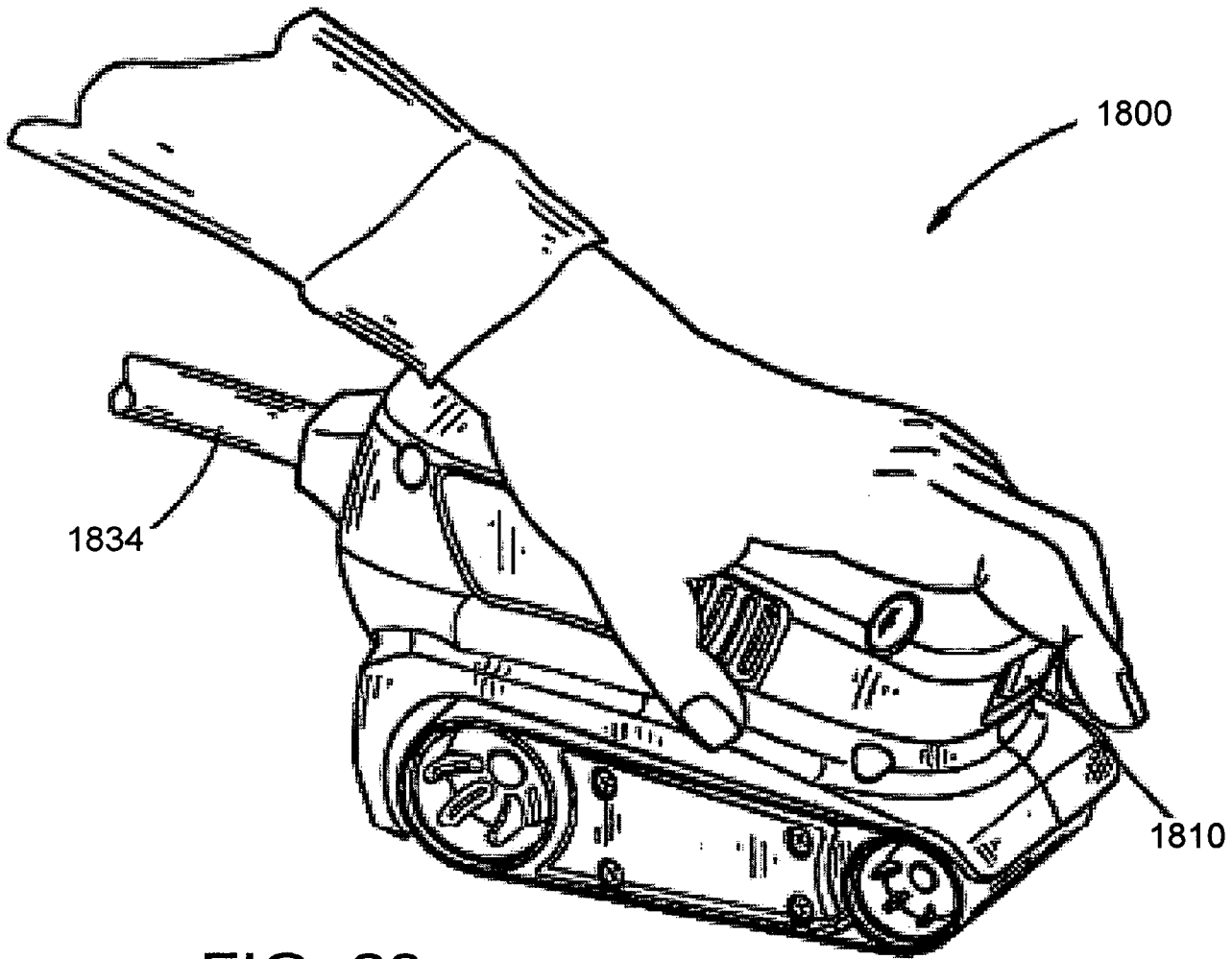
FIG. 23 is an isometric view of the belt sander shown in FIG. 18, wherein the placement of a user's hand is illustrated.

In further additional example embodiments, the belt sander 1800 may include a power cord 1834 and switch 1810 to control power transmission to the motor 1802 and motor components. In an example embodiment, the power cord 1834 is located on the rear of the motor housing 1806 to allow operation of the belt sander 1800 without interference of the power cord 1834. The rear of the motor housing 1806 may include a part of the sander 1800 which is covered by the a user's wrist and the lower edge of a user's palm during operation of the belt sander 1800. In further example embodiments, the power switch 1810 may be located on the front of the housing 1806 relative to the power cord 1834. Such configuration allows a user to grip the belt sander 1800 via the side grips 1808, gripping pads or the like while minimizing inadvertent manipulation of the power switch 1810 (as illustrated in FIG. 23). However, the power switch 1810 may be within a finger's reach, allowing a user to reach the switch 1810 if desired.

In additional example embodiments, the belt sander 1800 may include a mechanism to allow for speed variation. For example, in some example embodiments, the power switch 1810 may be a multi-positional switch allowing a user to vary motor speed as desired. Use of the HVDC motor, as described above, allows the belt sander to be capable of operating at various speeds. In an example embodiment, the switch 1810 may be located on the front of the motor housing 1806 relative to the power cord 1834, allowing a user to alter the speed of the sander without the user having to vary gripping position orientation. In further example embodiments, the belt sander 1800 may include a separate switch/dial for speed variation. In such embodiments, the additional switch/dial also may be located on the front of the motor housing 1806 relative to the power cord 1834. Such a configuration may allow motor speed to be varied without the user having to vary gripping position orientation. For example, the switch/dial may be configured so that it may be manipulated by a user's index finger. Further, the dial may denote pre-defined increments of variations in speed. In addition, the dial also may allow for smaller incremental variations in speed within the pre-defined increments.

In an example embodiment(s), the belt sander 1800 includes the sanding assembly 1804. Such assembly 1804 may be enclosed by a skirt 1812 of the motor housing 1806. In example embodiments, the skirt 1812 may be formed of materials which include the desired rigidity, machinability and impact resistance such as polyvinyl chloride (PVC), acrylonitrate-butadiene-styrene (ABS), ultra high molecular weight polyethylene (UHMW) plastic, and the like. In an example embodiment, the skirt 1812 is light weight and contoured to the general size of the motor housing 1806. Further, the skirt 1812 may protect the components within the sanding assembly 1804 from damage, and may prevent dust and debris from entering the assembly 1804.

Figure 19:
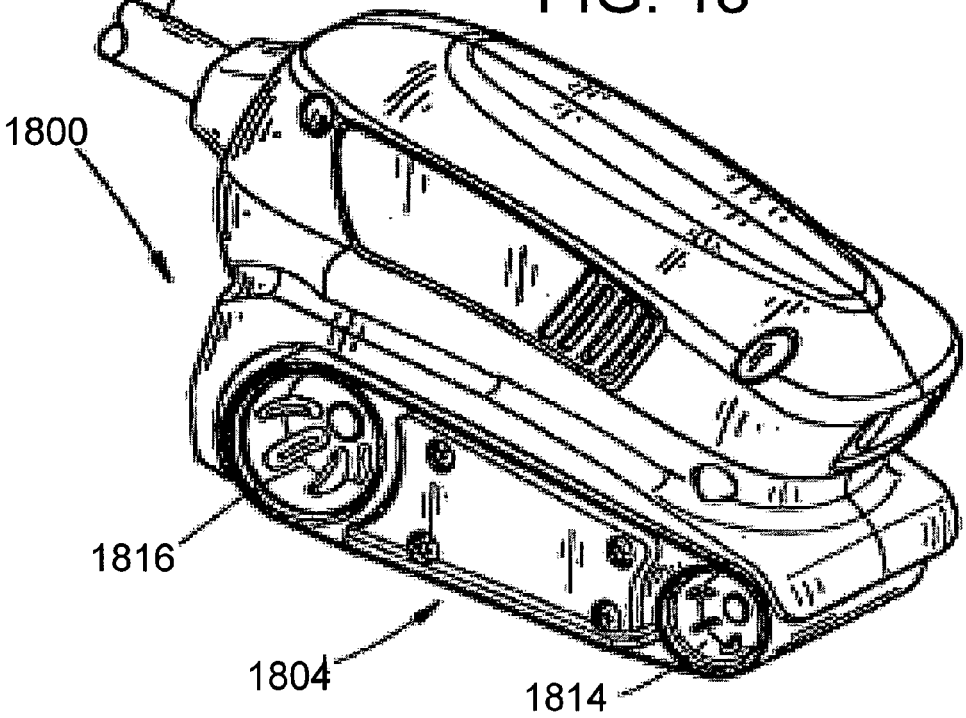
FIG. 19 is an alternate side view of the belt sander shown in FIG. 18.
Figure 20:
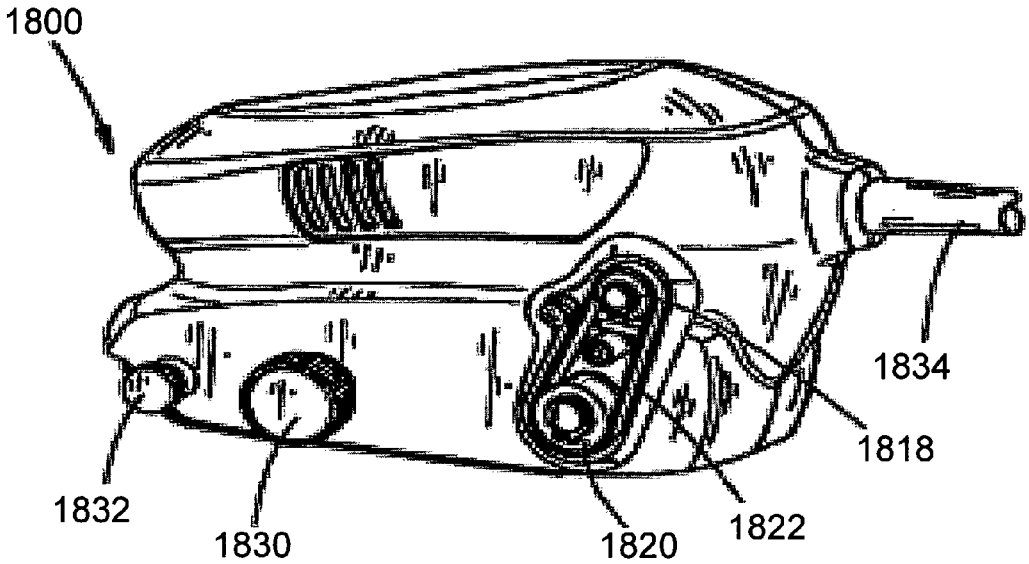
FIG. 20 is a partial side view of the belt sander shown in FIG. 18, wherein a sanding assembly including a drive belt pulley and a pitch belt is illustrated.

As illustrated in FIG. 19, the sanding assembly 1804 may include a front roller 1814 and a rear roller 1816 relative to the power cord 1834. In an example embodiment(s), the front roller 1814 may be of a smaller diameter than the rear roller 1816, resulting in the rake of the motor housing 1806 to be at an incline. Such configuration provides an inclined grip surface allowing a user hand, wrist and elbow to align in various planes. Providing the ability for the user's hand, wrist, and elbow allow the user to control the sander with one hand while in use whereby the inclined grip surface allows the sander 1800 to fit snugly in the palm of the user's hand providing a user with better control over the leading edge of the belt sander 1800 when a user's arm is angled. For example, the mushroom contour of the belt sander 1800 allows a user to grip the sander 1800 with one's thumb resting within a lower channel or recess. In further example embodiments, the front roller 1814 is an idle roller. In an alternative embodiment(s), power is transmitted to the front roller 1814 from the rear roller 1816 via a transmission system.

In additional example embodiments, the sanding assembly 1804 may include a pulley system which transmits the torque provided from the motor 1802 to the sanding assembly 1804. The pulley system may include a plurality of pulleys and belts. As illustrated in FIG. 3, in an example embodiment the plurality of pulleys may include a drive belt pulley 1818 and a driven pulley 1820. Further, in such embodiments, a pitch belt 1822 is present to transfer rotation from the drive belt pulley 1818 to the driven pulley 1820 which is connected to the rear sanding belt roller 1816. In an example embodiment, the width of the pitch belt 1822 is approximately three (3) millimeters. Such size of belt allows may allow rotation to be transferred from the drive belt pulley 1818 to the driven pulley 1820 effectively while minimizing the footprint of the belt sander 1800. Additionally, the plurality of pulleys and the pitch belt may be enclosed by a belt or transmission housing 1824 (shown in FIG. 18). Such housing 1824 may prevent dust and debris from entering and possibly interfering with the function of various components.

In further example embodiments, as illustrated in FIG. 21, power may be transmitted to the drive belt pulley 1818 via a gearing system 1826. In an example embodiment, the gearing system 1826 is a crossed helical gearing system or a worm-drive gearing system is utilized to transmit power to the drive belt pulley 1818. The use of a crossed helical gearing system or a worm-drive gearing system is advantageous for such systems reduce vibration/noise generated during operation as well as the stress placed on the gearing system in comparison to alternative gearing systems (e.g. spur gearing systems). In additional example embodiments, the gearing system 1826 may be enclosed by a gear housing 1827. The gear housing 1827 may provide an additional barrier to dust and debris, dampen noise, and to allow for subassembly.

Figure 22:
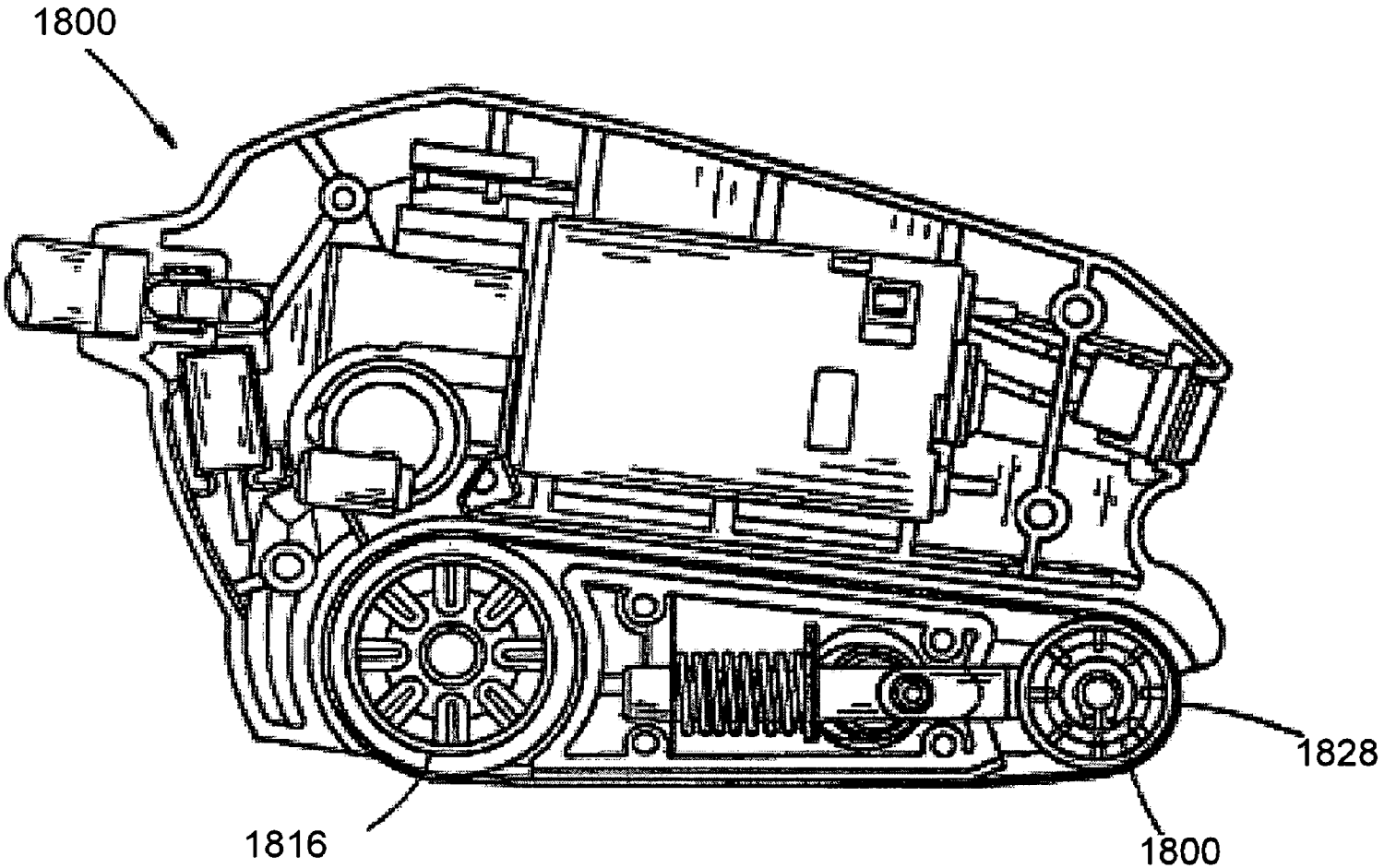
FIG. 22 is a cross-sectional view of the belt sander shown in FIG. 18, wherein a sanding assembly including a sanding belt wrapped around a front roller and a rear roller is illustrated.

Additionally, as demonstrated in FIG. 22, a sanding belt 1828 may include abrasive material extending around the front roller 1814 and the rear roller 1816. In an example embodiment(s), the sanding belt 1828 may be two and a fourth (2¼) inches wide and thirteen (13) inches long. In an alternative embodiment, the sanding belt 1828 may be two and a half (2½) inches wide and thirteen (13) inches long. It is contemplated that the type as well as the size of abrasive material included within the sanding belt 1828 may vary depending upon the users need such as to allow for less aggressive fine sanding.

In additional example embodiments, the sanding assembly 1804 may include a belt tensioning adjuster 1830 allowing a user to apply or release tension to the sanding belt 1828. For example, the sanding assembly 1804 may include an extending platen to extend or shorten the path of travel of the sanding belt or to extend an idle roller forward and back. Further, an additional belt tracking adjuster 1832 also may be included to allow for tool-free alignment of the sanding belt 1828. In an example embodiment(s), the belt tracking adjuster 1832 may be included within the front of the sanding assembly 1804. For example, if the sanding belt 1828 starts to track to one side of the sander 1800, a user may adjust the belt tracking by rotating the belt tracking adjuster 1832, so that clockwise movement of the belt tracking adjuster may move the belt to the right when facing the sander 1800, while counterclockwise movement moves the belt to the left.

In use, the motor provides torque to the sanding assembly 1804 via a gearing system 1826 (e.g. a cross helical or worm drive gearing system) wherein such system transmits power to the drive belt pulley 1818. In turn, the pitch belt 1822 then transfers rotation from the drive belt pulley 1818 to the driven pulley 1820 and the rear sanding belt roller 1816. The instant configuration thereby allows a user to operate the belt sander 1800 vertically, horizontally or at various angles in-between.

In additional example embodiments, the belt sander 1800 may include mechanisms designed to minimize or eliminate dust generated by fast sanding action. For example, in one embodiment, the belt sander 1800 may include an integrated dust collection system which allows dust to be collected within a receptacle during operation. In an additional embodiment, the belt sander 1800 may include a dust outlet allowing the belt sander 1800 to be directly connected to a conventional shop vacuum hose or a centralized vacuum system. In further example embodiments, a dust collection skirt may be included for managing dust generated during use. In an example embodiment, the dust collection skirt may be located towards the rear of the sander 1800 towards the power cord 1834 in order to not interfere with the operation of the sander 1800 and to direct dust away from the workpiece.

Thus, a sander comprised of a high voltage direct current motor for providing rotational torque to the sander is disclosed. In an example embodiment, a motor housing generally encompasses the motor for enclosure of the motor. The motor housing may be generally contoured to be received by a human hand, and sized to a generally sized human hand. Further, a sanding assembly may be operationally coupled to the motor housing for providing an abrasive surface to be used to sand a desired surface.

With reference to FIGS. 24-30, a belt tracking mechanism for a belt sander is disclosed that may be economical to manufacture, easy to assemble, and that may provide the functions of keeping a belt in proper tension, preventing harmful torquing of rollers normal to the flow of the belt, and/or keeping the rollers aligned to prevent belts from slipping off. Further, a hand-adjustable alignment feature for aligning the rollers in the belt sander is disclosed herein and illustrated with respect to FIGS. 24-30.

The belt sander tracking mechanism 10 for the belt sander of FIGS. 24-30 has a drive roller 15 driven by a motor (not shown in FIGS. 24-30), an idle roller 20, with sandpaper 22 (or a belt), received around the outside of the drive and idle rollers, and a platen 25 against which the backside of the belt rests when the platen is pushed against the work piece to be sanded. The drive roller has an axle axis 27. The idle roller has a cantilevered axle axis 29, which is connected to the yoke 30 in a cantilevered fashion.

Figure 24:
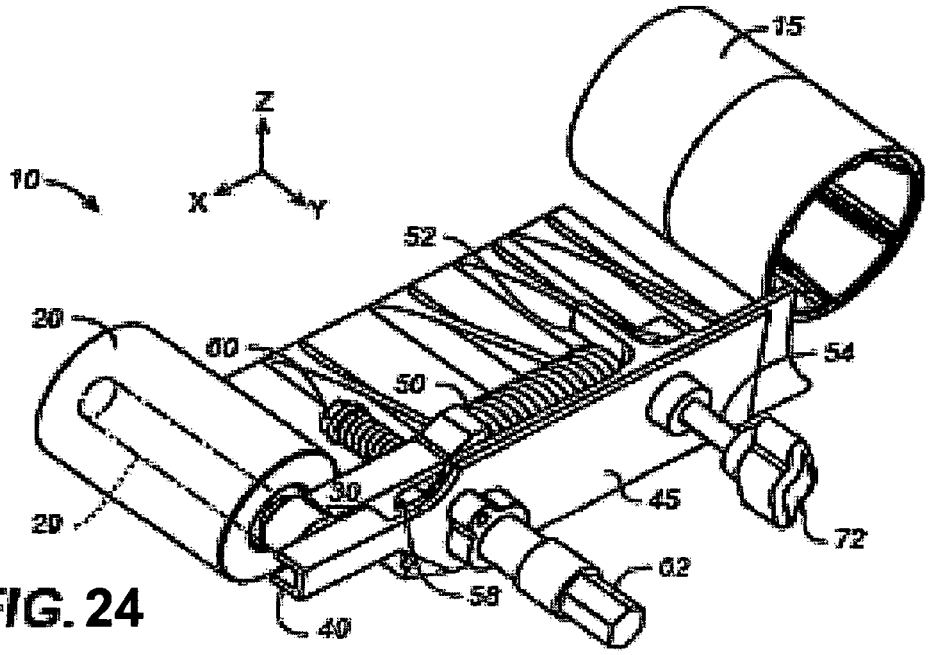
FIG. 24 is a perspective topside view of an additional or alternative belt tracking mechanism for a belt sander.
Figure 25:
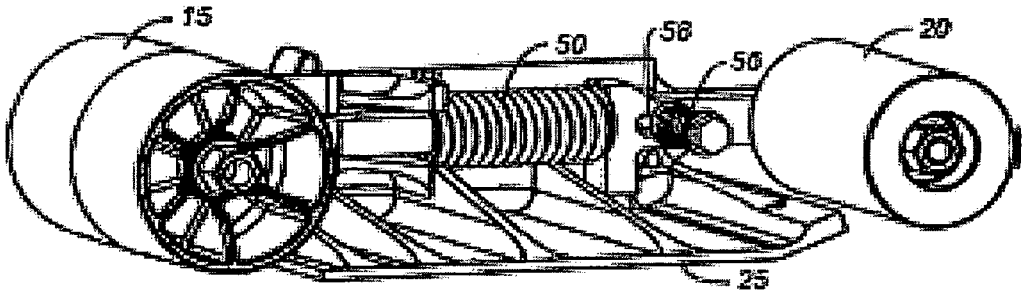
FIG. 25 is a perspective top and front side view of the belt tracking mechanism of FIG. 24.
Figure 26:
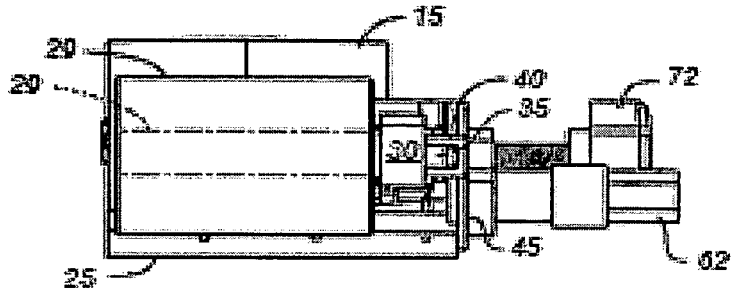
FIG. 26 is a cross sectional view of the belt tracking mechanism along a lateral section line of FIG. 25.
Figure 27:
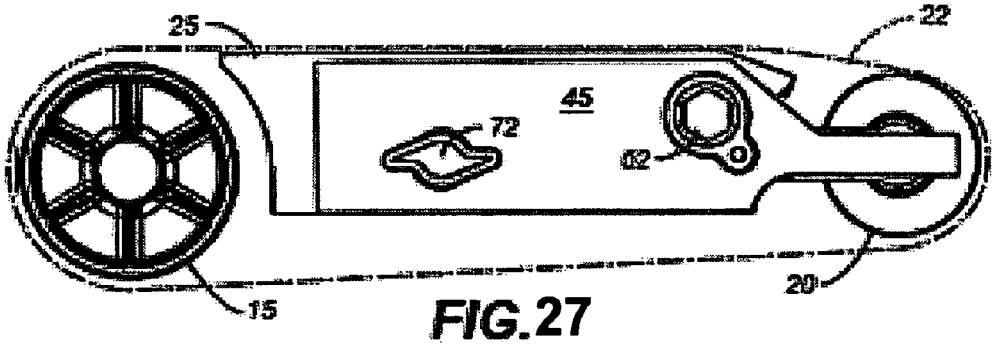
FIG. 27 is a backside view of the belt tracking mechanism of FIG. 24.
Figure 28:
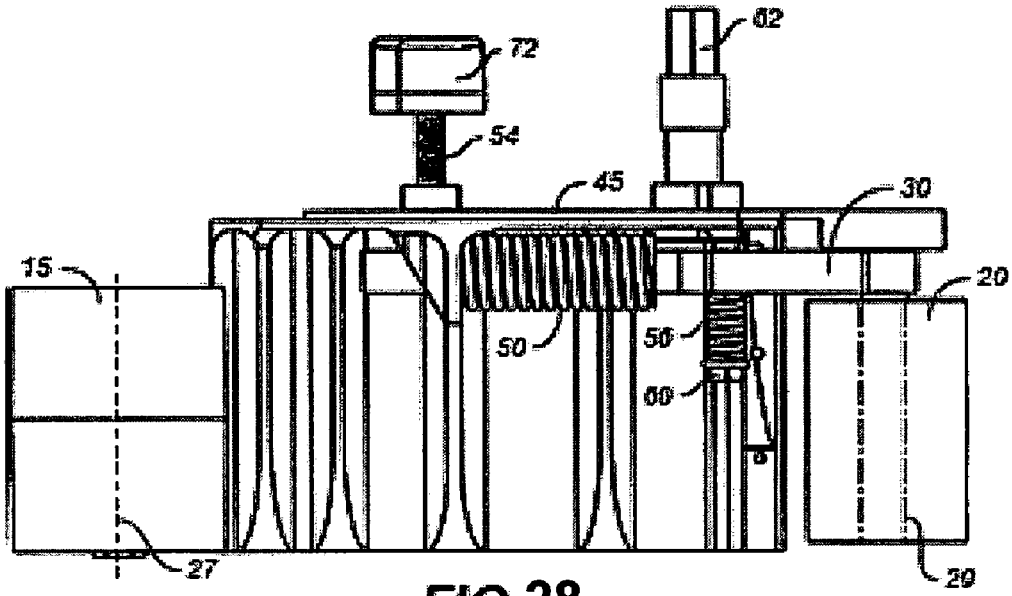
FIG. 28 is a top view of the belt tracking mechanism of FIG. 24.
Figure 29:
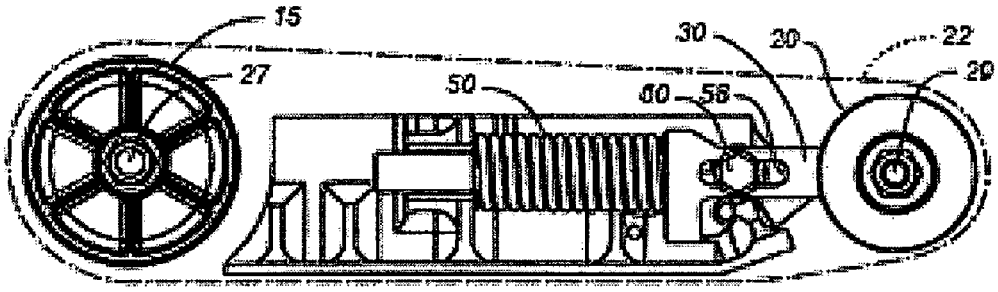
FIG. 29 is a front side view of the belt tracking mechanism of FIG. 24.

Referring to FIG. 24, for convention, the direction along which the drive and idle roller axes generally lie is deemed the "Y" axis or "lateral" direction; the "X" axis is the direction normal to the "Y" axis, and is termed the "longitudinal" direction, and defines a horizontal plane where the belt lies in; while the direction orthogonal to the "X" axis and "Y" axis is deemed the "vertical" axis or "Z" axis.

As explained more fully herein, one goal of the belt sander tracking mechanism 10 is to avoid as much as possible movement by the idle roller in the vertical direction along the Z axis; to allow movement of the idle roller relative to the drive roller in the longitudinal or X axis; and to allow the degree of parallelism between the drive and idle roller axes to be adjusted by varying the direction the axes point to in the lateral or Y axis.

Turning attention to the figures, with like numbered reference numbers referring to the same element, there is shown perspective top and topside view of the belt tracking mechanism 10, having a yoke 30, which may be made of, for example, sintered iron, holding the idle roller 20 at its end thereof, and having a protrusion 35 protruding from the back side of the yoke 30. The protrusion 35 may be coaxial with the axle 29 of the idle roller 20 and has a rounded or pointed tip 37 to minimize friction as it slideably traverses and translates along the X axis, along with the yoke 30. The protrusion is received by a longitudinally extending groove 40 built into a sidewall frame or sidewall body 45 of the frame of the belt sanding tracking mechanism 10. As may be appreciated, while in example embodiments the protrusion 35 may be part of the yoke 30, and may be received by a longitudinally extending groove 40 in the sidewall body 45 of the tracking mechanism 10, the groove 40 may be part of the yoke 30 and the protrusion 35 may be part of the side wall, or, to have the protrusion offset from being coaxial with the idle roller axis. The yoke protrusion 35 received by the groove 40 helps keep the idle roller 20 from rotating and torquing in the Z (vertical) direction. The idle roller 20 may be mounted about the idle roller axle 29 with antifriction bearings, to allow the idle roller to roll freely and still be firmly and rigidly attached to the axle and yoke assembly.

Opposing the yoke 30 are two springs designed to keep the yoke 30 in proper alignment. A longitudinally extending compression spring 50, which may be concentric and/or in parallel with yoke 30, biases the yoke in the X axis direction to properly tension the belt passing over the rollers, and allows the yoke 30 to move back and forth in the X axis direction while the sander is under power. The longitudinally extending compression string 50 may be received between two supports, a U-shaped buttress or fork 52 built into sidewall 45, which is fixed but laterally adjustable along an axis by threaded thumbscrew or threaded post 54, and a shoulder 55 integral with yoke 30. A laterally extending compression spring 56, which may be tightened in compression by shoulder bolt 60, keeps the yoke 30 pressed and aligned next to the sidewall 45. The yoke 30 may have a longitudinally extending slot 58 which receives the shaft of the shoulder bolt 60 and extends to a hexagonal shaft 62.

Figure 30:
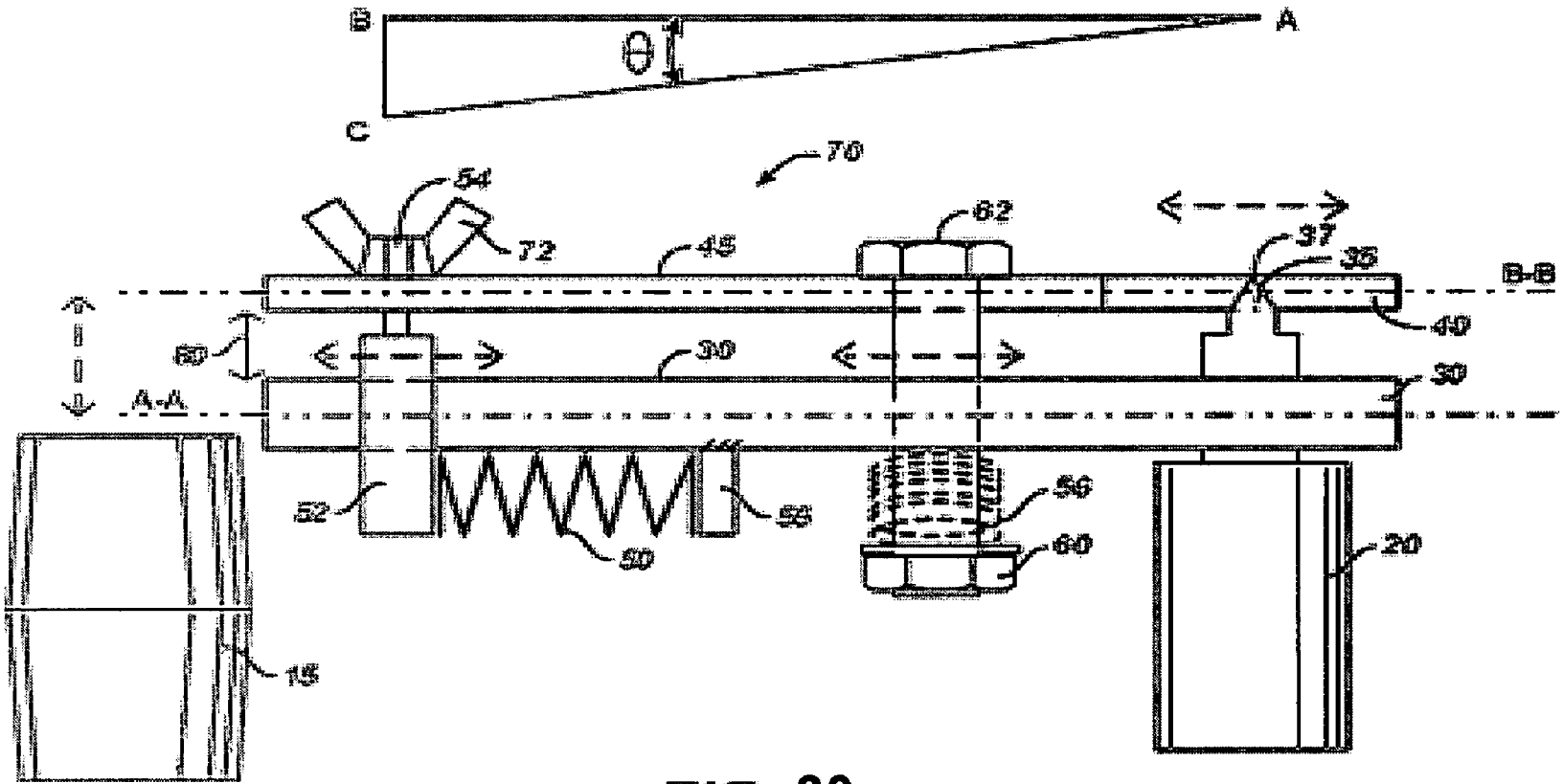
FIG. 30 is a schematic of a longitudinal cross section of the belt tracking mechanism of FIG. 24, showing a parallelism alignment adjustment mechanism of the belt sander of FIG. 24.

To keep the belt from wandering off the rollers the parallelism of the axes of the drive roller axis and idle roller axis can be adjusted. Turning attention now to FIG. 30, there is shown a schematic of a longitudinal cross section of the belt tracking mechanism showing a parallelism alignment adjustment mechanism 70. The parallelism adjustment mechanism 70 is for keeping the axis of the idle roller 20 and drive roller 15 in parallel, or substantially parallel, and to otherwise adjust the degree of parallelism between them. This is done by varying the degree of separation of angle theta ("θ"), which is the acute angle formed by the points of right triangle A-B-C. Point A is the pivot point where the tip 37 of protrusion 35 of the yoke 30 slideably engages and contacts the groove 40 of the sidewall 45. Points B and C are found along the threaded axis 54 of the threaded thumbscrew 72, which fixedly supports the U-shaped buttress or fork 52, which in turn slideably supports yoke 30, and represent the degree of separation between the yoke 30 from the side wall 45. The U-shaped buttress 52 is fixed in position to the sidewall 45 by the axis 54 of threaded thumbscrew 72, but may be moved in the Y-direction, laterally, by rotating the thumbscrew 72 by hand. In this way the distance 80 between the yoke 30 and the sidewall 45 may be varied. Thus the angle θ may be increased or decreased by increasing or decreasing the distance of side BC of right triangle ABC. By adjusting the threaded thumbscrew 72, the idle roller axis 29, which is generally perpendicular to the yoke 30, may also be moved by angle theta (θ) from a former position, and thus may be angularly moved relative moved to the drive roller axis 27, which is not fixed on the yoke. Thus the degree of parallelism between the axes of the two rollers 15 and 20 may be varied. In this way the belt surrounding the two rollers may be kept from slipping off.

Although described in terms of the example embodiments above, numerous modifications and/or additions to the above-described example embodiments would be readily apparent to one skilled in the art. For example, the pivot point "A" may be moved by having the protrusion 35 not coaxial with the idle roller axis 29, or the groove and protrusion may be interchanged, as explained above, or a different parallelism adjustment mechanism thumbscrew may be employed. In addition, other changes may be made, such as, for example, constructing a mechanism that straddles the outside of yoke 30 rather than have a shaft of the shoulder bolt 60 pass through the slot 58 in the yoke 30.

Thus, a belt tracking mechanism for a power belt sander having spring biased support that allows the idle roller to move in a longitudinal direction in the direction the sand belt is traveling is described, while constraining movement of the idle roller in a vertical direction perpendicular to the longitudinal direction. A hand-tightened mechanism allows for adjustment of the degree of parallelism between the idle roller and power roller axes, to allow proper belt tracking.

While certain features of the described implementations have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. A belt sander comprising:

a first roller;

a second roller;

a motor operationally coupled to the first roller to cause rotation thereof;

a groove formed in the first roller; and a band within the groove, the band around only the first roller being in contact with a sanding belt of the belt sander during operation thereof and configured to impart motion of the first roller to the sanding belt for rotation of the sanding belt around the first roller and the second roller.

2. The belt sander of claim 1 wherein the groove is formed around a circumference of the first roller.

3. The belt sander of claim 1 wherein the groove is formed substantially centered around a middle of the first roller.

4. The belt sander of claim 1 wherein the band includes an elastomer and/or rubber material.

5. The belt sander of claim 1 wherein the first roller includes a crowning at a center portion thereof.

6. The belt sander of claim 1 wherein the band protrudes beyond a surface of the rear roller.

7. The belt sander of claim 1 wherein the first roller includes a rear roller of the belt sander.

8. A belt sander comprising:

a sanding assembly having a front roller and a rear roller, the sanding assembly being configured to receive a sanding belt around the front roller and the rear roller to define a sanding surface therebetweeen, the rear roller having a groove and a drive band joined around only the rear roller within the groove and in contact with the sanding belt; and a motor operationally coupled to the sanding assembly, the motor being configured to rotate at least the rear roller and the drive band, and thereby rotate the sanding belt around the rear roller and the front roller.

9. The belt sander of claim 8 wherein the rear roller includes the groove formed around a circumference thereof, the groove containing the drive band.

10. The belt sander of claim 9 wherein the groove is formed substantially centered around a middle of the rear roller.

11. The belt sander of claim 9 wherein the groove and the drive band are the only groove and/or drive band associated with the rear roller.

12. The belt sander of claim 8 wherein the drive band includes an elastomer and/or rubber material.

13. The belt sander of claim 8 wherein the rear roller includes a crowning at a center portion thereof.

14. The belt sander of claim 8 wherein the drive band protrudes beyond a surface of the rear roller.

15. The belt sander of claim 8 comprising a handgrip formed around at least a portion of the motor and substantially encasing the motor.

* * * * *